US006634536B2

(12) United States Patent
Yoshie

(10) Patent No.: US 6,634,536 B2
(45) Date of Patent: Oct. 21, 2003

(54) ELECTRIC STAPLER

(75) Inventor: Toru Yoshie, Tokyo (JP)

(73) Assignee: Max Co., Ltd., Tokyo (JP)

( * ) Notice: Subject to any disclaimer, the term of this patent is extended or adjusted under 35 U.S.C. 154(b) by 27 days.

(21) Appl. No.: 09/749,844

(22) Filed: Dec. 26, 2000

(65) Prior Publication Data

US 2003/0042286 A1 Mar. 6, 2003

(30) Foreign Application Priority Data

| | | |
|---|---|---|
| Dec. 28, 1999 | (JP) | 11-374018 |
| Dec. 28, 1999 | (JP) | 11-375098 |
| Dec. 28, 1999 | (JP) | 11-375099 |
| Dec. 28, 1999 | (JP) | 11-375100 |
| Dec. 28, 1999 | (JP) | 11-375101 |
| Dec. 28, 1999 | (JP) | 11-375102 |
| Dec. 28, 1999 | (JP) | 11-375103 |
| Dec. 28, 1999 | (JP) | 11-375104 |

(51) Int. Cl.[7] ..... B25C 1/06; B27F 7/21
(52) U.S. Cl. ..... 227/131; 227/155
(58) Field of Search ..... 227/155, 131, 227/131.2, 138

(56) References Cited

U.S. PATENT DOCUMENTS

| | | | | |
|---|---|---|---|---|
| 2,770,805 A | * | 11/1956 | Elzer et al. | 227/120 |
| 4,726,505 A | * | 2/1988 | Okazaki | 227/120 |
| 5,269,451 A | * | 12/1993 | Udagawa et al. | 227/120 |
| 5,454,503 A | * | 10/1995 | Udagawa et al. | 227/120 |
| 5,460,314 A | * | 10/1995 | Udagawa | 227/131 |
| 5,584,471 A | * | 12/1996 | Muck et al. | 227/123 |
| 5,605,268 A | * | 2/1997 | Hayashi et al. | 227/131 |
| 5,676,299 A | * | 10/1997 | Yoshie et al. | 227/120 |
| 5,791,543 A | * | 8/1998 | Udagawa et al. | 227/131 |
| 5,975,396 A | * | 11/1999 | Manabe | 227/131 |
| 6,068,173 A | * | 5/2000 | Sueda | 227/131 |
| 6,164,513 A | * | 12/2000 | Yoshie | 227/119 |

* cited by examiner

*Primary Examiner*—Rinaldi I. Rada
*Assistant Examiner*—Paul R Durand
(74) *Attorney, Agent, or Firm*—Chapman and Cutler LLP

(57) ABSTRACT

An electric stapler includes a case with a reciprocating staple forming plate and driver. A motor is connected to a planetary gearbox to provide a small electric stapler.

11 Claims, 72 Drawing Sheets

ELECTRIC STAPLER

BACKGROUND OF THE INVENTION

1. Field of the Invention

The present invention relates to an electric stapler that sends a sheet staple contained in a chamber to one end of a driving passage, forms the staple sent to the one end of the driving passage in a U-letter shape by means of a forming plate, and shoots the staple formed in the U-letter shape to the other end of the driving passage by means of a driver.

2. Description of the Prior Art

Conventionally, an electric stapler has been known which includes a table that mounts a sheet bundle, a main body that loads a cartridge containing the sheet staple, a drive mechanism that elevates the table, and a driver that shoots a staple into the sheet bundle from the shooting portion of the cartridge.

The drive mechanism is provided with a drive motor, a reduction gear train that the drive motor rotates, and a drive shaft that the reduction gear train rotates. The drive shaft is provided with a table cam that moves the table vertically, a driver cam that moves the driver vertically, and the like. And, one rotation of the drive shaft makes one vertical reciprocating motion of the table, and interlocking with the reciprocating motion of the table, the driver shoots out the staple from the shooting portion. And, a clincher mechanism provided with the table clinches the legs of the staple that have shot out of the sheet bundle, thus completing a series of filing operation.

Now, in this type of the electric stapler, the drive motor is disposed in the direction perpendicular to the sending direction of the staple, and plural shafts of the reduction gears attached to the side walls are arrayed in parallel to the motor spindle. Accordingly, the plural reduction gears are placed in parallel on the sidewalls, and the plural and parallel installation of the reduction gears enlarges the main body vertically and laterally, which is a disadvantage. Further, a link mechanism that moves the driver vertically is provided between the driver cam and the driver, and the driver is moved up and down through this link mechanism. Accordingly, the structure becomes complicated and the main body becomes still more enlarged, which is also disadvantageous.

SUMMARY OF THE INVENTION

The present invention has been made in view of the foregoing circumstances of the conventional technique, and an object of the invention is to provide a construction of an electric stapler, whereby the stapler can be made smaller.

According to one aspect of the invention, the electric stapler, to accomplish the foregoing object, includes inside a body case: a sending means that sends out a sheet staple contained in a chamber to one end of a driving passage, a forming plate and a driver disposed to be able to reciprocate, a holder that holds the forming plate and the driver and makes the forming plate and the driver reciprocate, a drive shaft that reciprocates the holder, and a motor that rotates the drive shaft. And, a forward motion of the forming plate forms a staple sent out to the one end of the driving passage in a U-letter shape, the forward motion of the driver shoots out the staple formed in the U-letter shape from the other end of the driving passage, and a clincher mechanism clinches the legs of the staple shot out. And, in the electric stapler with this construction, the drive shaft is disposed on one centric straight line with a spindle of the motor, and planet gears for reduction that rotate the drive shaft by rotation of the motor spindle are disposed along the drive shaft.

BRIEF DESCRIPTION OF THE DRAWINGS

[FIG. 66] is an explanatory chart of a shooting portion of the conventional electric stapler;

[FIG. 67] is an enlarged view of a part in [FIG. 66];

[FIG. 68] is an explanatory chart illustrating the positional relation of the driver, the forming plate, the anvil portion, and the pusher.

DETAILED DESCRIPTION OF THE EMBODIMENT

Figure 1B:
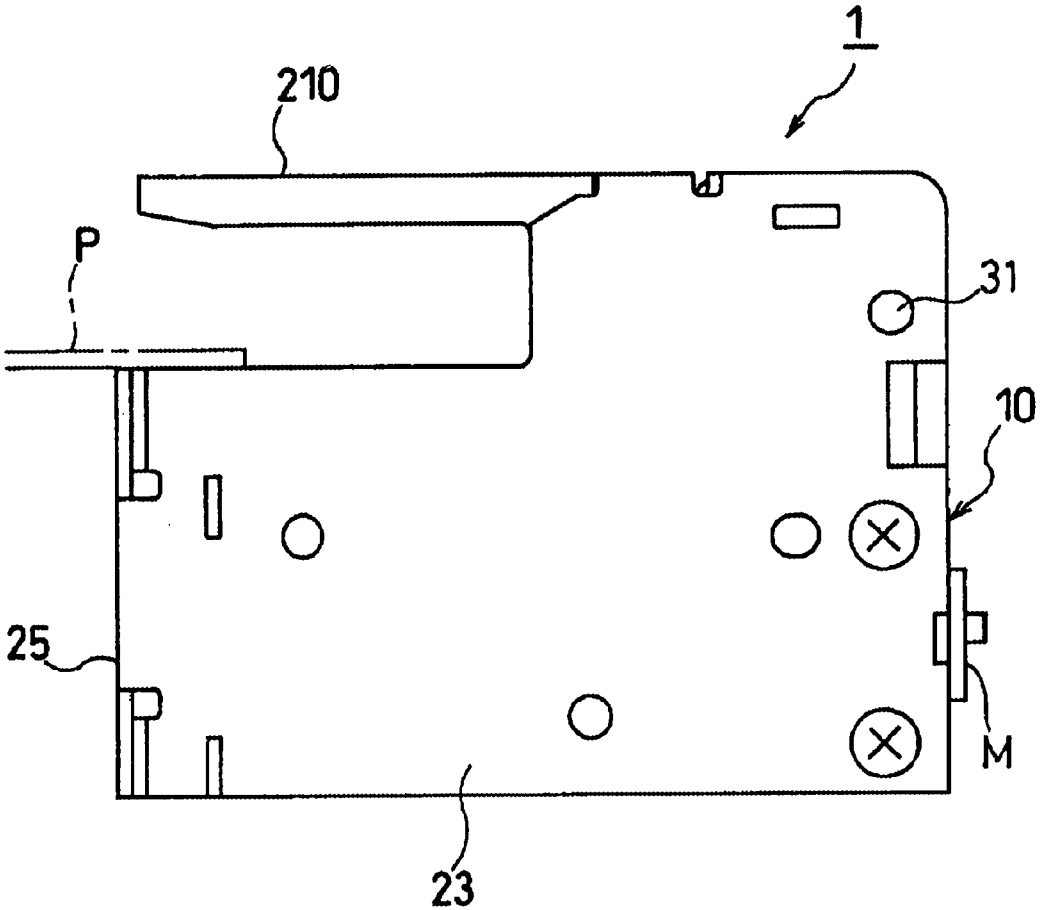
FIG. 1(B) is a side view of the electric stapler.
Figure 1A:
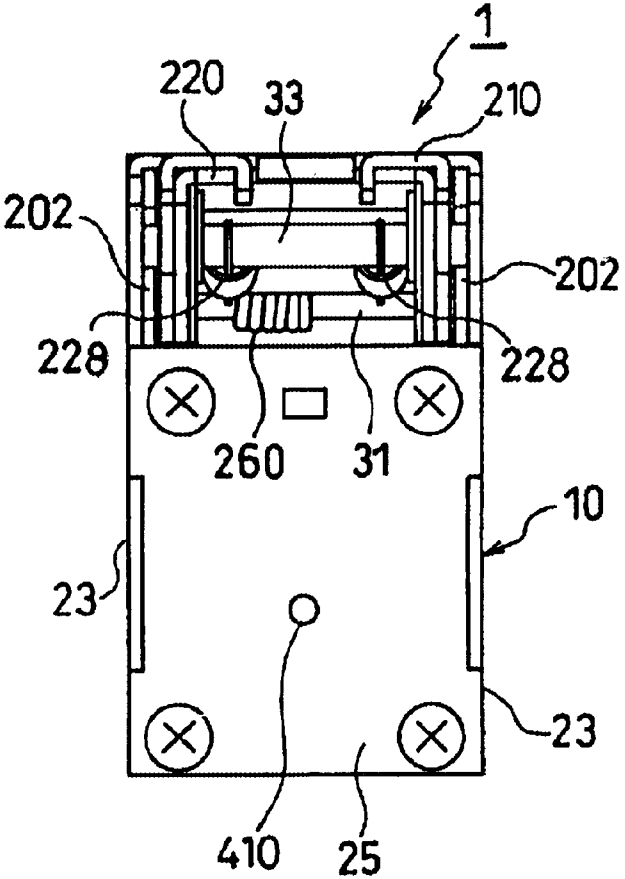
FIG. 1(A) is a front view illustrating the outlook of the electric stapler relating to the invention.
Figure 2A:
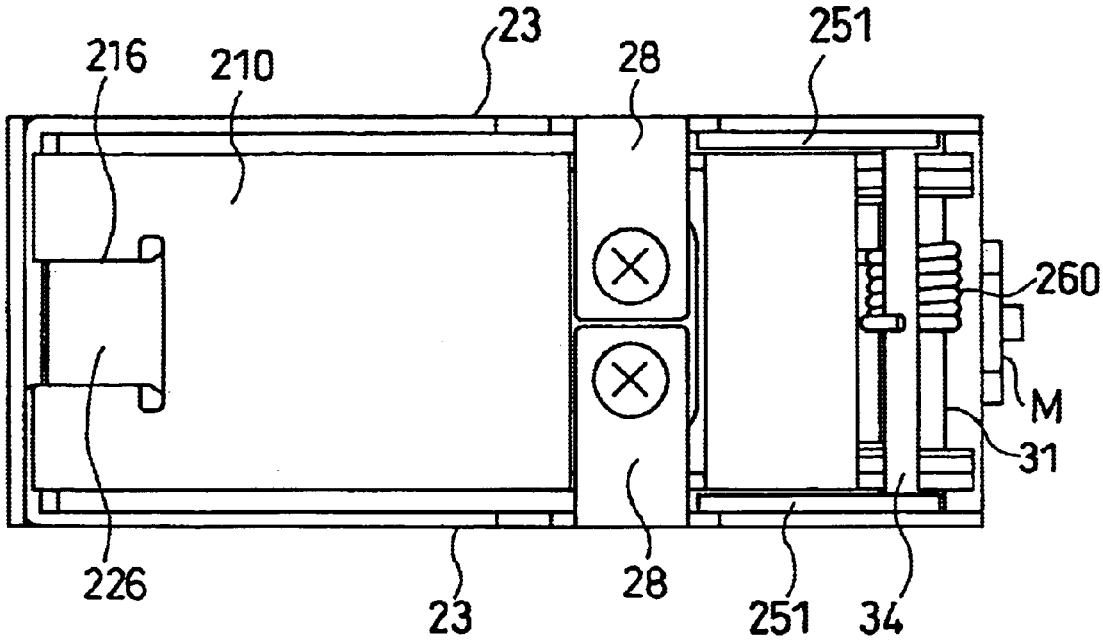
FIG. 2(A) is a plan view of the electric stapler shown in FIG. 1.
Figure 2B:
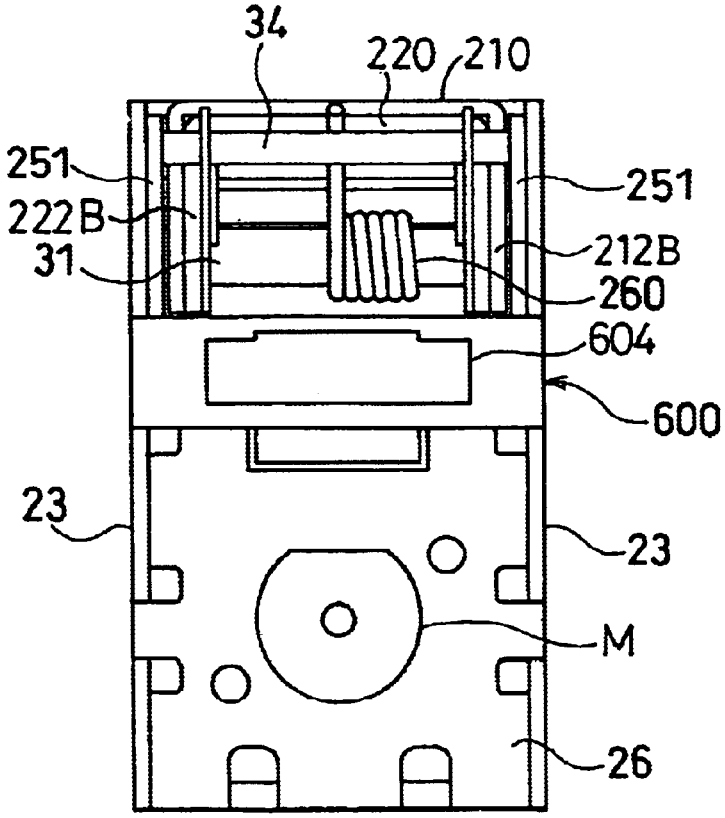
FIG. 2(B) is a rear view of the electric stapler shown in FIG. 1.

The embodiment of an electric staple relating to the invention will now be described on the basis of the accompanying drawings.

An electric staple 1 as shown in FIG. 1 through FIG. 4 has a stapler body 10 and a cartridge 600 detachably mounted on the stapler body 10.

The stapler body 10 includes a shooting mechanism 100 that shoots a staple S from a driving passage 601 provided with the cartridge 600, a clincher mechanism 200 that enfolds the tip portions of the staple shot, a sending mechanism 300 that sends a sheet staple ST piled up in the cartridge 600 to one end of the driving passage 601, a drive mechanism 400 that drives the mechanisms 100, 200, and 300, and an anvil mechanism 500 that retreats the anvil described later from the driving passage 601, after forming the staple in a U-letter shape.

Figure 3:
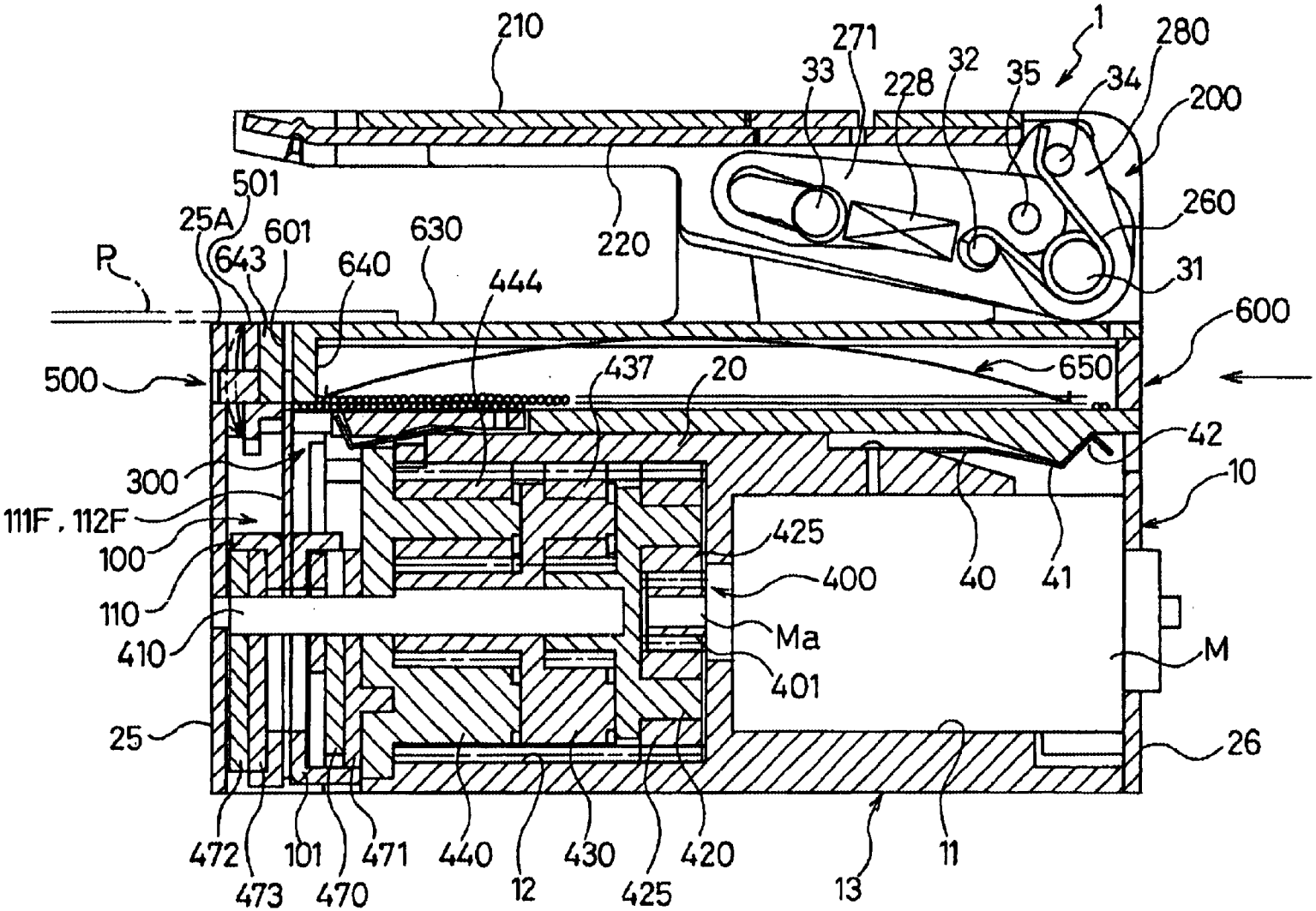
FIG. 3 is a vertical sectional view illustrating the construction of the electric stapler in FIG. 1.
Figure 5:
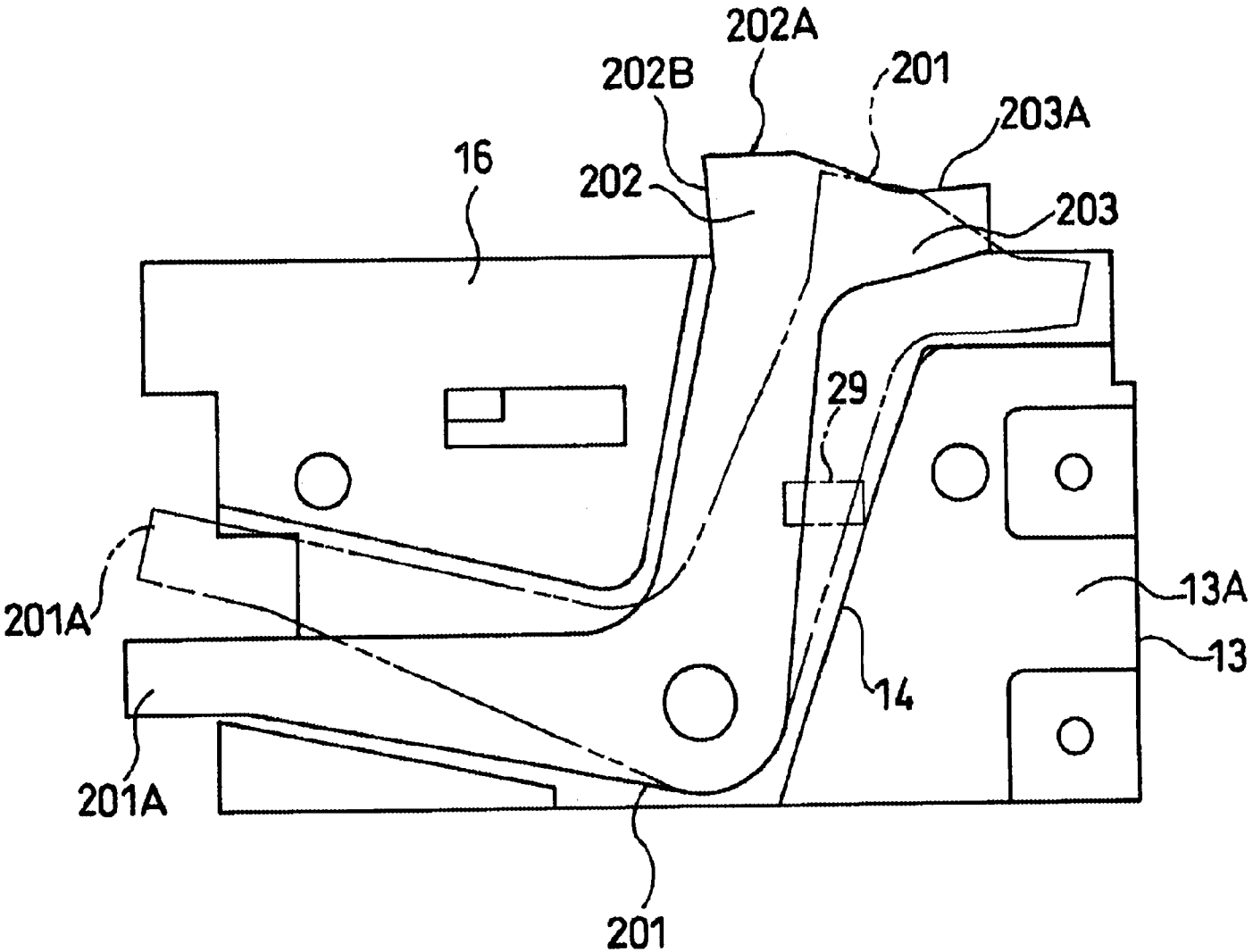
FIG. 5 is an explanatory chart of a state in which the clincher links are mounted.

As shown in FIG. 3, the stapler body 10 is provided with a motor chamber 11 of which section is virtually circular and a body case 13 in which a gear chamber 12 is formed, and inside the gear chamber 12 are formed inner teeth 12A. As shown in FIG. 5, L-letter formed grooves 14, 14 are formed on both sides 13A, 13A of the body case 13. The front ends of the grooves 14, 14 are made open, which reach the front ends of the sides 13A, 13A. Similarly, the upper ends of the grooves 14, 14 are made open, which reach the upper ends of the sides 13A, 13A. And, clincher links 201 are attached to each of the groves 14, 14 in such a manner that they can swing to the position of the dotted lines.

Figure 6A:
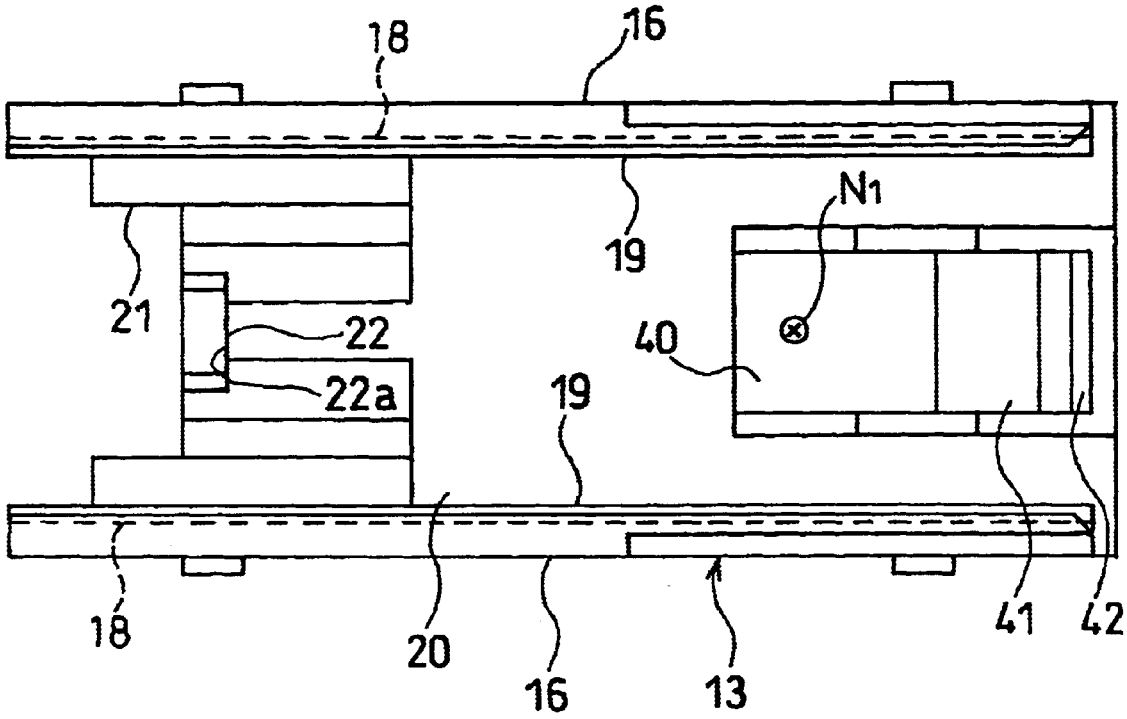
FIG. 6(A) is a plan view of the body case.
Figure 6B:
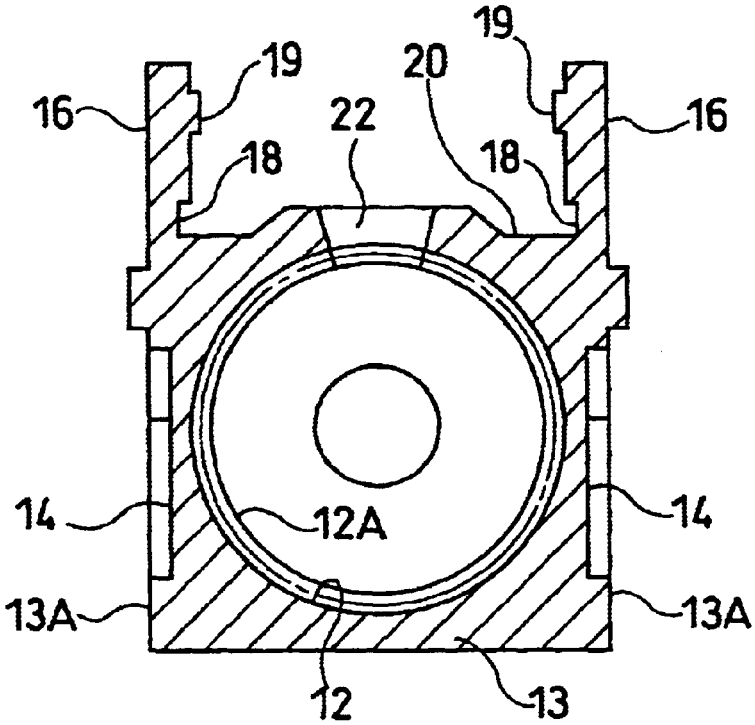
FIG. 6(B) is a sectional view of the body case.

As shown in FIG. 6, upper walls 16, 16 having a specific height and depth are formed on the upper portions of the body case 13. Guide grooves 18, 18 are formed along the upper walls 16, 16 on the inner lower portions thereof. Guide projections 19, 19 are formed along the upper walls 16, 16 on the inner upper portions thereof. A recess 21 is formed on the front end of a ceiling wall 20 of the body case 13, and a notch 22 is formed on the center of the recess 21.

Figure 7:
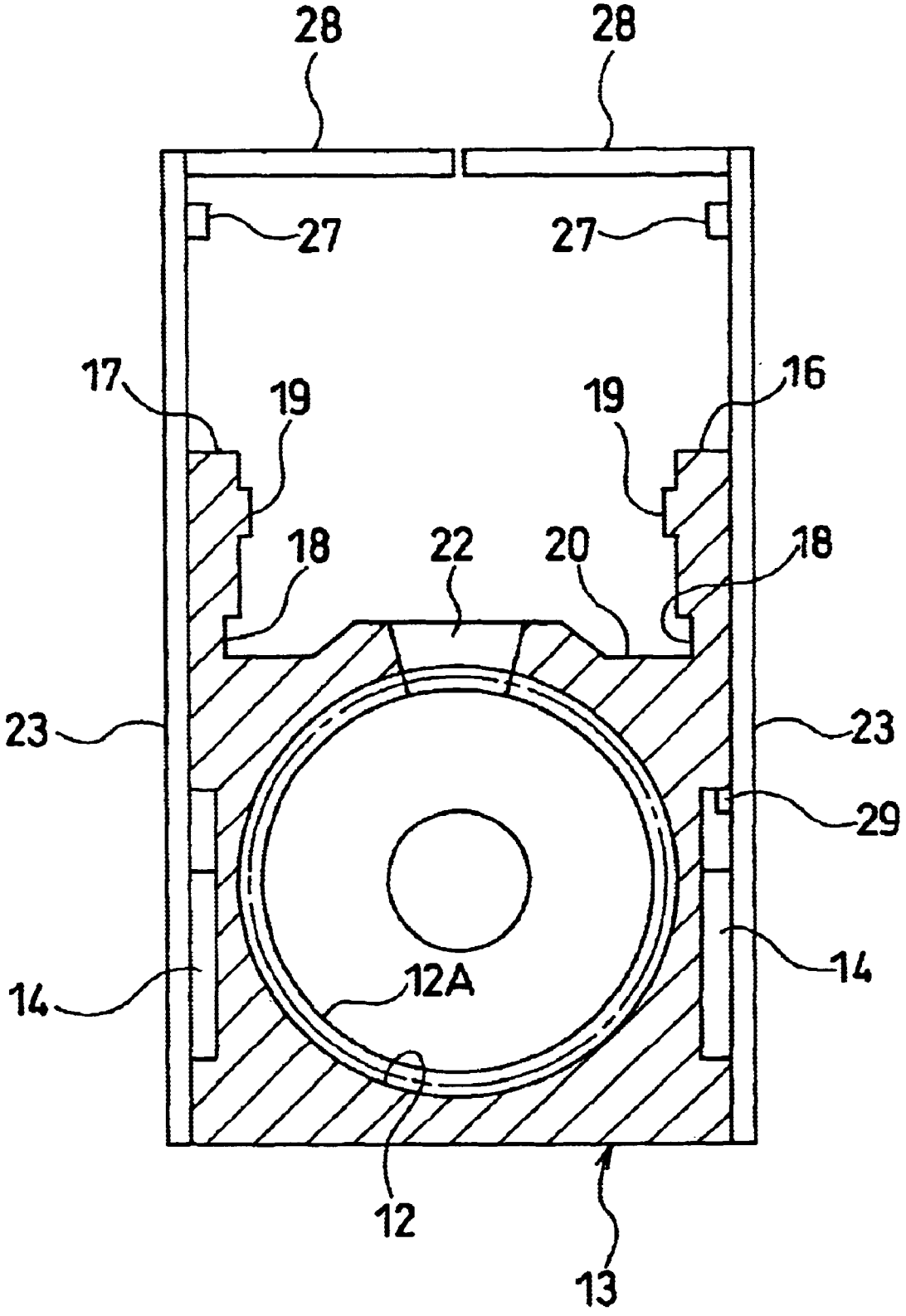
FIG. 7 is an explanatory chart of a state in which the side plates are mounted to the body case.

Side plates 23, 23 are attached to both the sides 13A, 18A of the body case 13, as shown in FIG. 7. A front plate 25 and a rear plate 26 are attached to the front side and the rear side of the body case 13. Flat projections 27, 27 are formed on and inside the upper portions of the side plates 23, 23 (see FIG. 46), and the side plates 23, 23 have contact portions 28, 28 extending inward on the upper ends thereof. Further, a micro switch 29 is attached on one side plate 23, which detects that the clincher link 201 stays at the solid line position (see FIG. 5). When the clincher link 201 stays at the solid line position, a forming holder 110 described later is at the home position (the position illustrated in FIG. 3).

A fixed spring 40 is attached by a screw N1 on the backside of the ceiling wall 20 of the body case 13. The fixed spring 40 has a virtually V-letter formed nadir 41 and a crest 42 formed on the back of the nadir 41.

Drive Mechanism

The drive mechanism 400 contains, as shown in FIG. 3, a drive gear 401 attached onto a motor spindle Ma of a motor M, a first mid gear holder 420 mounted on a drive shaft 410, a second mid gear holder 430 mounted on the drive shaft 410, a drive gear holder 440, a driver cam 470, a driver return cam 471, a forming cam 472, a forming return cam 473, and the like. The drive gear holder 440 and the cams 470 to 473 are mounted on the D-cut portion of the drive shaft 410, which rotate together with the drive shaft 410.

Further, the motor M is installed under the cartridge 600 in such a manner that the direction of the motor spindle Ma of the motor M coincides with the sending direction of the sheet staple ST of the cartridge 600 described later. And, the motor spindle Ma and the drive shaft 410 are on the same straight line.

First Mid Gear Holder

Figure 8B:
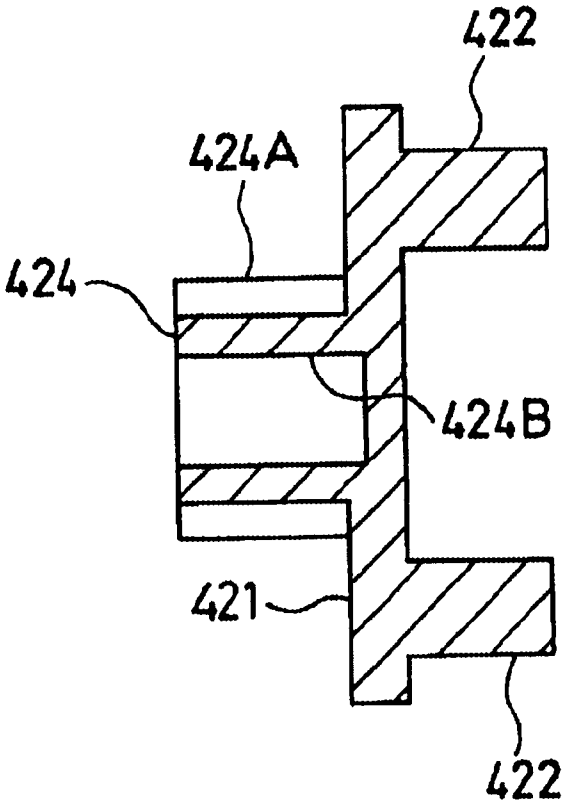
FIG. 8(B) is a sectional view of the first mid gear holder.
Figure 8A:
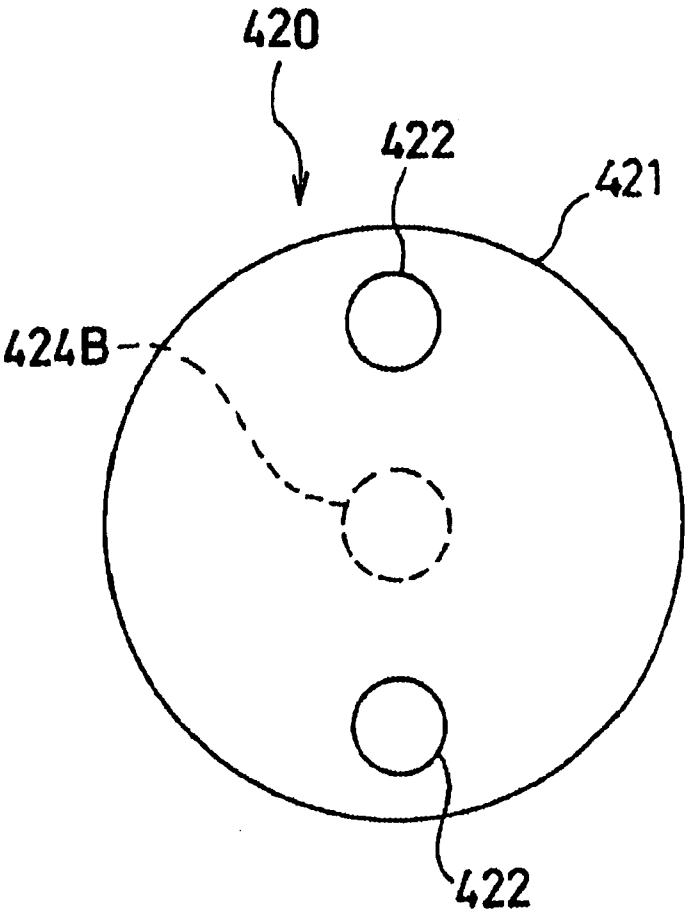
FIG. 8(A) is a front view of the first mid gear holder.

As shown in FIG. 8, the first mid gear holder 420 has a disc 421, a pair of shafts 422, 422 is formed on one side of the disc 421 to be symmetrical with the center thereof, and a shaft 424 is formed on the center of the other side of the disc 421. A gear 424A is formed on the circumference of this shaft 424, and a hole 424B is formed to hollow the shaft 424. Planet gears 425, 425 are mounted on the shafts 422, 422 so that they can rotate freely (see FIG. 3), The planet gears 425, 425 are engaged with the inner teeth 12A of the gear chamber 12, and with the drive gear 401 as well One end of the drive shaft 410 is inserted in the hole 424B of the shaft 424 of the first mid gear holder 420, which is supported to be rotatable. The other end of the drive shaft 410 is supported to be rotatable on the front plate 25.

Second Mid Gear Holder

Figure 9A:
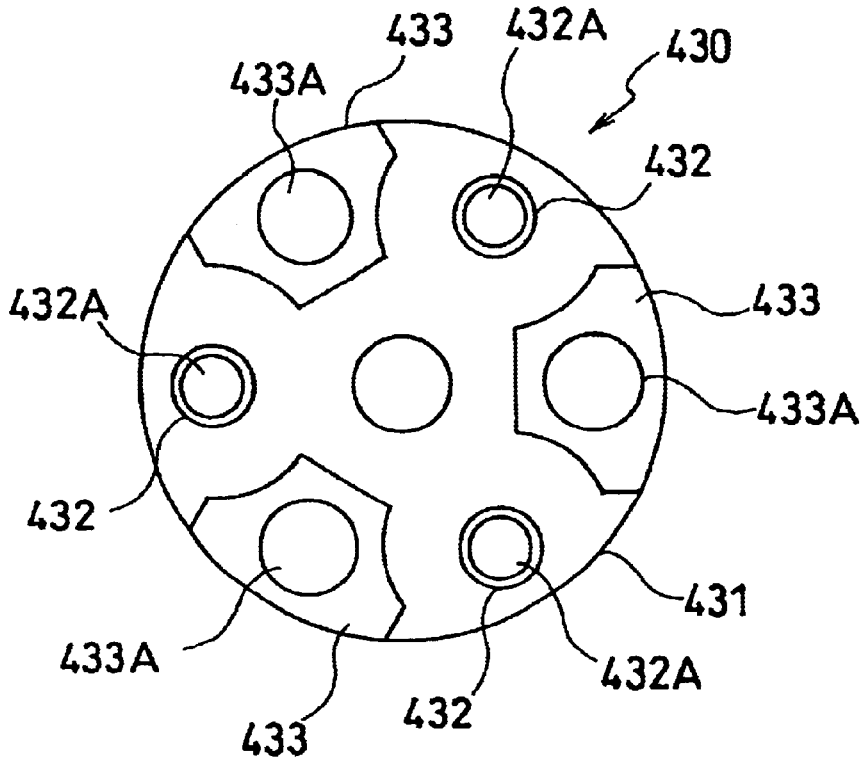
FIG. 9(A) is a front view of the second mid gear holder.
Figure 9B:
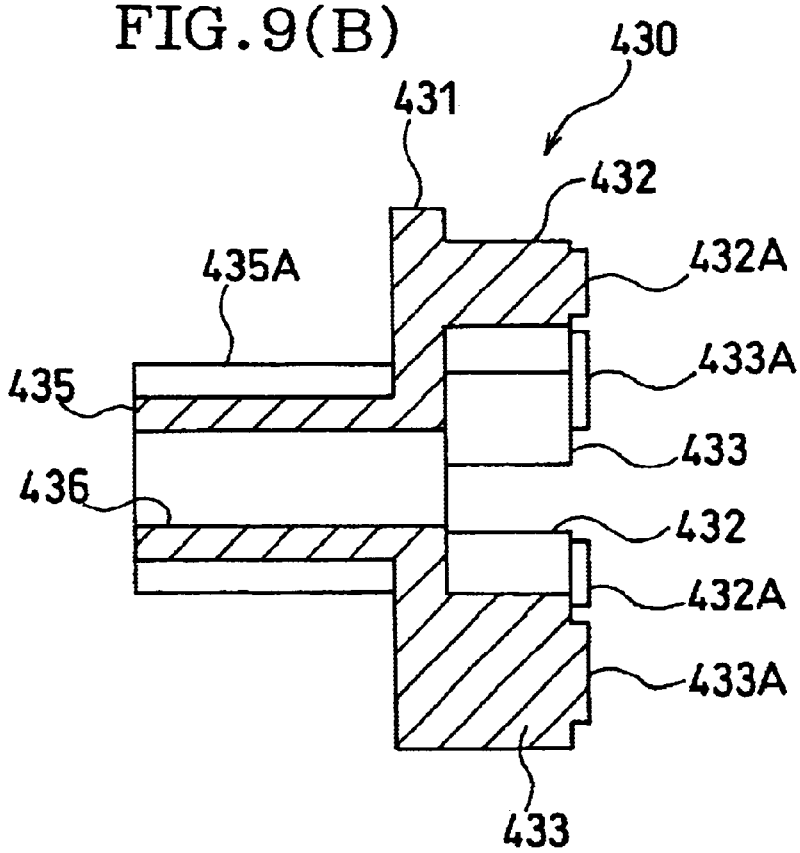
FIG. 9(B) is a sectional view of the second mid gear holder.

As shown in FIG. 9, the second mid gear holder 430 has a disc 431, on one side of which are formed three shafts 432 and three retaining portions 433 having the same heights as the shafts 432, which are disposed alternately with an equal distance along the periphery of the disc 431. Projections 432A having a smaller diameter than the shaft 432 are formed on each of the end faces of the shafts 432, and circular projections 433A axe formed on each of the end faces of the retaining portions 433. Further, a shaft 435 is formed on the other side of the disc 431, and a gear 435A is formed to surround the shaft 435. A through hole 436 is formed through the shaft 435 and the disc 431. As shown in FIG. 3, the drive shaft 410 is inserted through the through hole 436, and the second mid gear holder 430 is mounted to be rotatable on the drive shaft 410.

And, planet gears 437 are mounted each on the shafts 432 so that they can freely rotate (see FIG. 3). The planet gears 437 are engaged with the inner teeth 12A of the gear chamber 12 and with the gears 424A of the first mid gear holder 420 as well.

Figure 10:
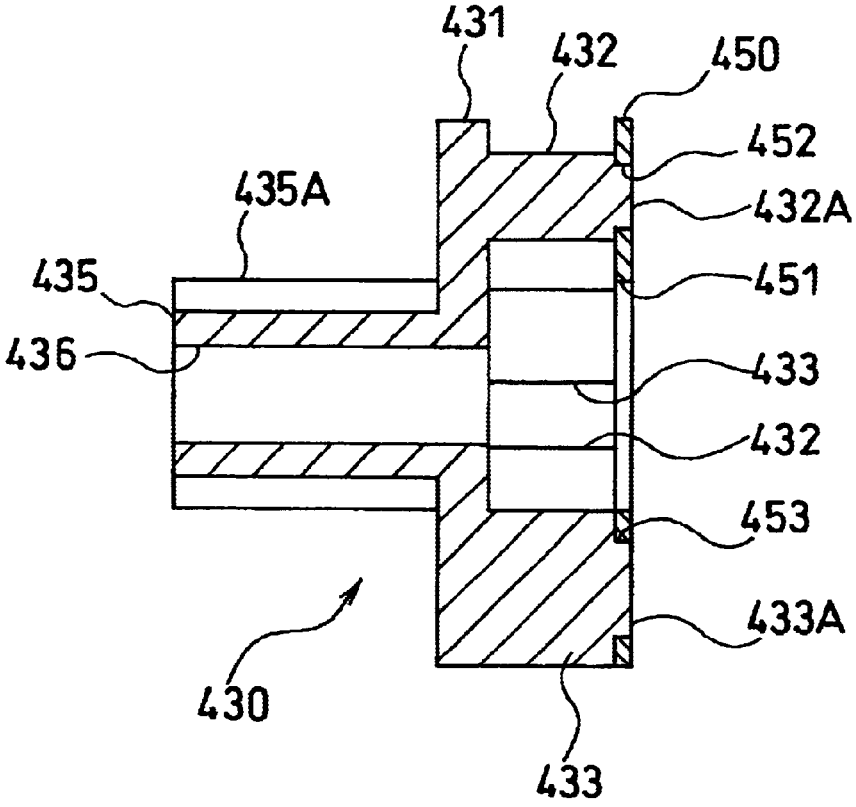
FIG. 10 is a sectional view of a state in which the gear plate is attached to the second mid gear holder.

As shown in FIG. 10, a gear plate 450 is attached to the retaining portions 433 of the second mid gear holder 430. The gear plate 450 has a hole 451 formed on the center thereof, and three smaller holes 452 and three larger holes 453 formed around the hole 451 so that the smaller holes and the larger are alternately arranged. The projections 433A of the retaining portions 433 of the second mid gear holder 430 are engaged in the larger holes 453, so that the gear plate 450 is attached to the retaining portions 433 of the second mid gear holder 430.

Further, the projections 432A of the shafts 432 are engaged in the smaller holes 452 of the gear plate 450, whereby one end of the shafts 432 are retained in the smaller holes 452 of the gear plate 450. That is, the disc 431 and the gear plate 450 retain both the ends of the shafts 432, whereby the strength of the shafts 432 are secured. The gear plate 450 is omitted in FIG. 3.

Drive Gear Holder

Figure 13:
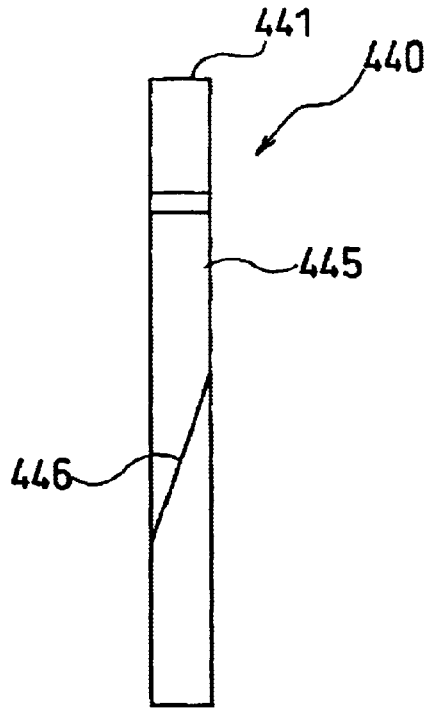
FIG. 13 is a side view of the disc of the drive gear holder.
Figure 14:
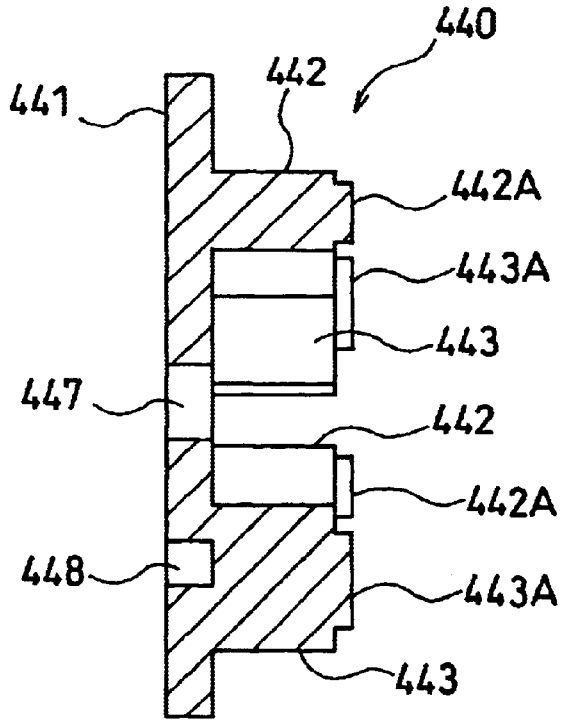
FIG. 14 is a sectional view of the drive gear holder.
Figure 15:
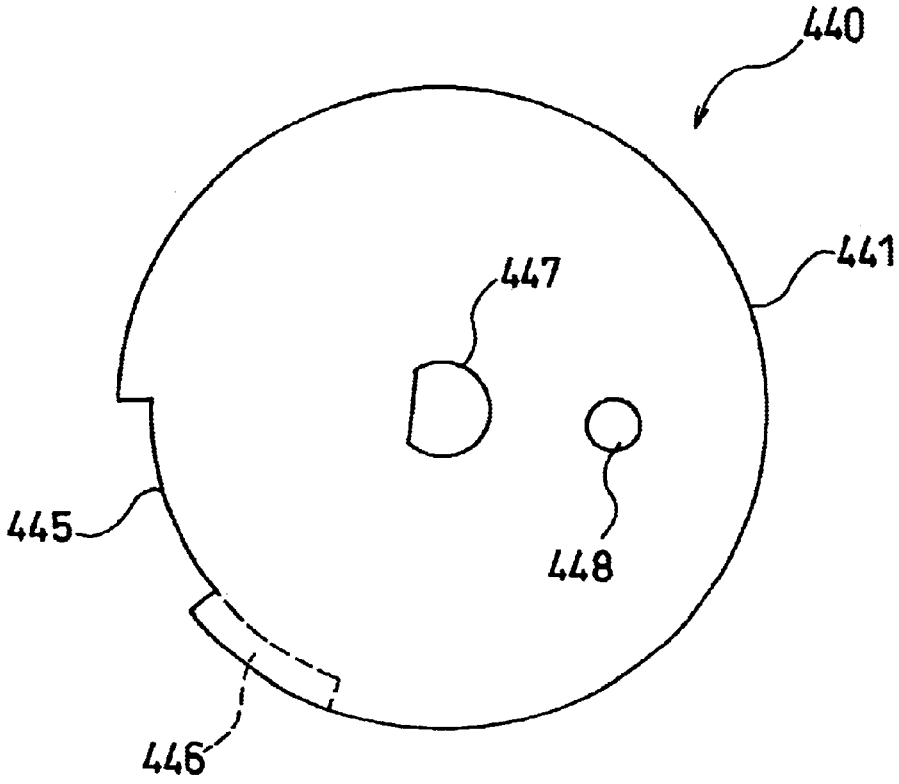
FIG. 15 is a rear view of the drive gear holder.

As shown in FIG. 12 through FIG. 15, the drive gear holder 440 has a disc 441. On one side of the disc 441, three shafts 442 and three retaining portions 443 having the same heights as the shafts 442 are formed alternately with an equal distance along the periphery of the disc 441. In FIG. 13, the shafts 442 and the retaining portions 443 are omitted.

Projections 442A having a smaller diameter than the shaft 442 are formed on each of the end faces of the shafts 442, and circular projections 443A are formed on each of the end faces of the retaining portions 443. And, planet gears 444 are mounted each on the shafts 442 so that they can freely rotate, and they are engaged with the inner teeth 12A of the gear chamber 12 and with the gears 435A of the second mid gear holder 430 as well.

Figure 11:
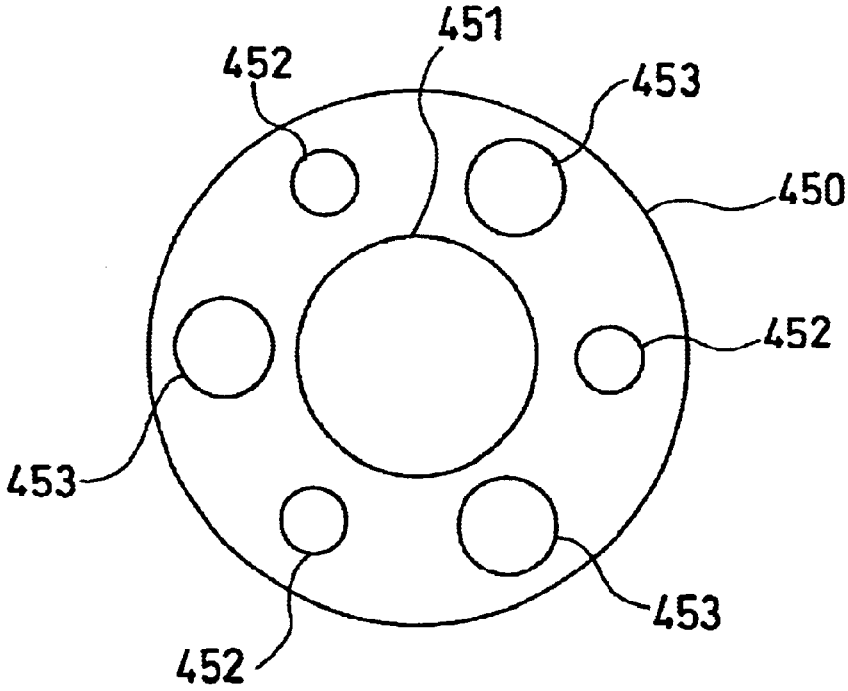
FIG. 11 is an explanatory chart of the gear plate.
Figure 12:
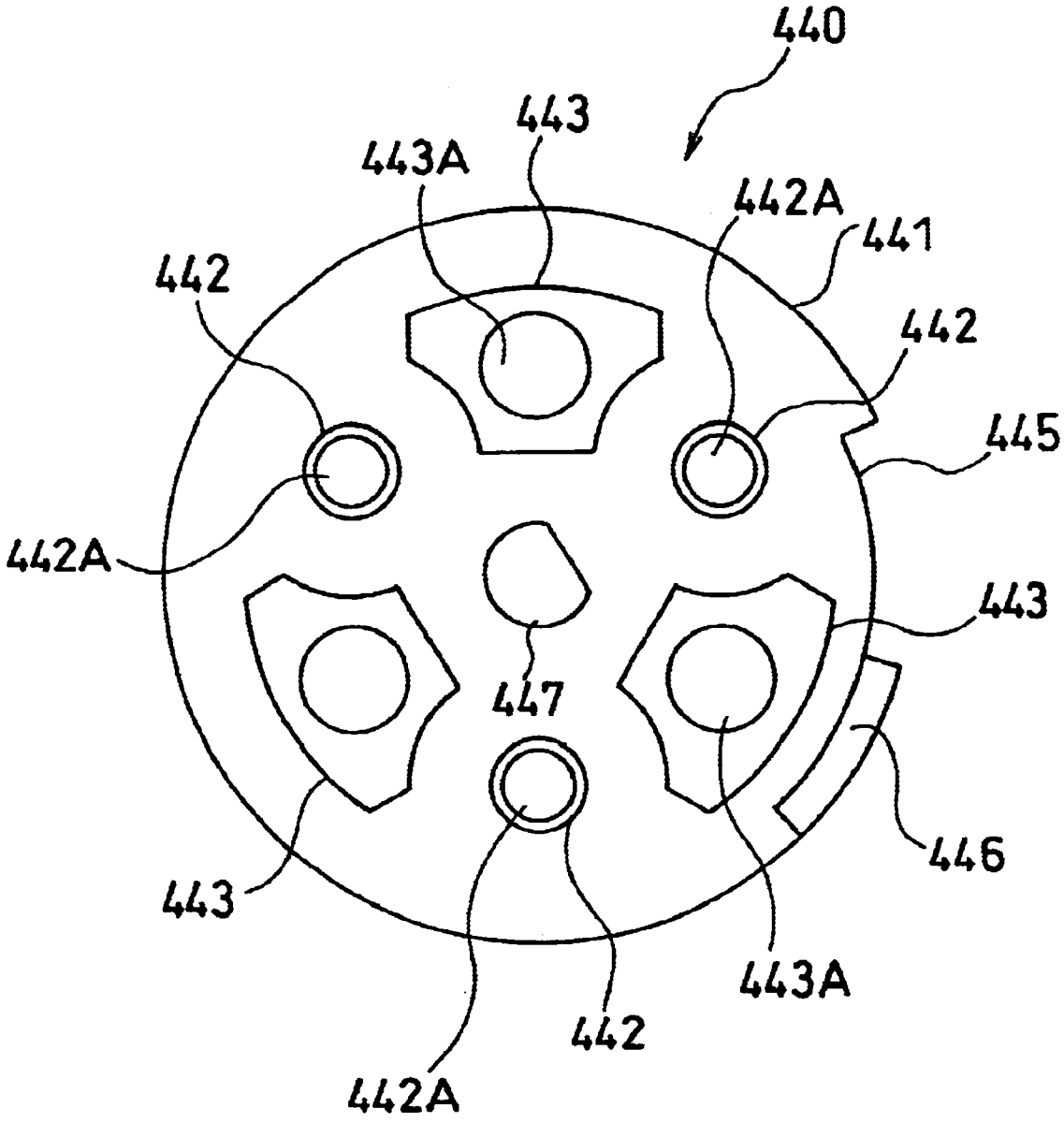
FIG. 12 is a font view of the drive gear holder.

The gear plate 450 illustrated in FIG. 11 is attached to the retaining portions 443 of the drive gear holder 440, in the same manner as in the second mid gear holder 430. The gear plate 450 ensures the strength of the shafts 442.

Further, on the periphery of the disc 441 is formed an arched notch 445 having a specific breadth, which extends along the circumference. On the periphery thereof is formed a slope 446 that extends along the circumference from one side to the other side of the disc 441. The slope 446 has the same thickness as the notch 445, and is formed continuously to the notch 445. A shaft hole 447 is formed on the center of the disc 441, and a hole 448 is formed on the other side of the disc 441, between the shaft hole 447 and the peripheral edge. The drive shaft 410 is put through the shaft hole 441 of the disc 441.

As the motor spindle Ma of the motor M rotates, the rotation turns the drive gear holder 440 by way of the planet gears 425, 437, 444, and the first and second mid gear holders 420, 430. The rotation of the drive gear holder 440 turns the drive shaft 410. The planet gears 425, 437, 444, and the gears 424A, 434A of the first, second mid gear holders 420, 430 constitute a reduction gear. The planet gears 425, 437, 444 are arranged to surround the drive shaft 410.

Driver Cam

Figure 16:
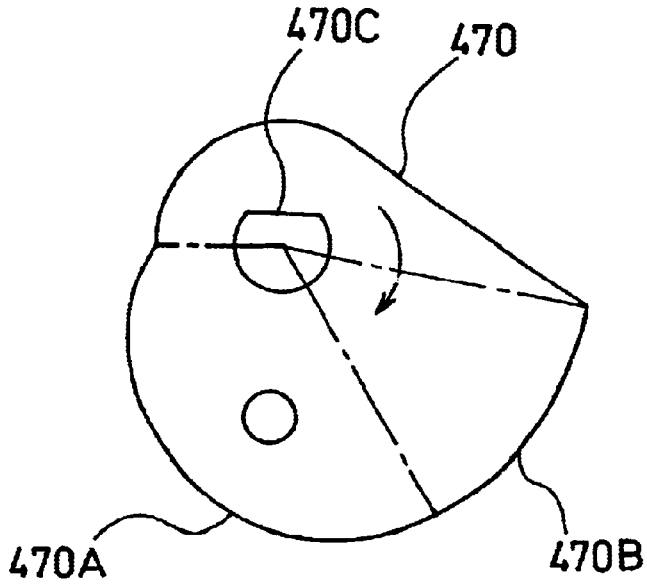
FIG. 16 is an explanatory chart of the driver cam.

As shown in FIG. 16, the driver cam 470 has a cam face 470A for shooting the staple S (the face whose diameter increases clockwise) and a cam face 470B for completely shooting the staple S (the face whose diameter becomes the maximum). Further, the driver cam 470 has a shaft hole 470C formed thereon, and the drive shaft 410 is engaged in the shaft hole 470C, and the driver cam 470 turns clockwise (in FIG. 16) together with the drive shaft 410.

Driver Return Cam

Figure 17:
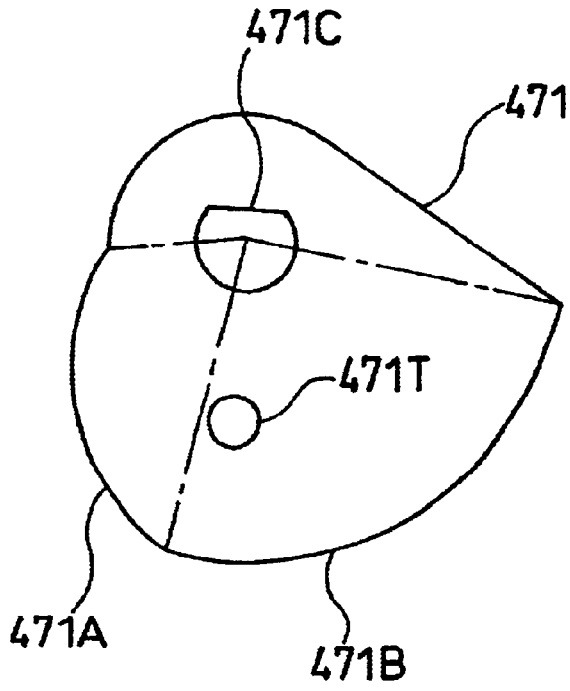
FIG. 17 is an explanatory chart of the driver return cam.

As shown in FIG. 17, the driver return cam 471 has a cam face 471A for returning the driver to the home position (the face whose diameter increases clockwise) and a cam face 471B for staying the driver at the home position (the face whose diameter becomes the maximum). Further, the driver return cam 471 has a projection 471T formed on one side thereof and the projection 471T is inserted in the hole 448 of the disc 441 of the drive gear holder 440 (see FIG. 3). Also, the driver return cam 471 has a shaft hole 471C formed thereon, and the drive shaft 410 is engaged in the shaft hole 471C as shown in FIG. 3, and the driver return cam 471 turns clockwise (in FIG. 17) together with the drive shaft 410.

Figure 18:
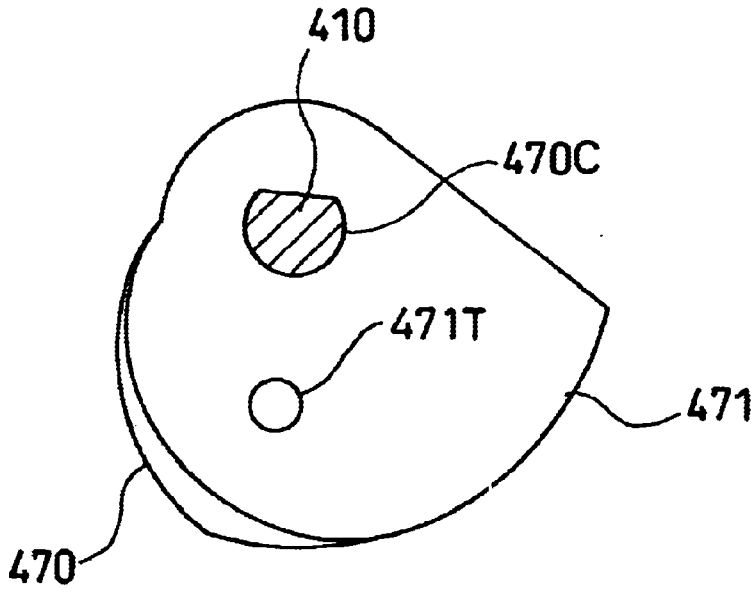
FIG. 18 is an explanatory chart of a state in which the driver cam and the driver return cam are overlapped.

The driver cam 470 and the driver return cam 471 are mounted on the drive shaft 410 in a state that they are overlapped, as shown in FIG. 18.

Forming Cam

Figure 19:
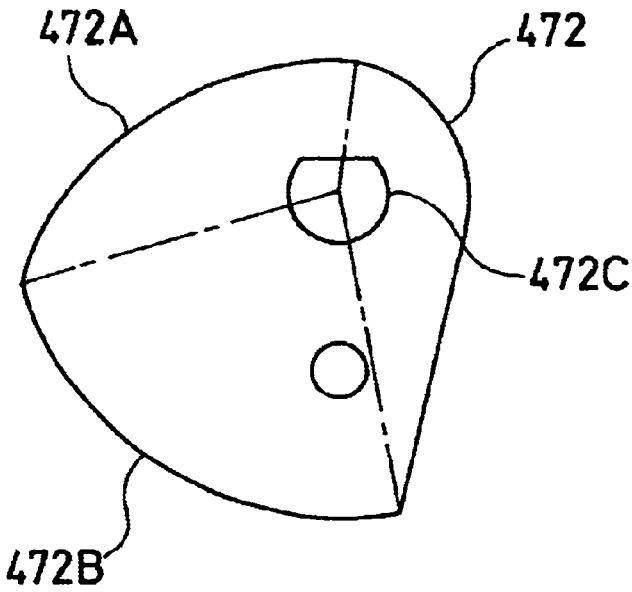
FIG. 19 is an explanatory chart of the forming cam.

As shown in FIG. 19, the forming cam 472 has a cam face 472A for forming the staple S in a U-letter shape (the face whose diameter increases clockwise) and a cam face 472B whose diameter becomes the maximum. Further, the forming cam 472 has a shaft hole 472C formed thereon, and the drive shaft 410 is engaged in the shaft 472C as shown in FIG. 3, and the forming cam 472 turns clockwise (in FIG. 19) together with the drive shaft 410.

Forming Return Cam

Figure 20:
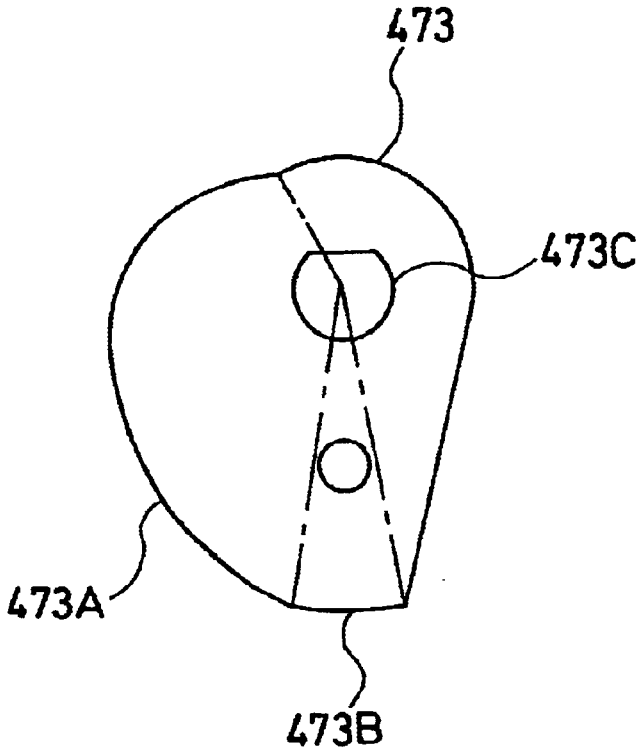
FIG. 20 is an explanatory chart of the forming return cam.

As shown in FIG. 20, the forming return cam 473 has a cam face 473A for returning the forming holder 110 described later to the home position (the face whose diameter increases clockwise) and a cam face 473B for staying the forming holder 110 at the home position (the face whose diameter becomes the maximum). Further, the forming return cam 473 has a shaft hole 473C formed thereon, and the drive shaft 410 is engaged in the shaft 473C, and the forming return cam 473 turns clockwise (in FIG. 20) together with the drive shaft 410.

Figure 21:
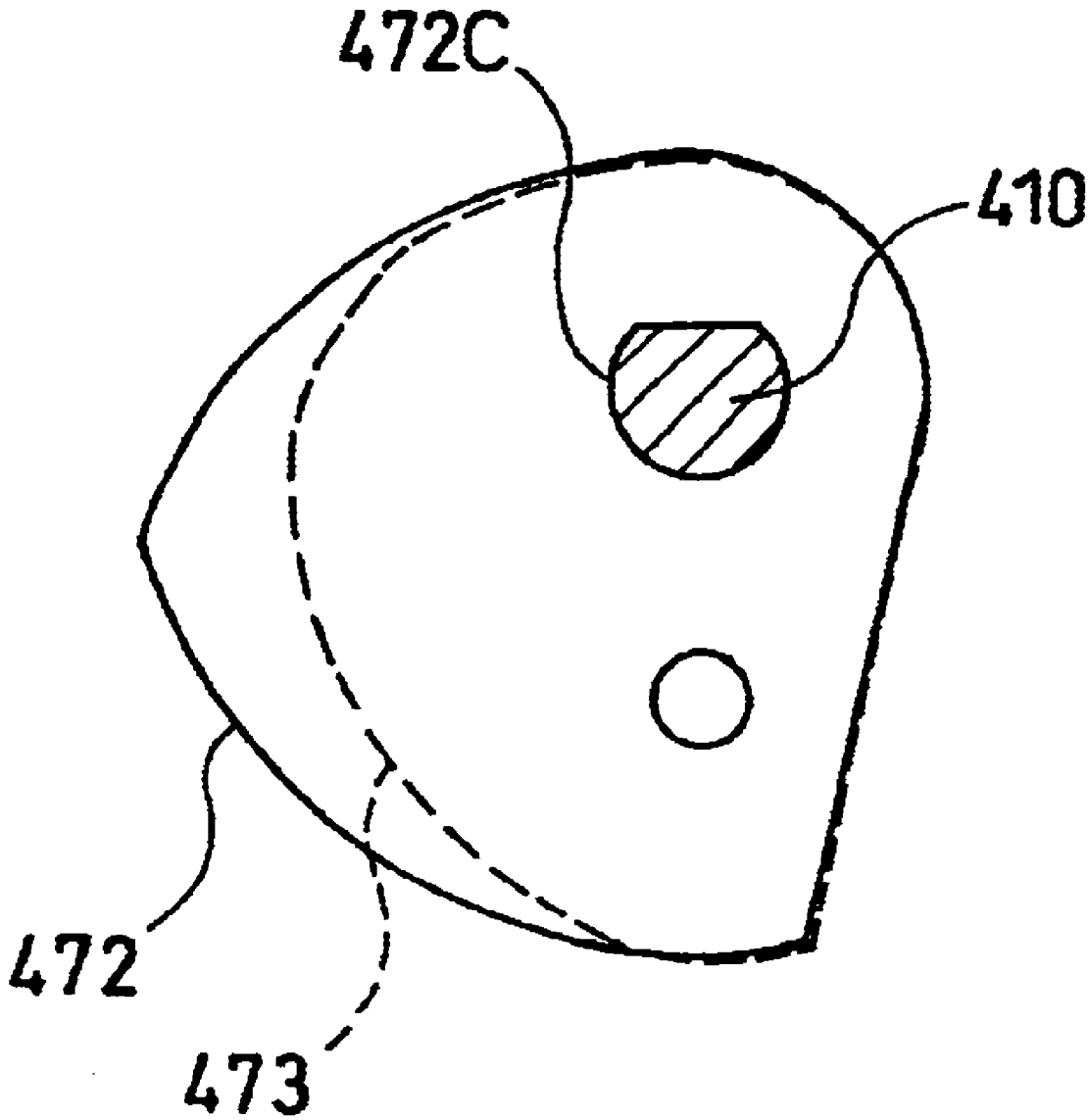
FIG. 21 is an explanatory chart of a state in which the forming cam and the forming return cam are overlapped.

The forming cam 472 and the forming return cam 473 are mounted on the drive shaft 410 in a state that they are overlapped, as shown in FIG. 21.

Shooting Mechanism

The shooting mechanism 100 includes a driver holder 101, a driver attached to the driver holder 101, the forming holder 110, forming plates 111, 112 attached to the forming holder 110.

Driver Holder

Figure 22A:
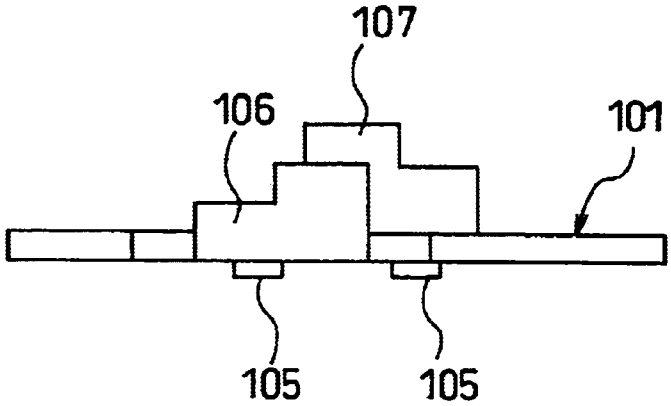
FIG. 22(A) is a plan view of the driver holder.
Figure 22B:
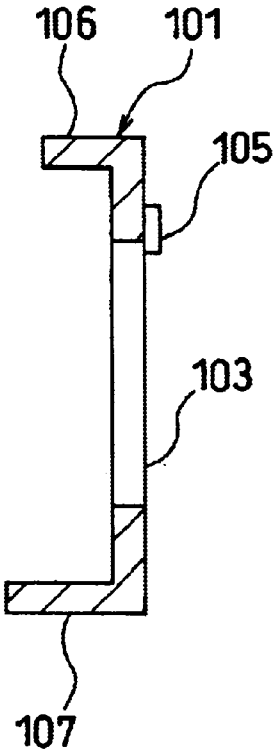
FIG. 22(B) is a sectional view of the driver holder.
Figure 22C:
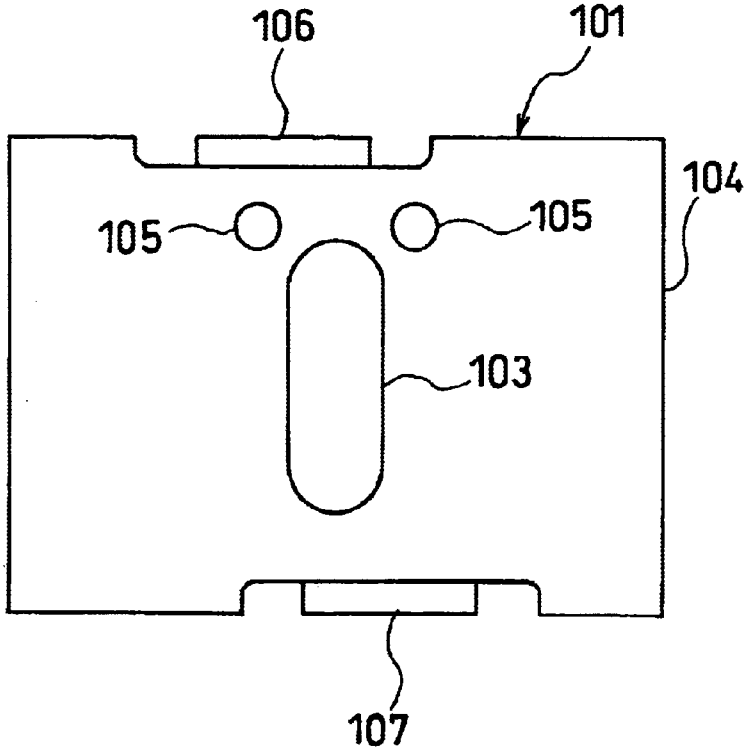
FIG. 22(C) is a front view of the driver holder.
Figure 23:
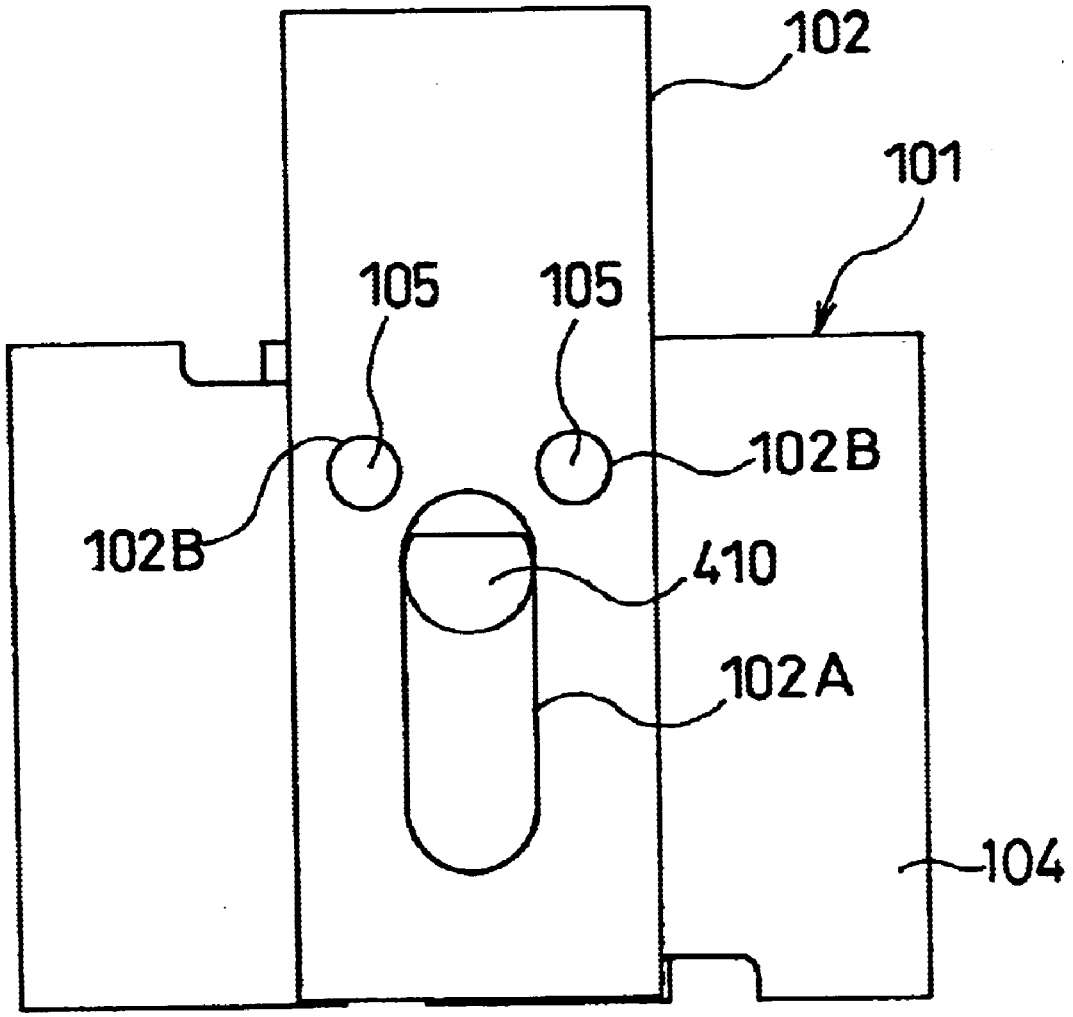
FIG. 23 is an explanatory cart of a state in which the driver is attached to the driver holder.

As shown in FIG. 22, the driver holder 101 has a virtually rectangular plate 104 with a vertical long hole 103 formed thereon. The plate 104 has a pair of projections 105 formed on one side thereof on the positions above the long hole 103 that are symmetrical to the long hole 103. Further, the plate 104 has contact portions 106, 107 formed on the upper and lower ends thereof which stick out on the other side, and the contact portion 107 sticks out longer by a specific length than the contact portion 106.

Driver

Figure 28:
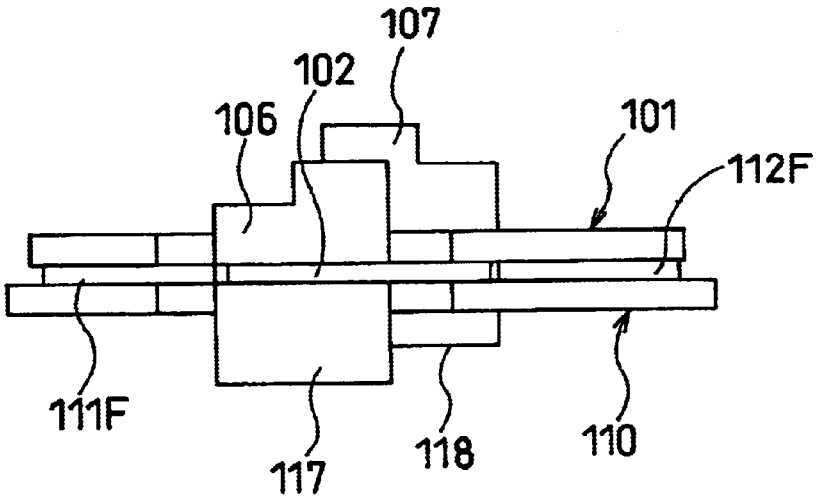
FIG. 28 is an explanatory chart illustrating the positional relation between the driver holder and the forming holder.

As shown in FIG. 28, the driver 102 has a vertically long rectangular shape; and it has a long hole 102A formed on the lower side, which has the same size as the long hole 103 of the driver holder 101. The driver 102 has a pair of holes 102B formed on the positions above the long hole 102A that are symmetrical to the long hole 102A. The projections 105 of the driver holder 101 are engaged in the holes 102B, whereby the driver 102 is attached to the driver holder 101.

Figure 24:
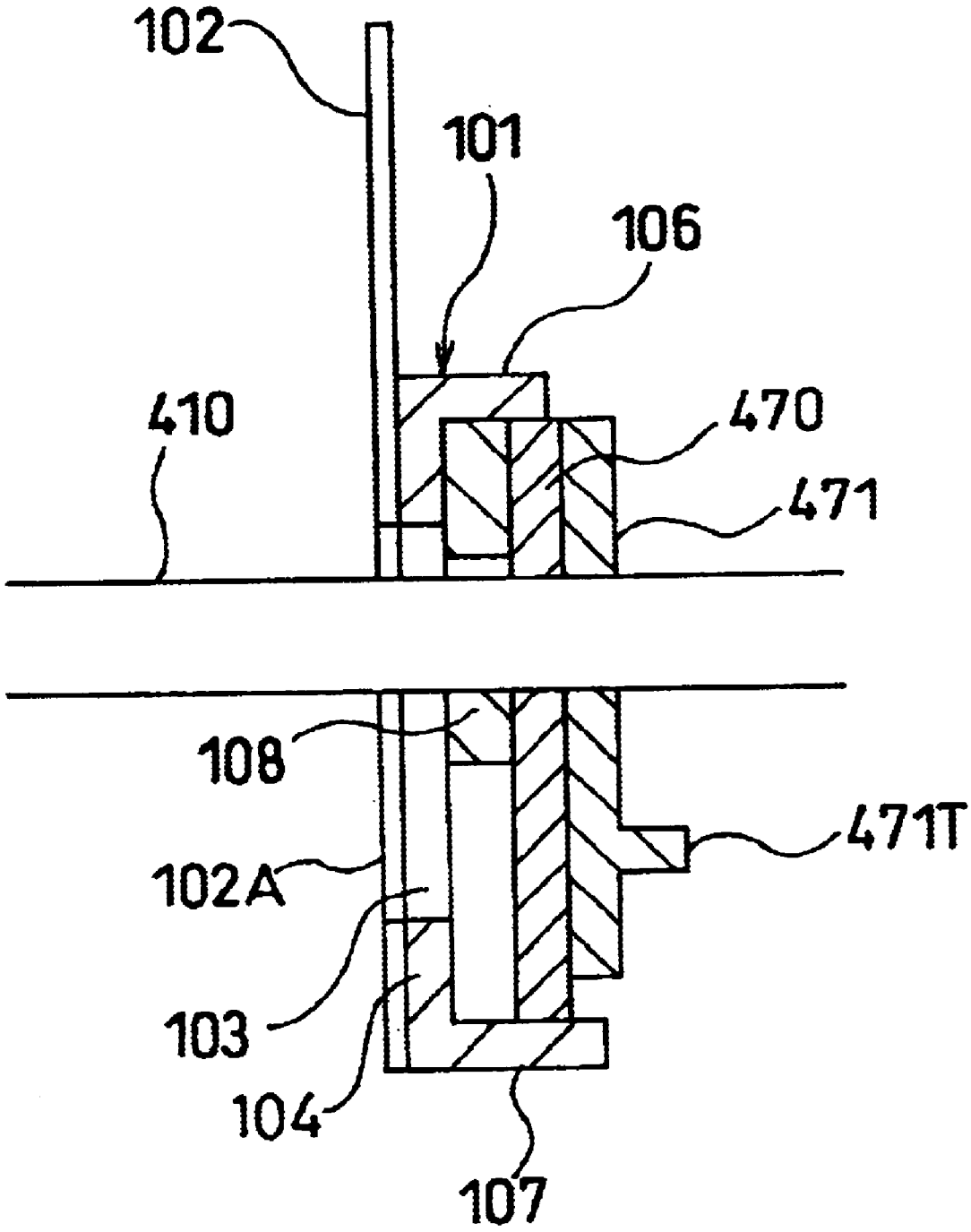
FIG. 24 is an explanatory chart illustrating the positional relation of the driver holder, the driver cam, and the driver return cam.

The drive shaft 410 is inserted through the long holes 103 and 102A of the driver holder 101 and the driver 102, and the long holes 103 and 102A allow the driver holder 101 and the driver 102 to move vertically to the drive shaft 410. Further, as shown in FIG. 24, the driver cam 470 and the driver return cam 471 mounted on the drive shaft 410 are disposed with a spacer 108 between the contact portions 106, 107 of the driver holder 101. The driver cam 470 is in contact with the contact portions 106, 107; and the driver return cam 471 is in contact only with the contact portion 107. The rotation of the driver cam 470 lifts up the driver holder 101, and the rotation of the driver return cam 471 brings down the driver holder 101.

Forming Holder

Figure 25A:
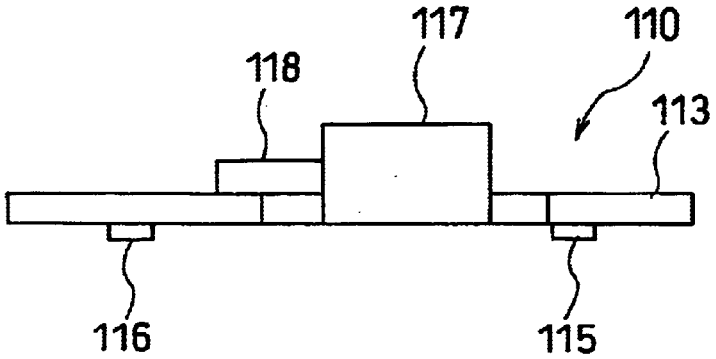
FIG. 25(A) is a plan view of the forming holder.
Figure 25B:
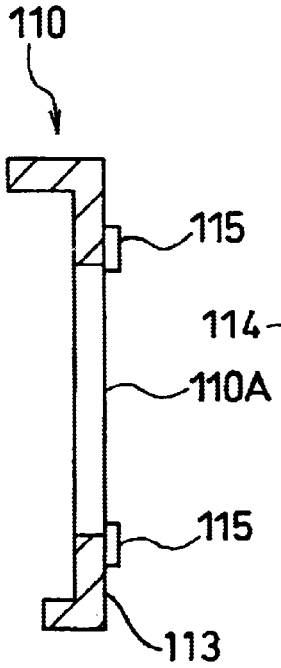
FIG. 25(B) is a sectional view of the forming holder.
Figure 25C:
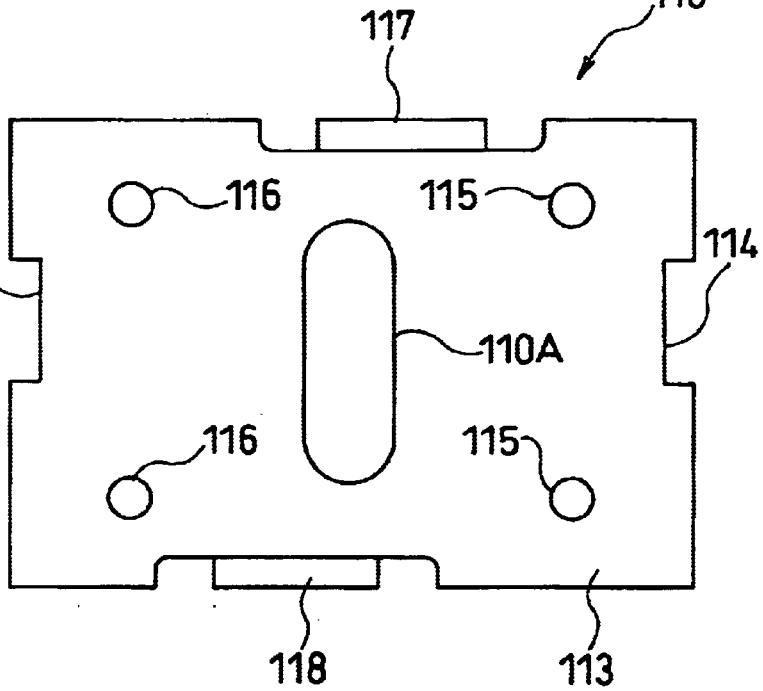
FIG. 25(C) is a front view of the forming holder.

As shown in FIG. 25, the forming holder 110 has a virtually rectangular plate 113 with a vertically long hole 110A formed thereon. The plate 113 has notches 114 formed on the center portions of the right and left side edges. The plate 113 has a pair of projections 115, 115 formed on the right upper and right lower areas on one side thereof (FIG. 25(C)), and has a pair of projections 116, 116 formed on the left upper and left lower areas on the one side thereof. Further, the plate 113 has contact portions 117, 118 formed on the upper and lower ends thereof, which stick out on the other side, and the contact portion 117 sticks out longer by a specific length than the contact portion 118.

Forming Plate

Figure 26:
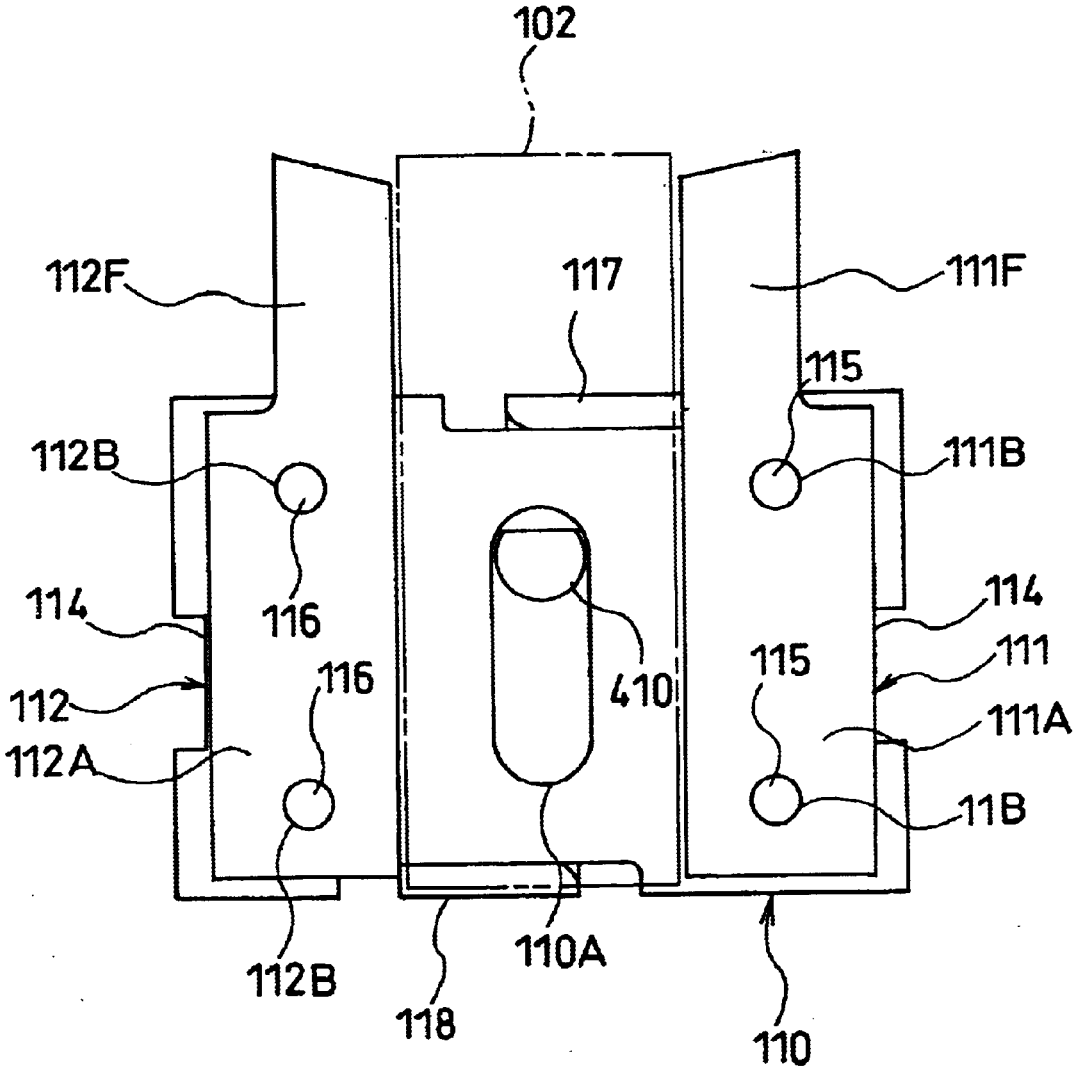
FIG. 26 is an explanatory chart of a state in which the forming plate is attached to the forming holder.

As shown in FIG. 26, the forming plate 111 includes a rectangular base plate portion 111A and a forming plate portion 111F narrower than the base plate portion 111A that overlies the left side of the base plate portion 111A (in FIG. 26). The base plate portion 111A has a pair of holes 111B formed on the upper and lower areas thereof. Similarly, the forming plate 112 includes a rectangular base plate portion 112A and a forming plate portion 112F narrower than the base plate portion 112A that overlies the tight side of the base plate portion 112A (in FIG. 26). The base plate portion 112A has a pair of holes 112B formed on the upper and lower areas thereof.

These forming plates 111, 112 are attached to the forming holder 110 in such a manner that the projections 115, 116 of the forming holder 110 are engaged in the holes 111B, 112B of the forming plates 111, 112.

Figure 27:
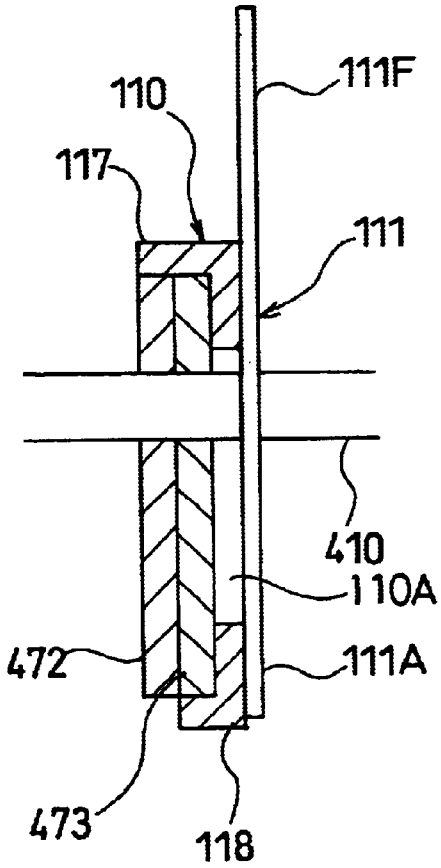
FIG. 27 is an explanatory chart illustrating the positional relation of the forming holder, the forming cam, and the forming return cam.

The drive shaft 410 is inserted through the long holes 110A of the forming holder 110, and the long holes 110A allows the forming holder 110 to move vertically to the drive shaft 410. Further, as shown in FIG. 27, the forming cam 472 and the forming return cam 473 mounted on the drive shaft 410 are disposed between the contact portions 117, 118 of the forming holder 110. The forming return cam 473 is in contact with the contact portions 117, 118; and the forming cam 472 is in contact only with the contact portion 117. The rotation of the forming cam 472 lifts up the forming holder 110, and the rotation of the forming return cam 473 brings down the forming holder 110.

End portions 201A of the clincher links 201 are inserted in the notches 114 of the forming holder 110, and the vertical movement of the forming holder 110 swings the clincher links 201 between the solid line position and the dotted line position (see FIG. 5).

The driver holder 101 and the forming holder 110 are mounted on the drive shaft 410 so as to sit back to back each other, and the driver 102 sits between the forming plates 111F, 112F. The forming plates 111F, 112F forward against the driving passage 601 by the rise of the forming holder 110 and form a staple in a U-letter shape. The driver 102 goes into the driving passage 601 by the rise of the driver holder 101 and shoots the staple formed in the U-letter shape from the driving passage 601.

Anvil Mechanism

Figure 29:
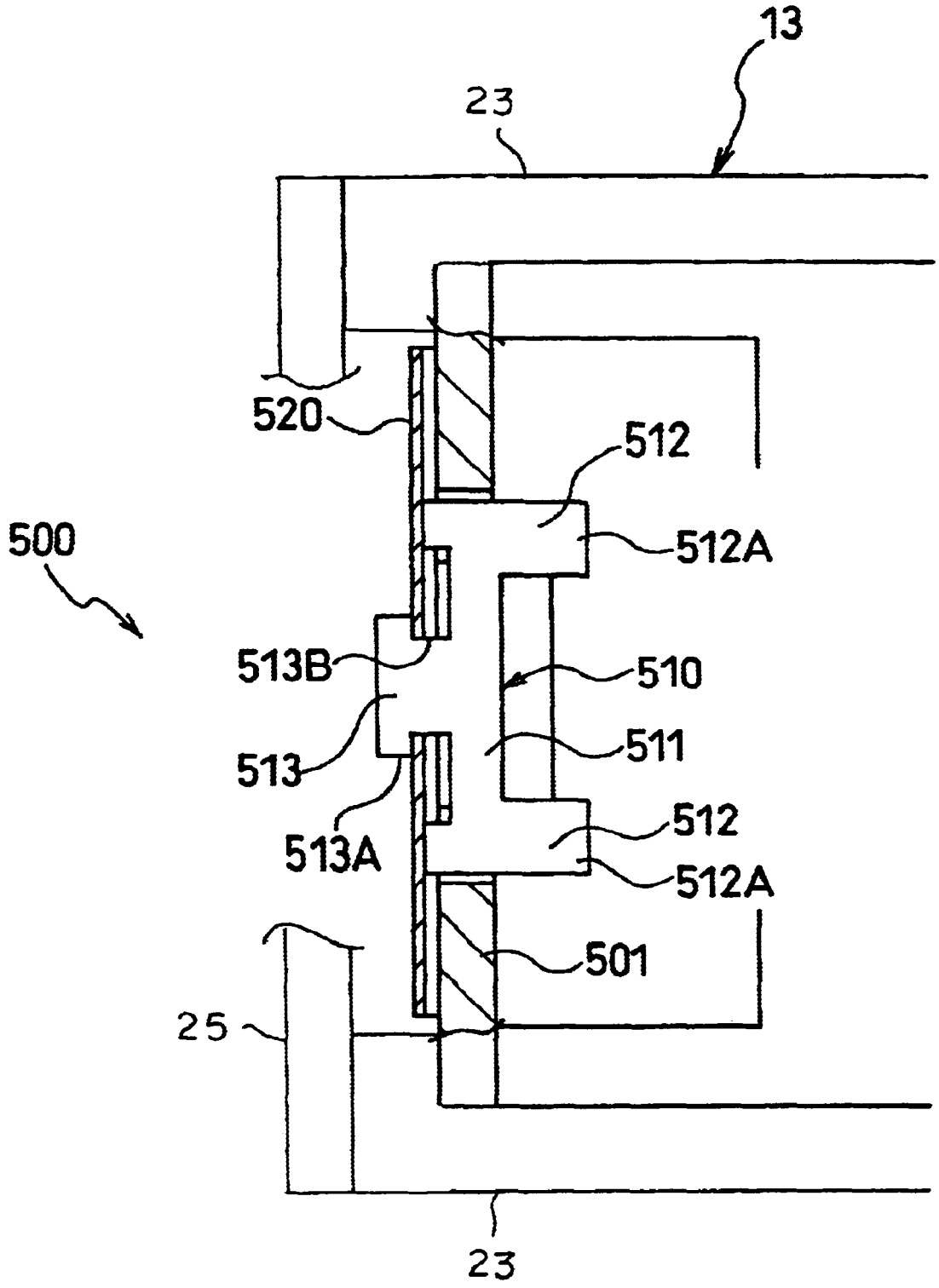
FIG. 29 is a sectional view illustrating the construction of the anvil mechanism.

As shown in FIG. 29, the anvil mechanism 500 is disposed on the front end of the ceiling wall 20 of the body case 13, which includes an anvil plate 501 attached to the front plate 25 by way of the front bent portion of the side plate 23, an anvil 510 retained by the anvil plate 501, a blade spring 520, and the like.

Anvil Plate

Figure 30A:
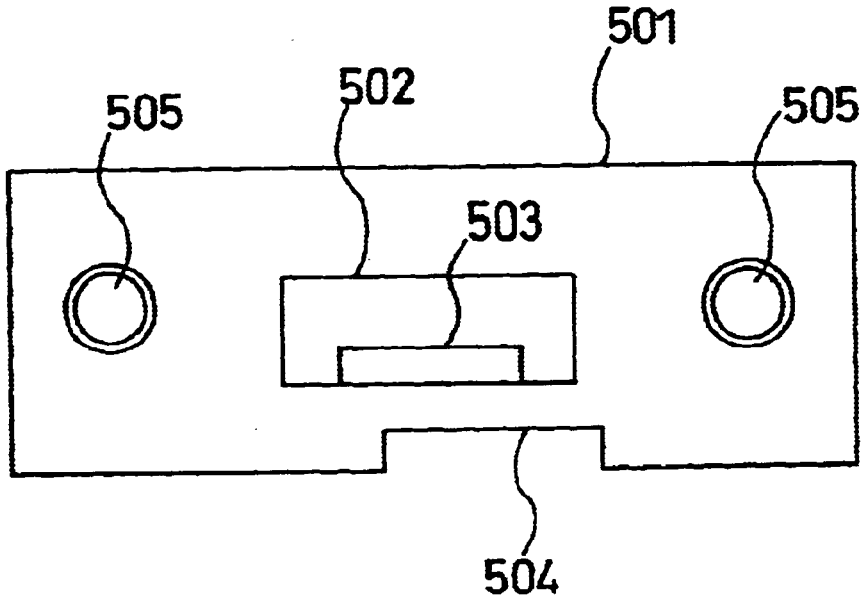
FIG. 30(A) is a font view of the anvil plate.
Figure 30B:
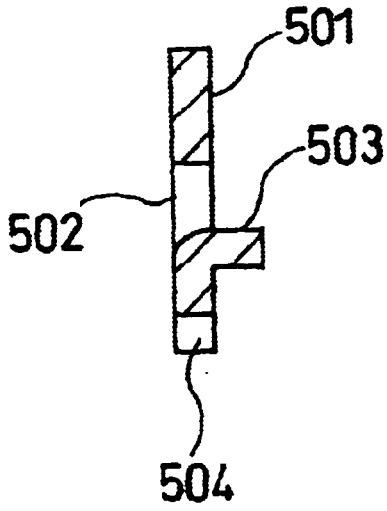
FIG. 30(B) is a sectional view of the anvil plate.

As shown in FIG. 30, the anvil plate 501 is made of a rectangular plate, on the center of which a rectangular opening 502 is formed. A retaining portion 503 extending backward is formed under the opening 502, and a recess 504 is formed on the lower edge of the anvil plate 501. Tapped holes 505 are formed on the right and left sides of the opening 502, and spews screwed in these tapped holes 505, which are not illustrated, fix the anvil plate 501 to the front plate 25.

Figure 31A:
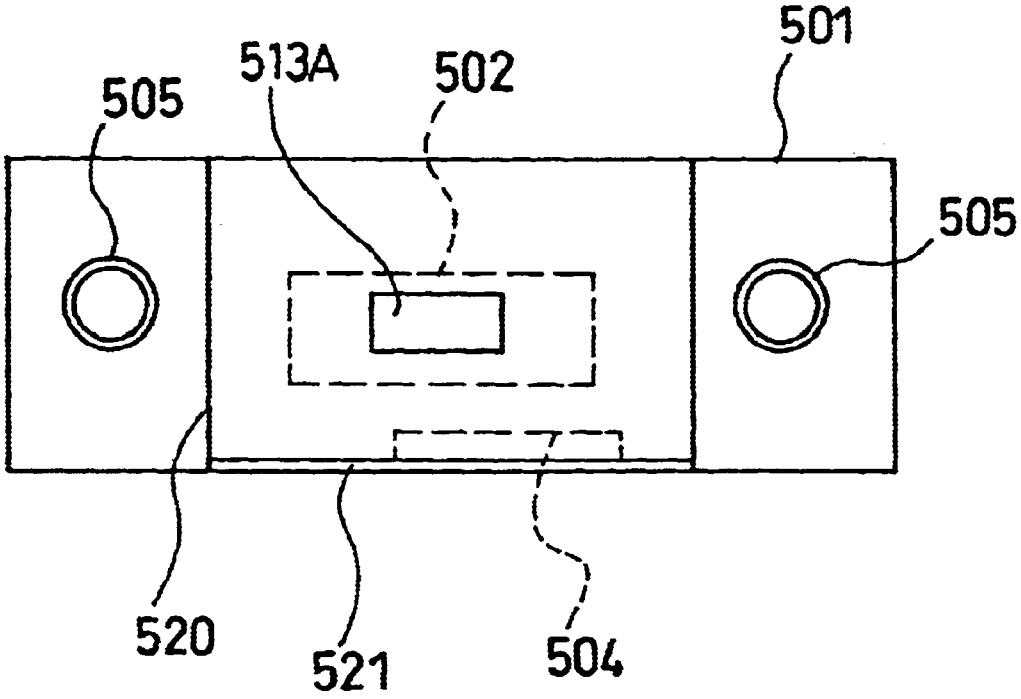
FIG. 31(A) is a front view of a state in which the blade spring is attached to the anvil plate.
Figure 31B:
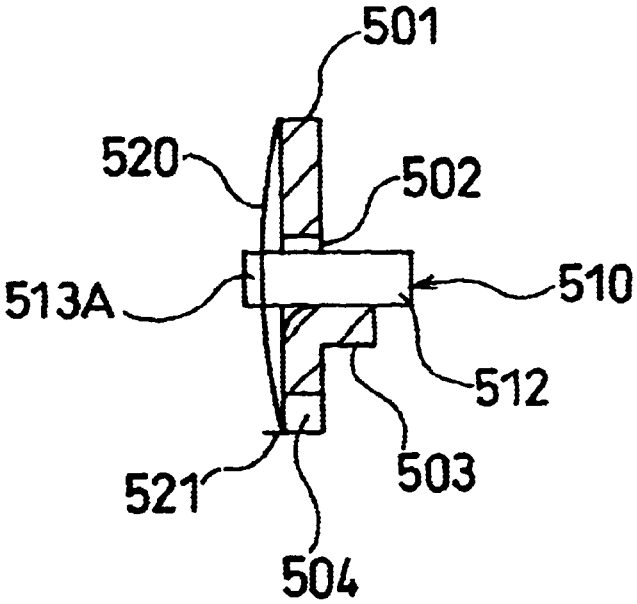
FIG. 31(B) is a sectional view of a state in which the blade spring is attached to the anvil plate.

The blade spring 520 is attached to the front side of the anvil plate 501, as shown in FIG. 31. A forward bent portion 521 is formed on the lower part of the blade spring 520, and the upper part of the blade spring 520 is fixed to the upper part of the anvil plate 501. The blade spring 520 slightly swells forward like a bow.

The anvil 510 is disposed inside the opening 502 of the anvil plate 501 so as to move forward and backward, and it is mounted on the retaining portion 503.

Anvil

The anvil 510 includes a base portion 511 extending right and left, an anvil portion 512 extending backward both the ends of the base portion 511, and a thrust portion 513 projecting forward from the center of the base portion 511. The thrust portion 513 has a head portion 513A and a neck portion 513B, the neck portion 513B pieces through the blade spring 520, and the head portion 513A thrusts out on the front side of the blade spring 520. The anvil 510 is fixed to the blade spring 520 by the head portion 513A.

Figure 32:
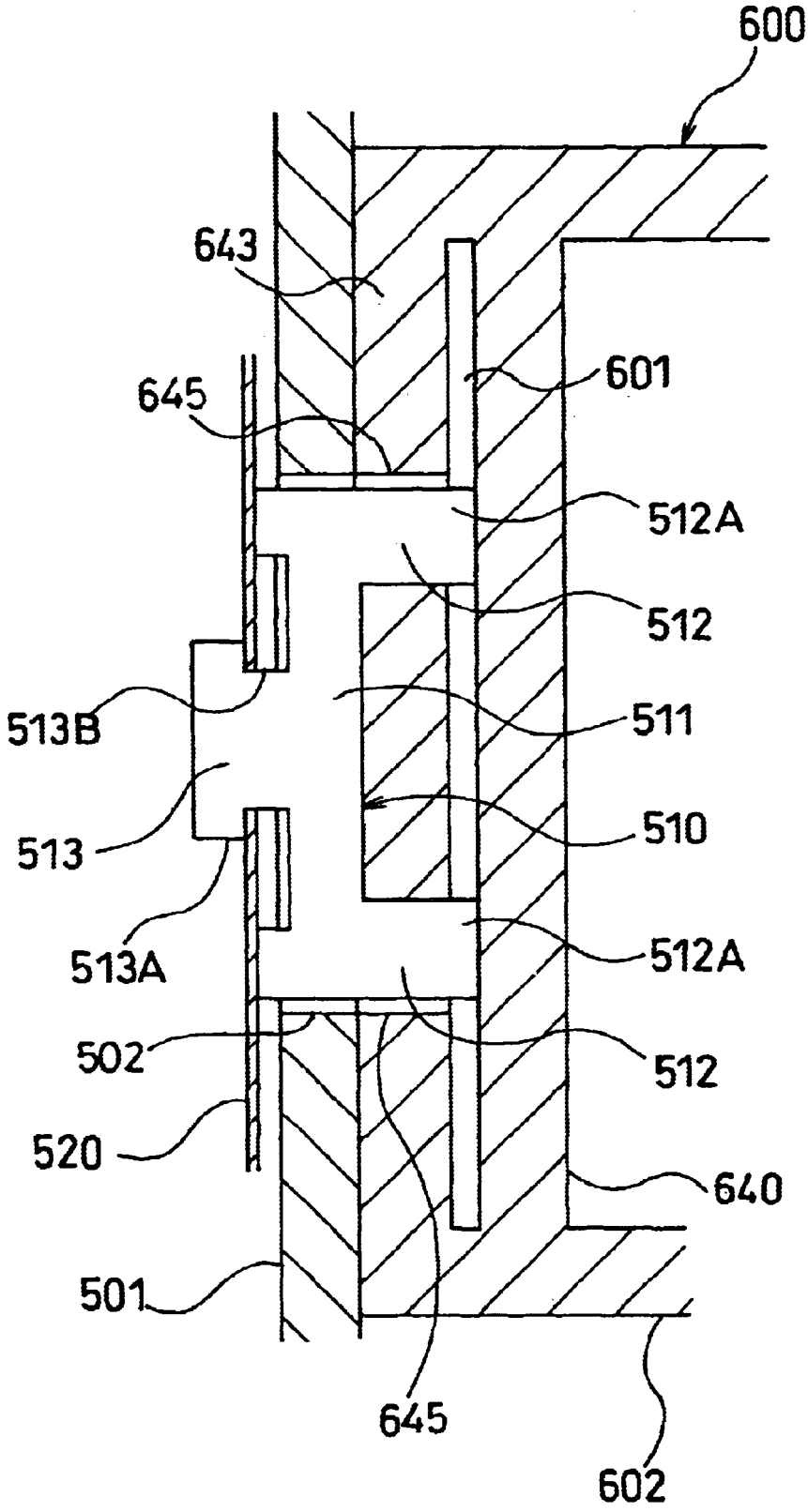
FIG. 32 is a plan section of a state in which the front end of the anvil reaches the driving passage of the cartridge.
Figure 33:
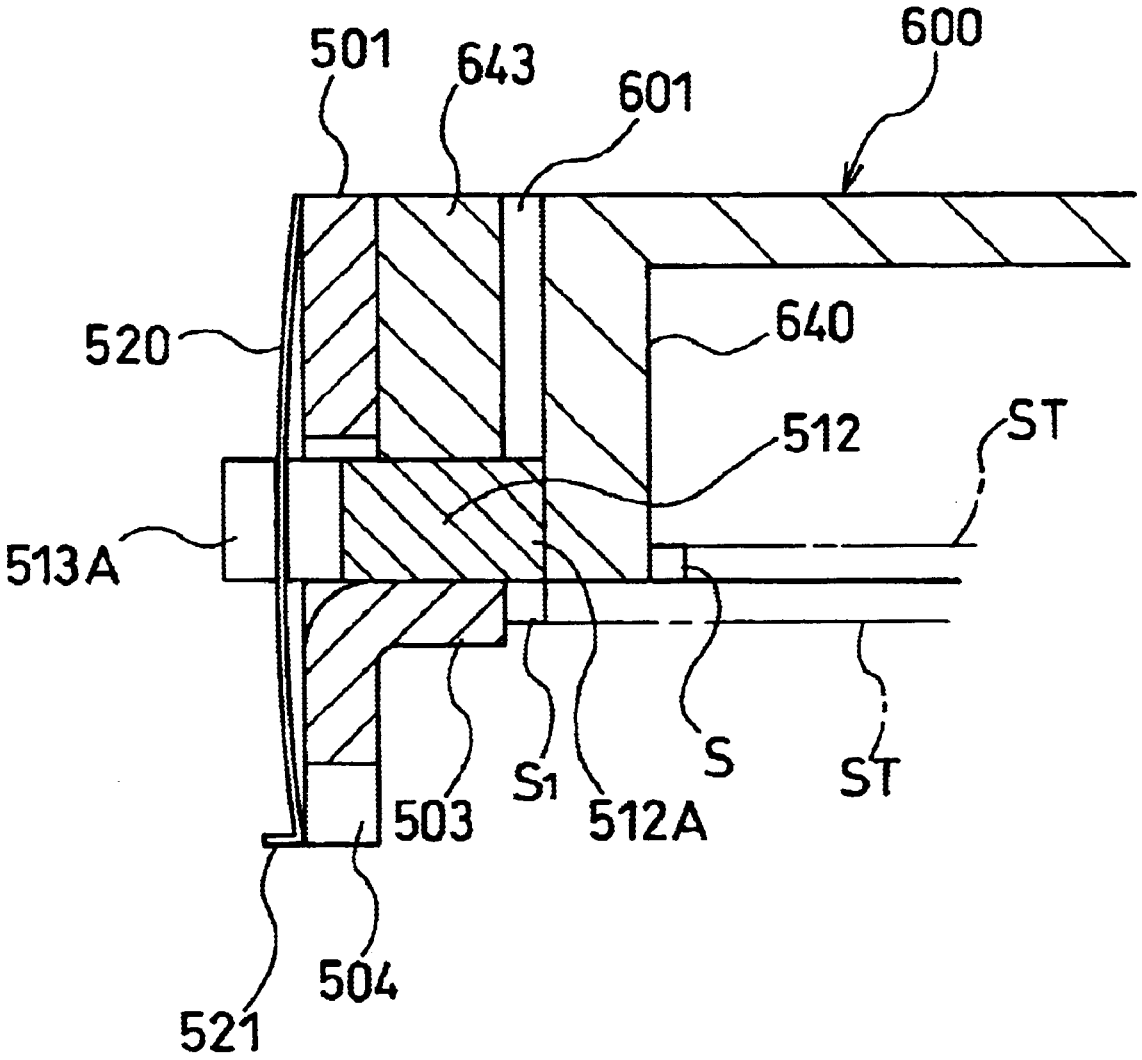
FIG. 33 is a side sectional view of a state in which the front end of the anvil reaches the driving passage of the cartridge.
Figure 34:
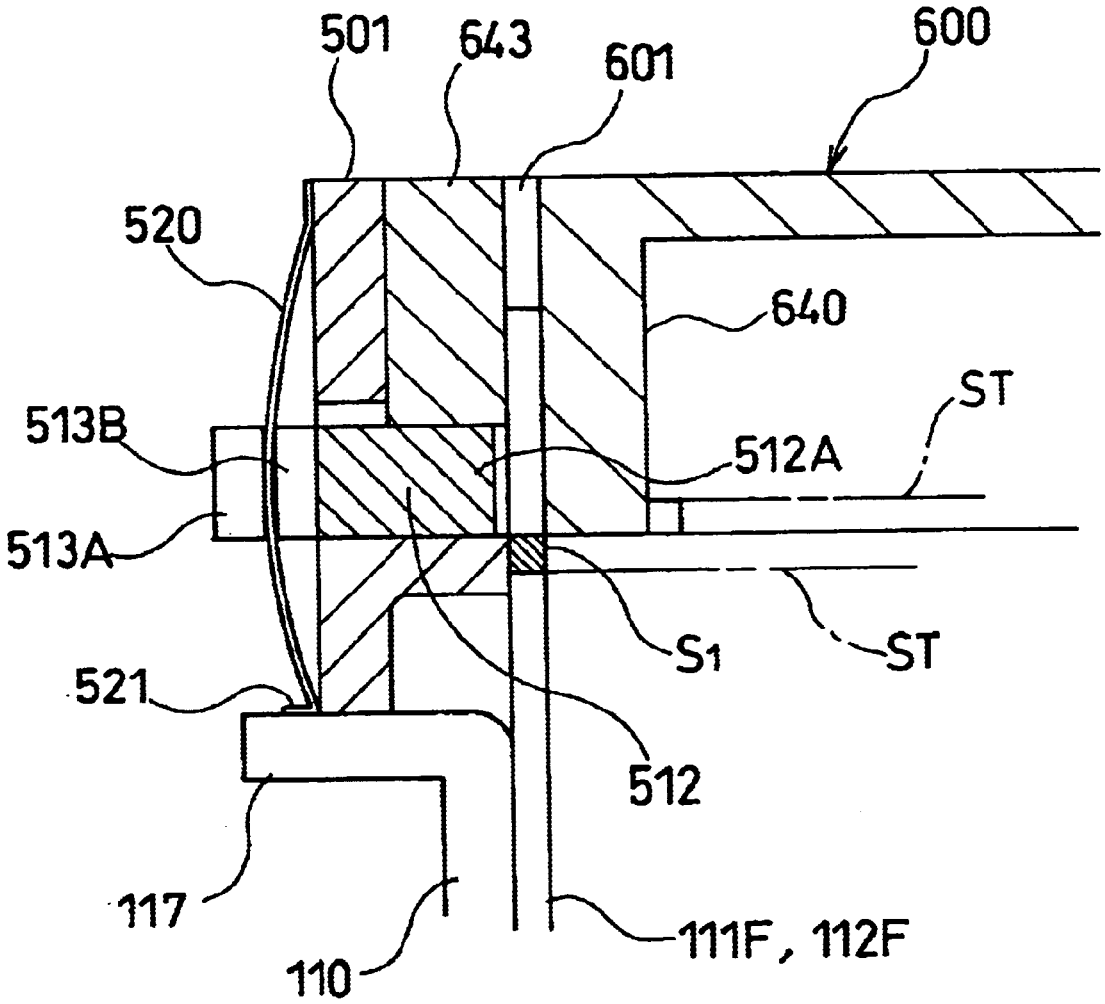
FIG. 34 is a side tonal view of a state in which the front end of the anvil retreats from the driving passage of the cartridge.
Figure 35:
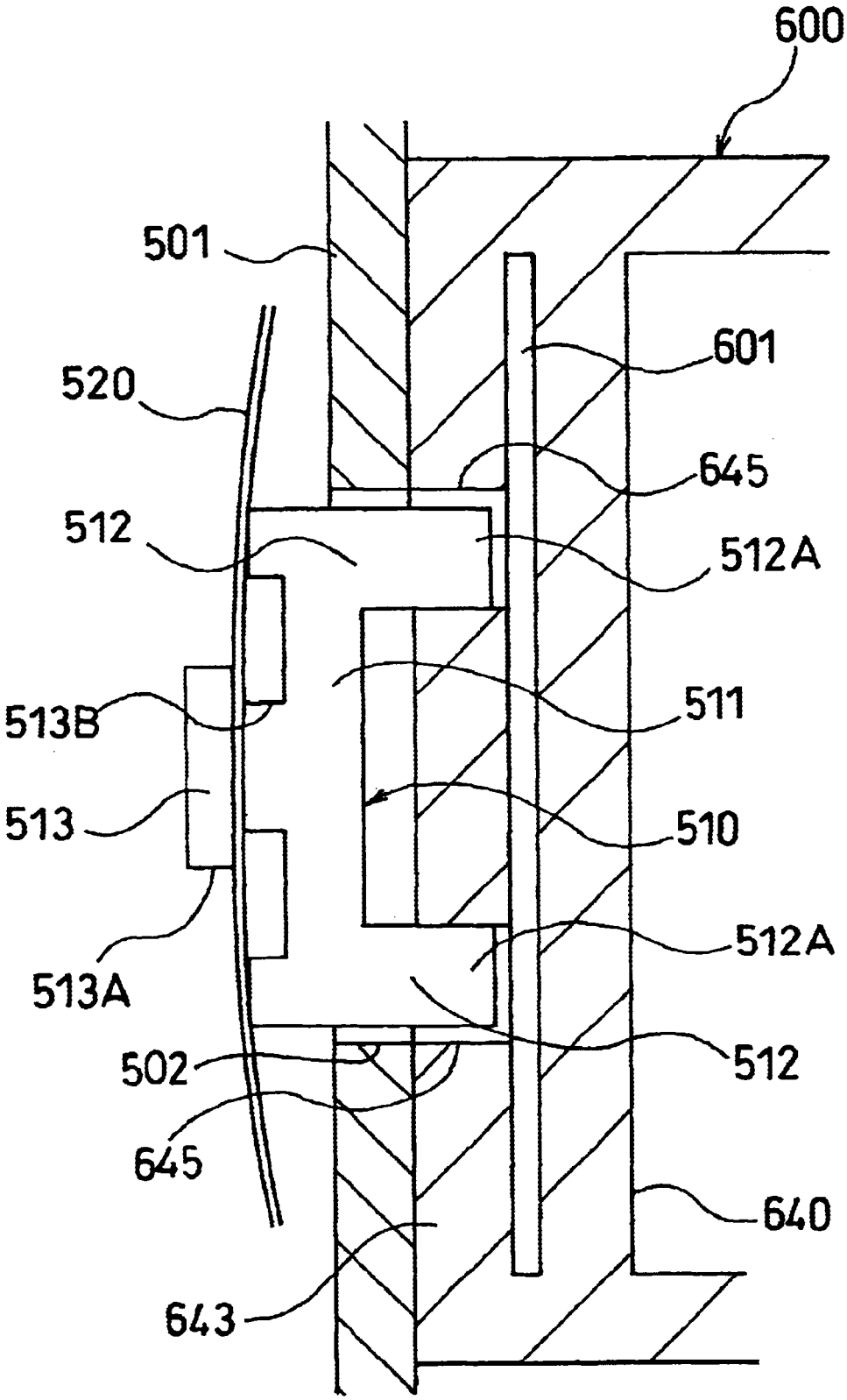
FIG. 35 is a plan section of a state in which the front end of the anvil retreats from the driving passage of the cartridge.
Figure 36:
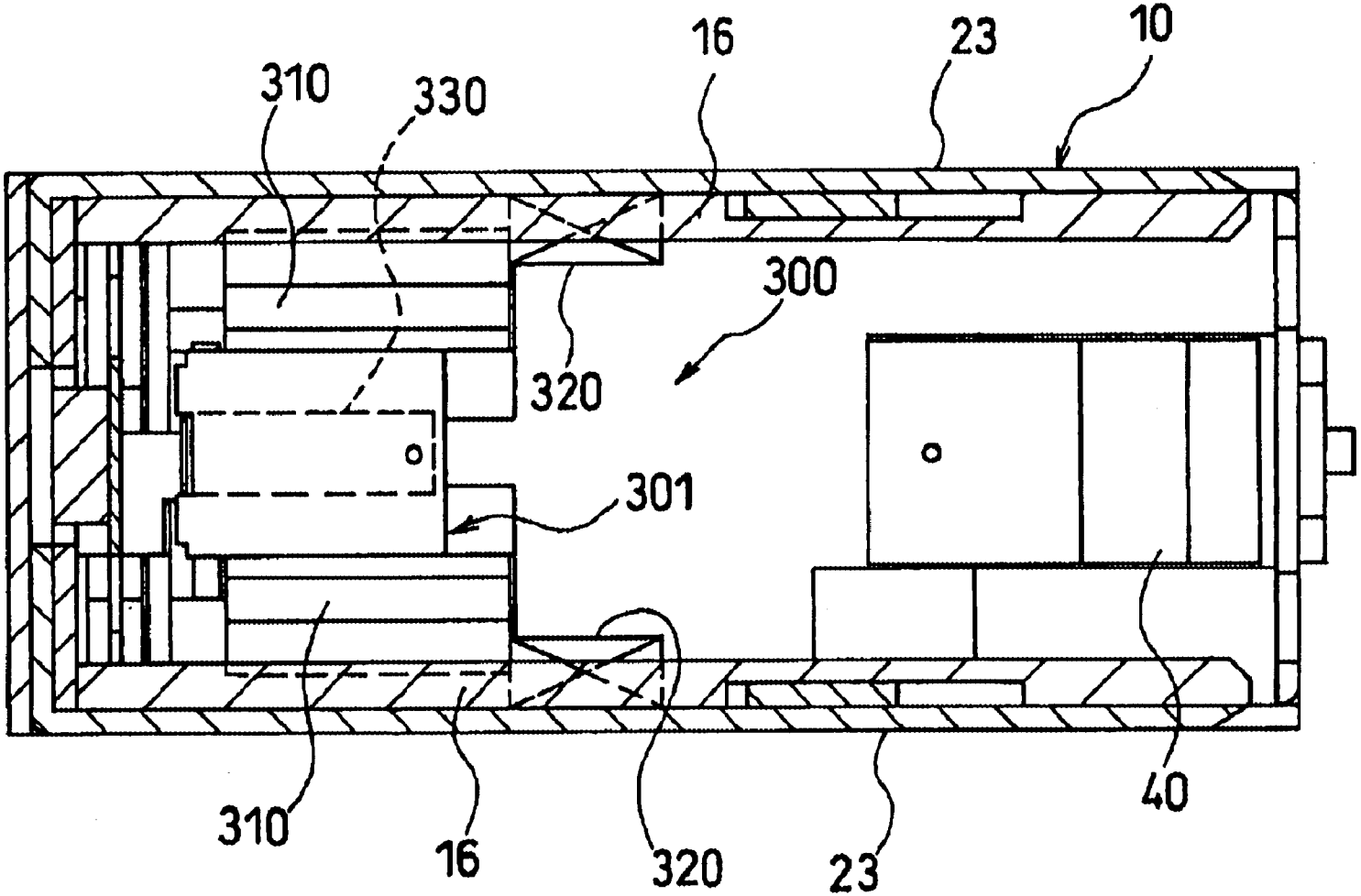
FIG. 36 is a plan view of a state in which the slider is attached to the body case.

As shown in FIG. 32 and FIG. 33, an end portion 512A of the anvil portion 512 goes into the driving passage 601, passing through a notch 645 of a guide plate 643 of the cartridge 600. The blade spring 520 is bending, as the forming holder 110 rises to push up the bent portion 521 of the blade spring 520, as shown in FIG. 34 and FIG. 35. The bending moves the anvil 510 forward, and the end portion 512A of the anvil portion 512 retreats from the driving passage 601 of the cartridge 600.

Sending Mechanism

The sending mechanism 300 includes, as shown in FIG. 36 through FIG. 39, the disc 441 of the drive gear holder 440, a slider 301 attached to the upper front of the ceiling wall 20 of the body case 13 to be movable back and forth, springs 320 that energize the slider 301 forward, a sending plate 330 attached to the slider 301, and the like. The springs 320 are attached to the upper walls 16, 16 of the body case 13, which energy wing portions 310 of the slider 301 forward (see FIG. 40).

Slider

Figure 40A:
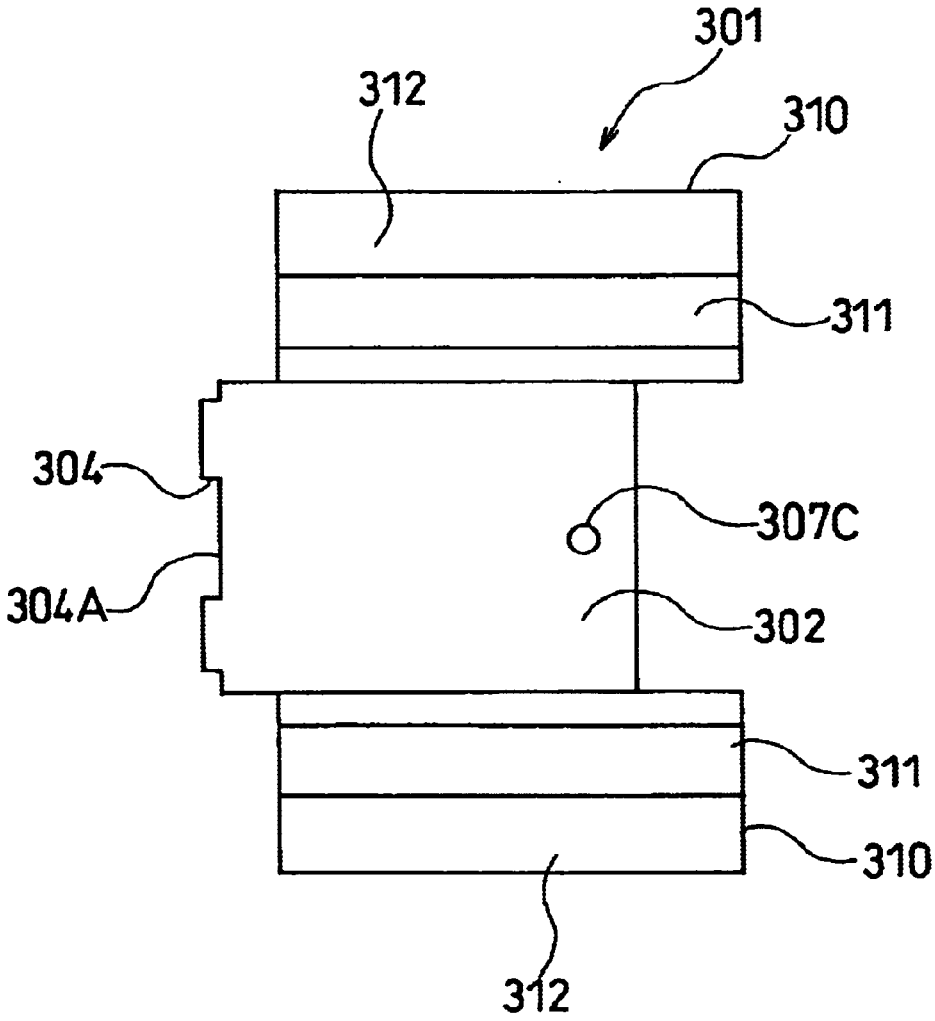
FIG. 40(A) is a plan view of the slider.
Figure 40B:
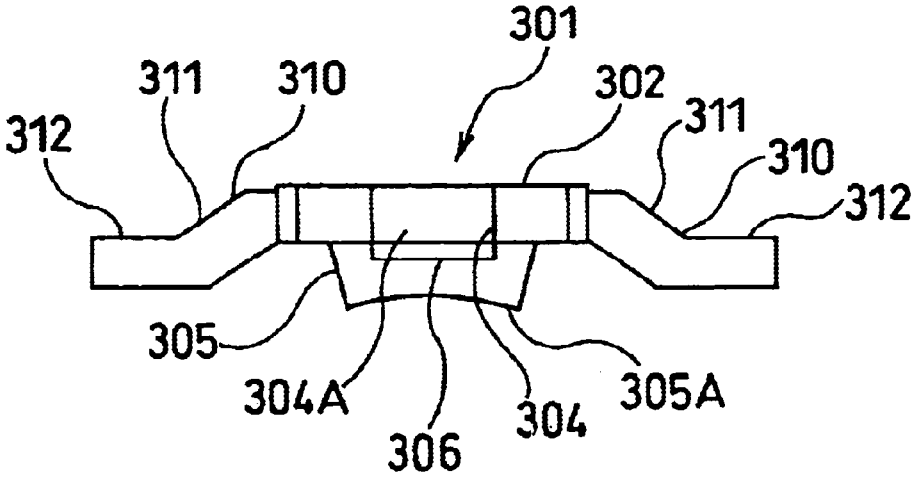
FIG. 40(B) is a front view of the slider.
Figure 41:
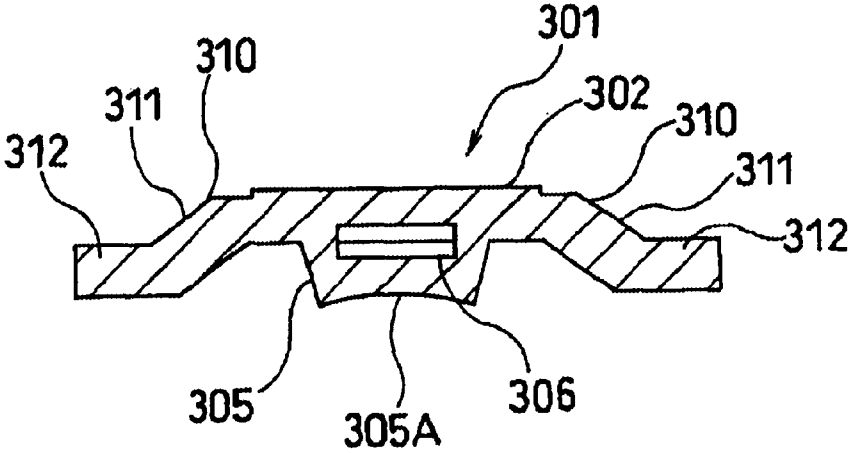
FIG. 41(A) is a bottom view of the slider shown in FIG. 40.
FIG. 41(B) is a transverse cross section of the slider.
FIG. 41(C) is a vertical section of the slider.
Figure 41:
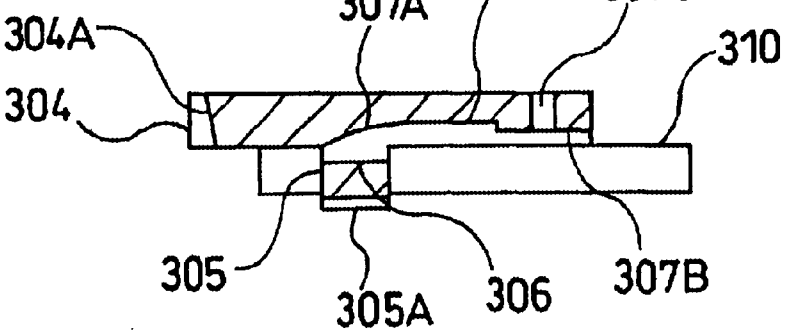
Figure 41:
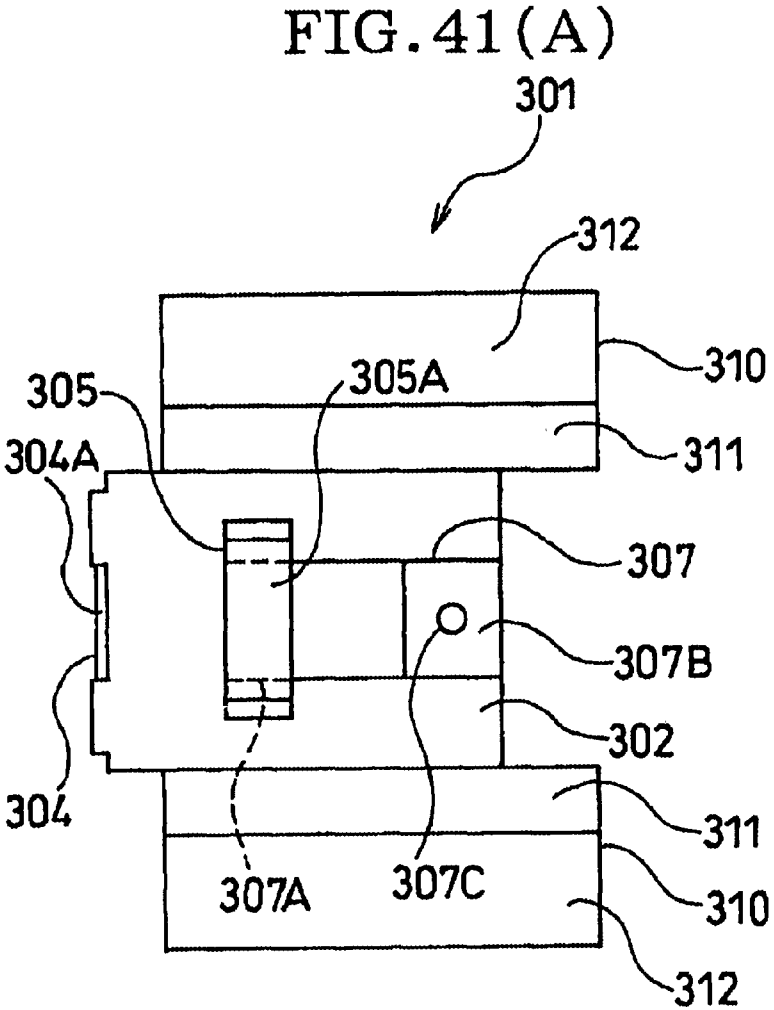

The slider 301 has a flat base portion 302, as shown in FIG. 40 and FIG. 41. The base portion 302 has the wing portions 310 formed along both the sides thereof. The wing portions 310 have slant portions 311 extending downward, and horizontal portions 312 extending horizontally from the lower ends of the slant portions 311.

The base portion 302 has a recess 304 formed on the front end thereof, and the recess 304 has an end face 304A, being a slope slant forward. The base portion 302 has a projection 305 on the underside thereof, and the projection 305 has a through slit 306 formed thereon. The lower face of the projection 305 is formed into an arched recess 306A.

The base portion 302 has a recess 307 formed on the underside thereof, which has a specific width and extends backward from the front end of the portion 305. The depth of the recess 307 becomes gradually shallow toward a front portion 307A of the recess 307 that faces the projection 305. A flat shallow mounting face 307B is formed on the back of the recess 307, and the mounting face 307B has a tapped hole 307C formed thereon. The sending plate 330 is fixed to the mounting face 307B by a screw N2, as shown in FIG. 42.

Sending Plate

Figure 43A:
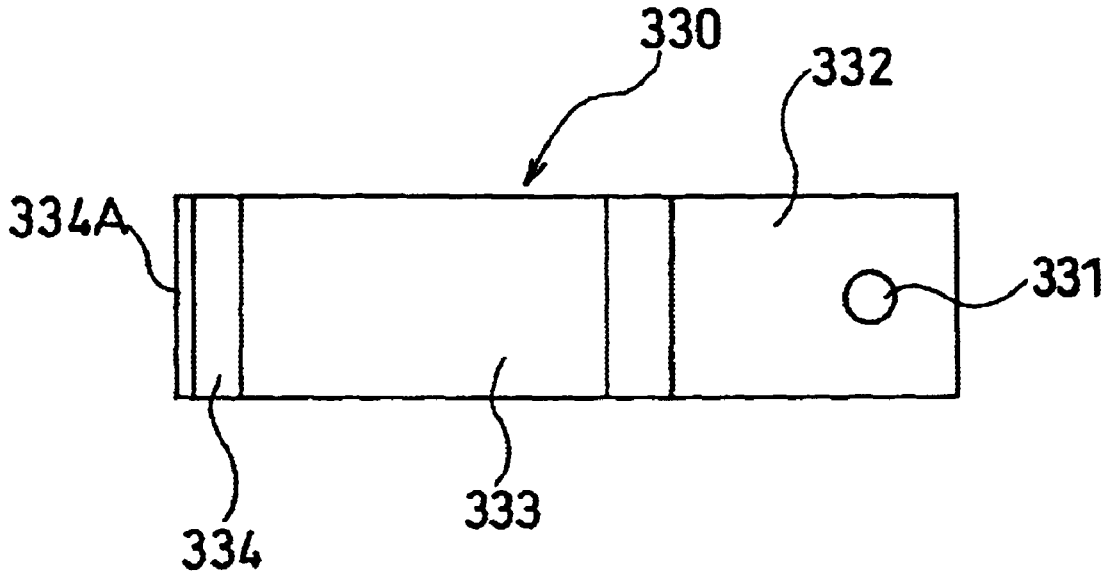
FIG. 43(A) is a plan view of the sending plate.
Figure 43B:
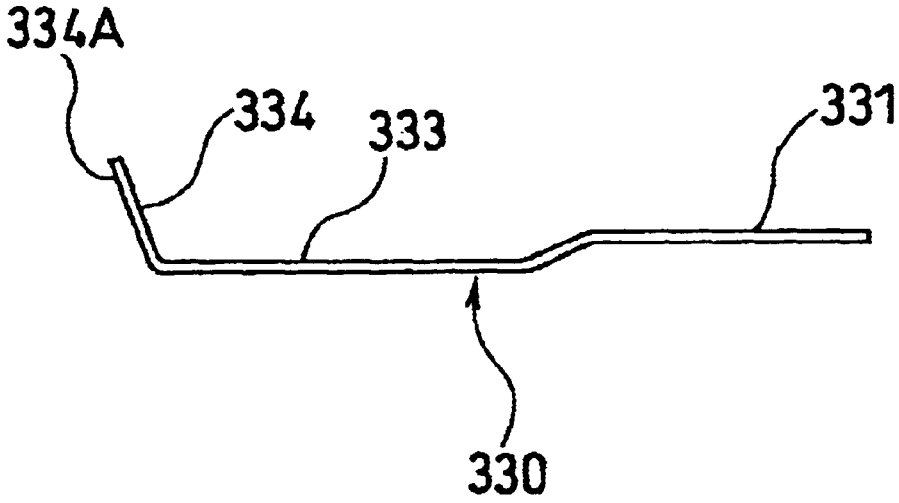
FIG. 43(B) is a side view of the sending plate.

The sending plate 330 has a fixing portion 332 with a screw hole 331, as shown in FIG. 43, in which an elastic portion 333 is formed which goes down a step from the fixing portion 332 and extends forward. On the end of the elastic portion 333, a claw 334 is formed which projects Slant upward.

Figure 42:
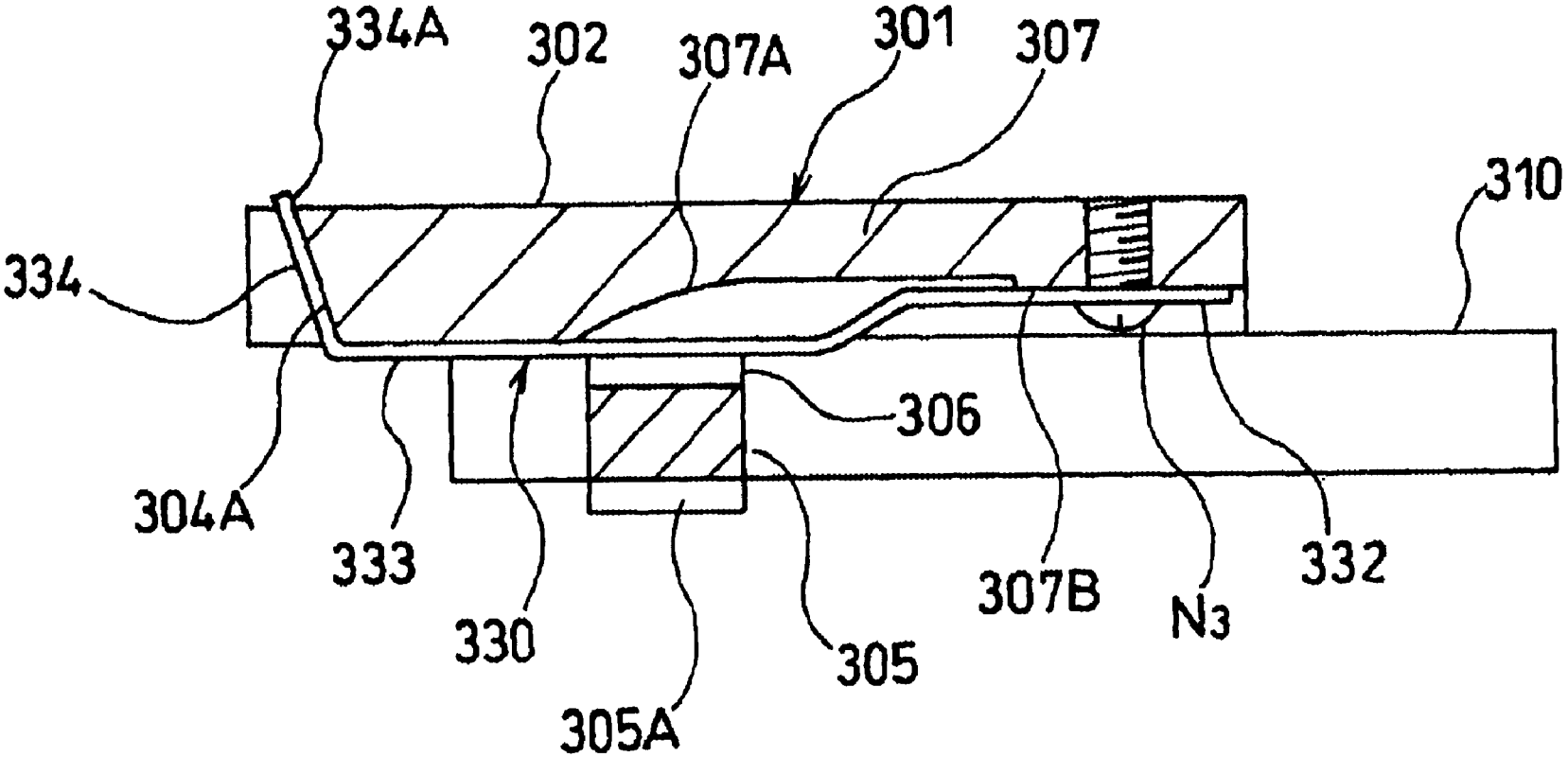
FIG. 42 is an explanatory chart of a state in which the sending plate is attached to the slider.

The sending plate 330 is attached to the slider 301 by the fixing portion 332 being fixed to the mounting face 307B of the slider 301 by the screw N3, as shown in FIG. 42. And, the elastic portion 333 of the sending plate 330 is inserted through the slit 306 of the projection 305, and the claw 334 is in contact with the end face 304A of the slider 301 and an end portion 334A of the claw 334 thrusts out over the upper ace of the base portion 302 of the slider 301.

Figure 37:
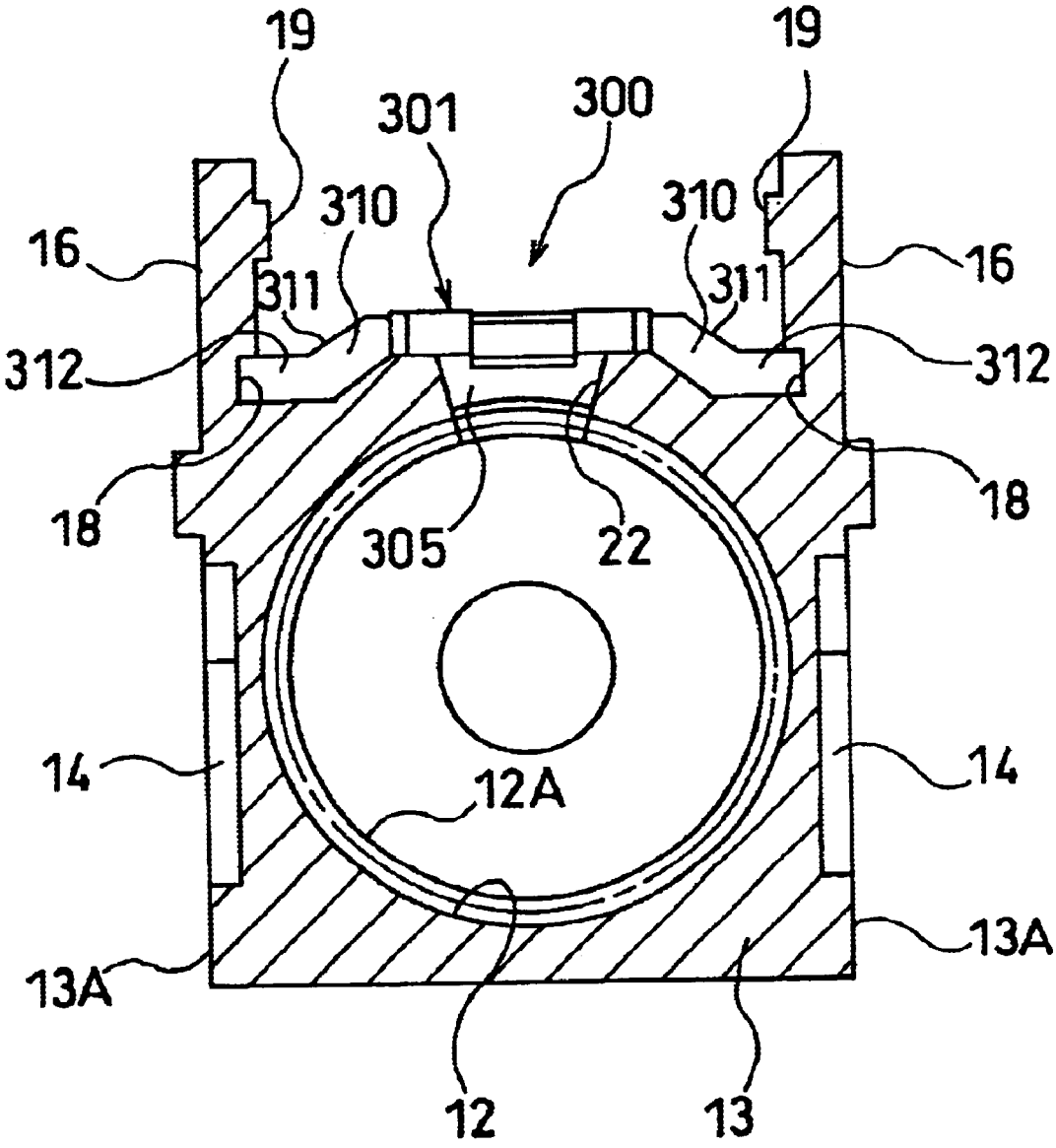
FIG. 37 is a transverse cross section of a state in which the slider is attached to the body case.
Figure 38:
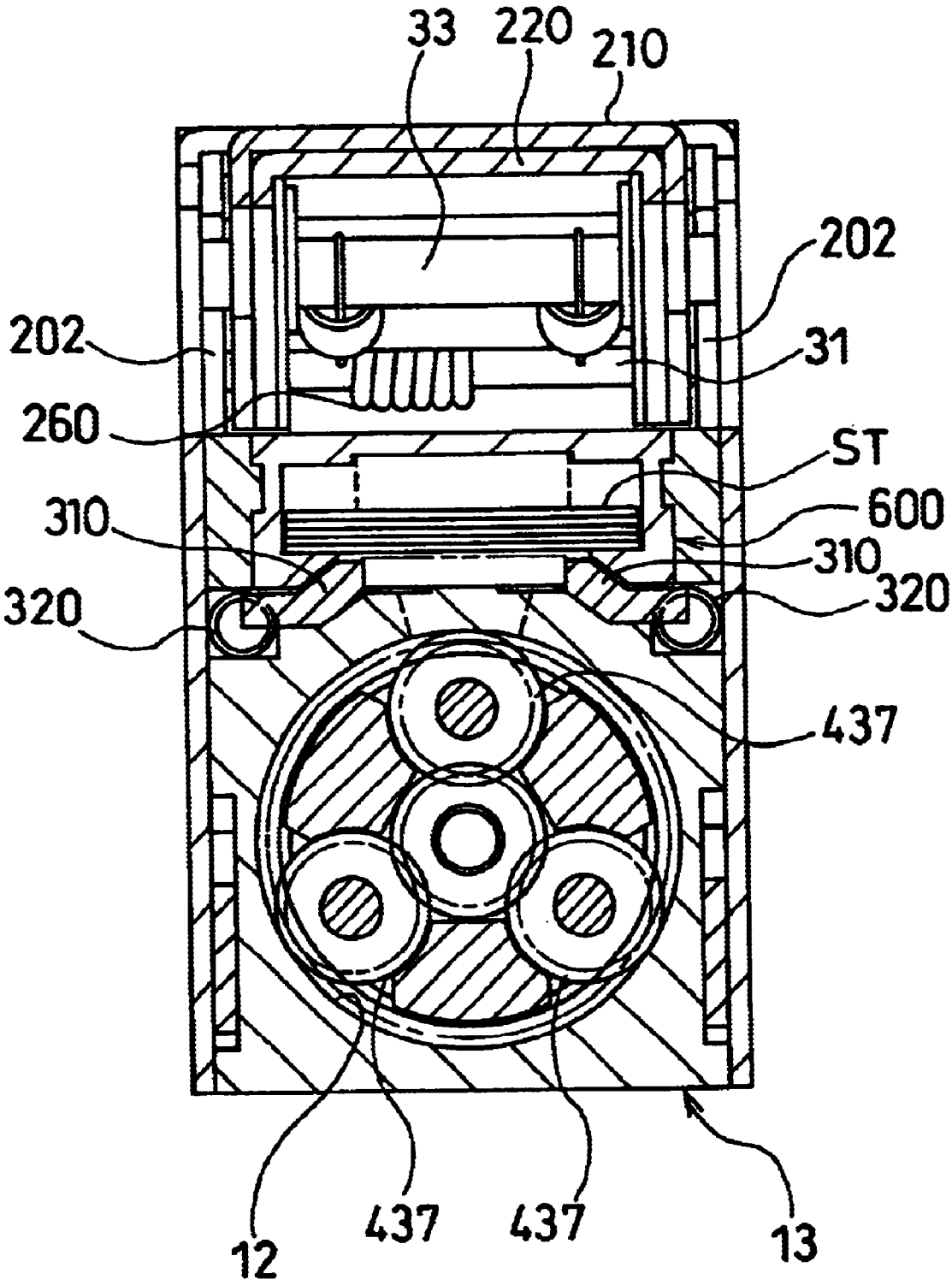
FIG. 38 is a transverse cross section of the stapler body.

After the slider 301 has the sending plate 330 attached thereon, as shown in FIG. 37 and FIG. 38, the horizontal portions 312 of the wing portions 310 are inserted in the guide grooves 18, 18 of the body case 13, and the projection 305 of the base portion 302 is put in the notch 22 of the body case 13, whereby the slider 301 is attached to the upper side of the ceiling wall 20 of the body case 13. The slider 301 moves back and forth by the horizontal portions 312 of the wing portions 310 sliding in the guide grooves 18, 18 of the body ease 13.

Figure 44:
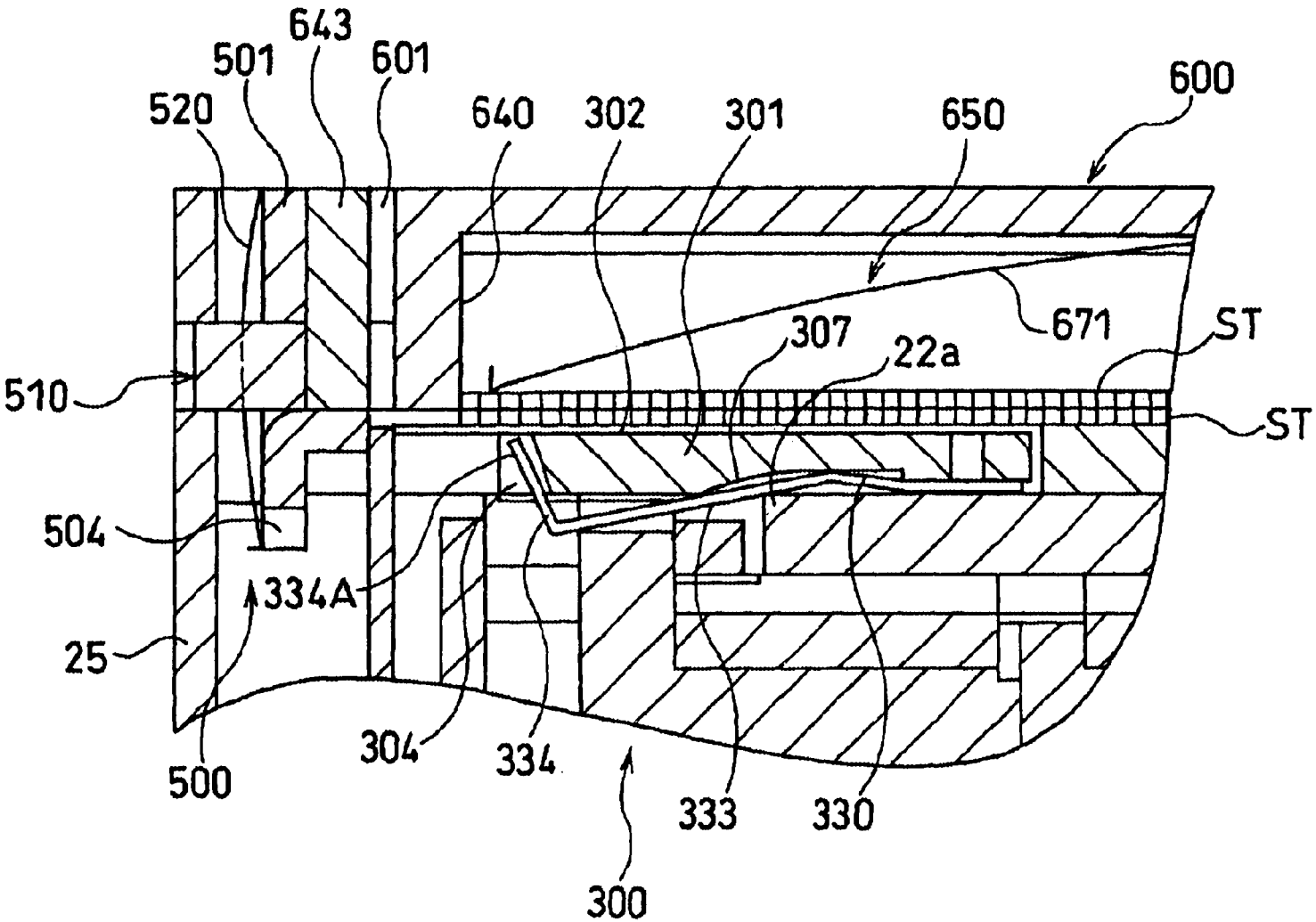
FIG. 44 is an explanatory chart illustrating the positional relation between the slider and the sheet staple contained in the cartridge.

The slider 301 is energized forward by the spring 320, and when the forming holder 110 is in the home position, the projection 305 of the slider 301 comes in contact with the disc 441 of the drive gear holder 440, and the slider is stopped at the position illustrated in FIG. 44. Here, an edge portion 22*a* of the notch 22 on the ceiling wall 20 of the body case 13 is to press the elastic portion 333 of the sending plate 330. This pressing pushes a part of the elastic portion 333 into the recess 307 of the base portion 302 of the slider 301, so that the end portion 334 of the claw 334 of the sending plate 330 is pulled in down from the upper face of the base portion 302 of the slider 301.

Figure 45:
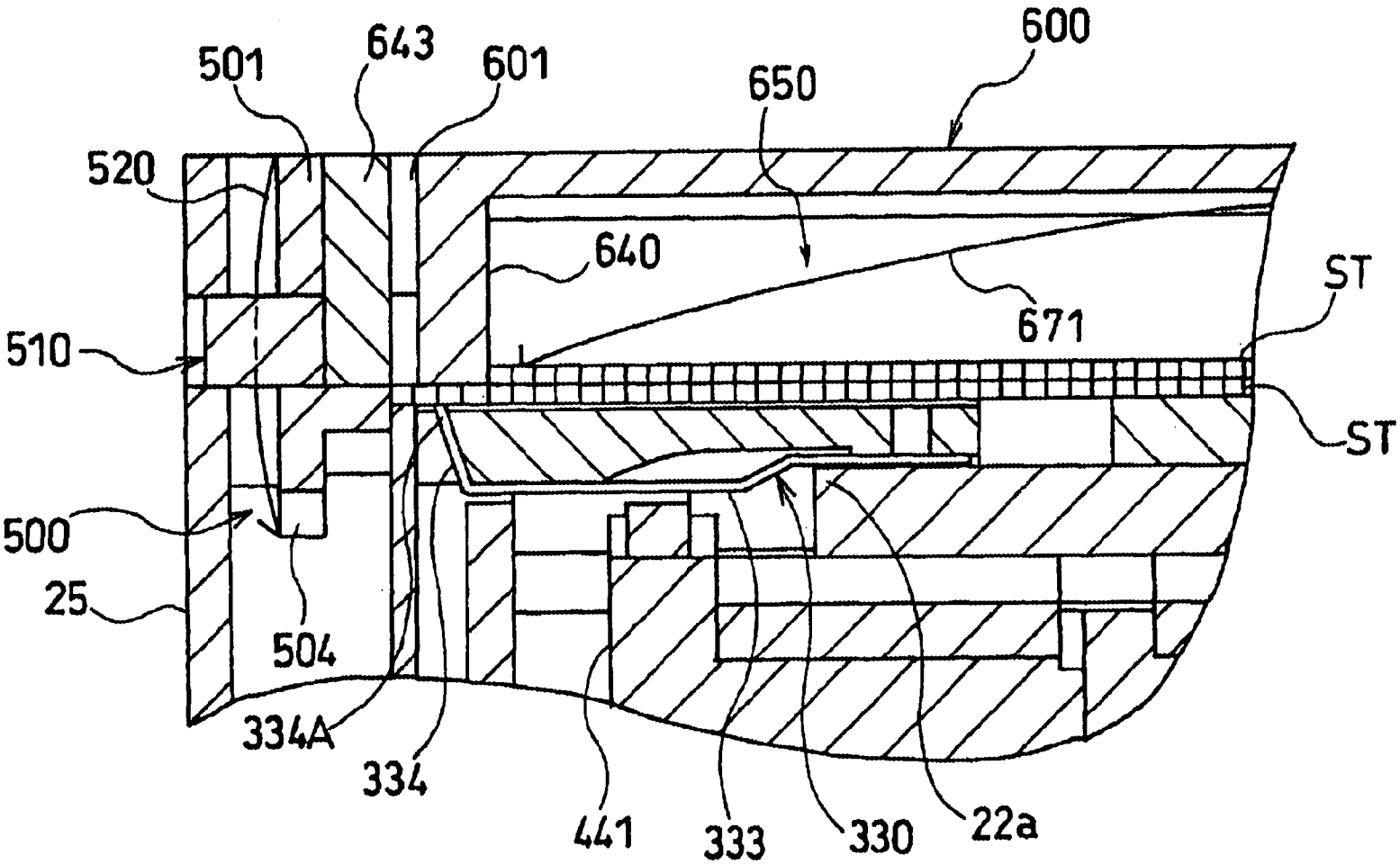
FIG. 45 is an explanatory chart of a state in which the sheet staple is sent out by the slider.

As the drive gear holder 440 turns and the notch 445 of the disc 441 comes to a specific position, the slider 301 goes into the notch 446. That is, the slider 301 moves forward. As the slider 301 moves forward, as shown in FIG. 45, the pressing to the elastic portion 333 of the sending plate 330 which has been given by the edge 22*a* of the notch 22 on the ceiling wall 20 of the body case 13 is released, and the end portion 334A of the claw 334 of the sending plate 330 thrusts out over the upper face of the base portion 302 of the slider 301 to thereby send the sheet staple ST forward.

And, as the drive gear holder 440 further turns, the slope 446 of the disc 441 comes in contact with the front of the projection 305 of the slider 301, and accompanied with the rotation of the drive gear holder 440, the slope 446 pushes back the slider 301 against the energizing force of the spring. Thus, the slider 301 makes one reciprocating motion back and forth, with one rotation of the drive gear holder 440.

Clincher Mechanism

Figure 46:
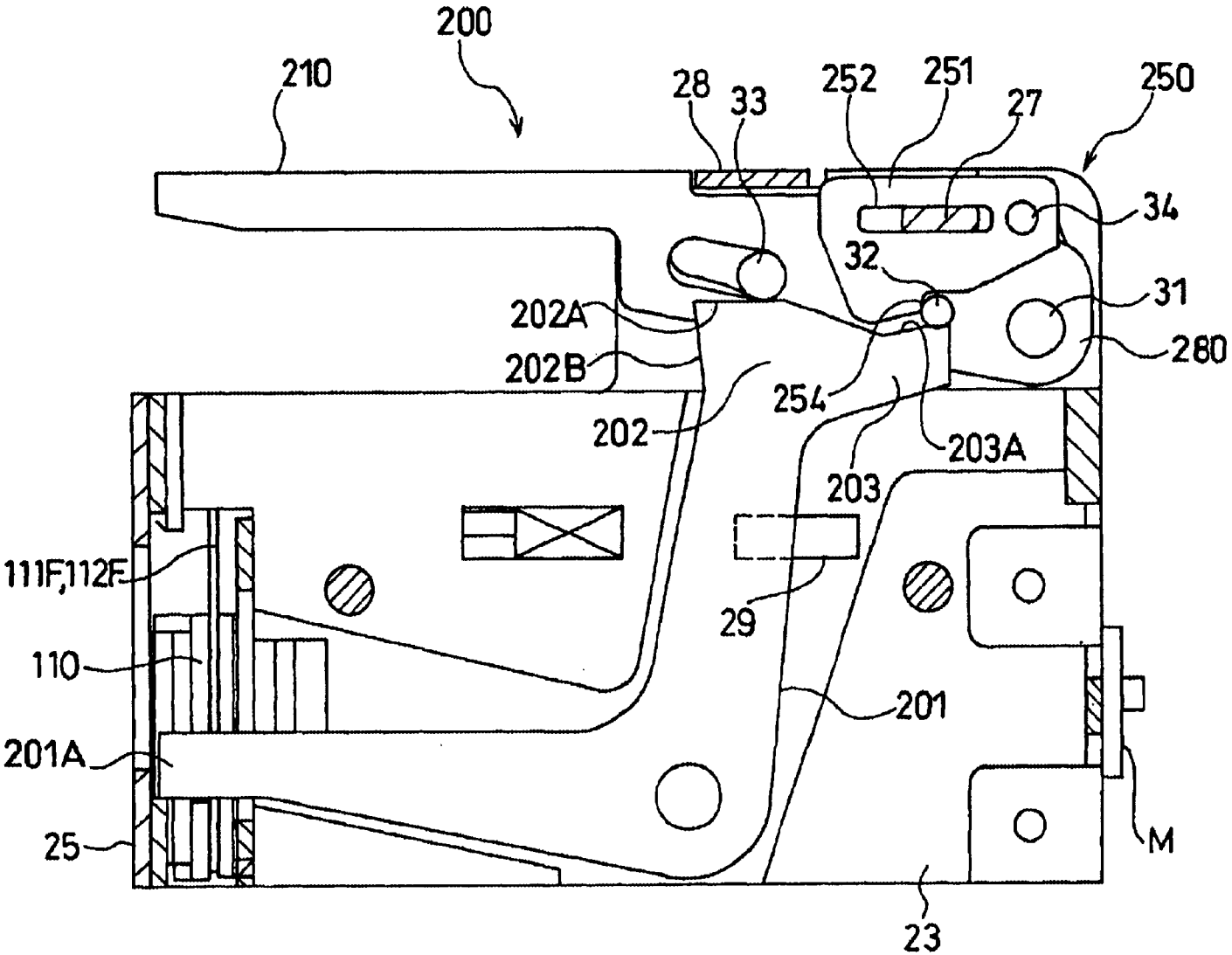
FIG. 46 is a side view of the lock mechanism.
Figure 47:
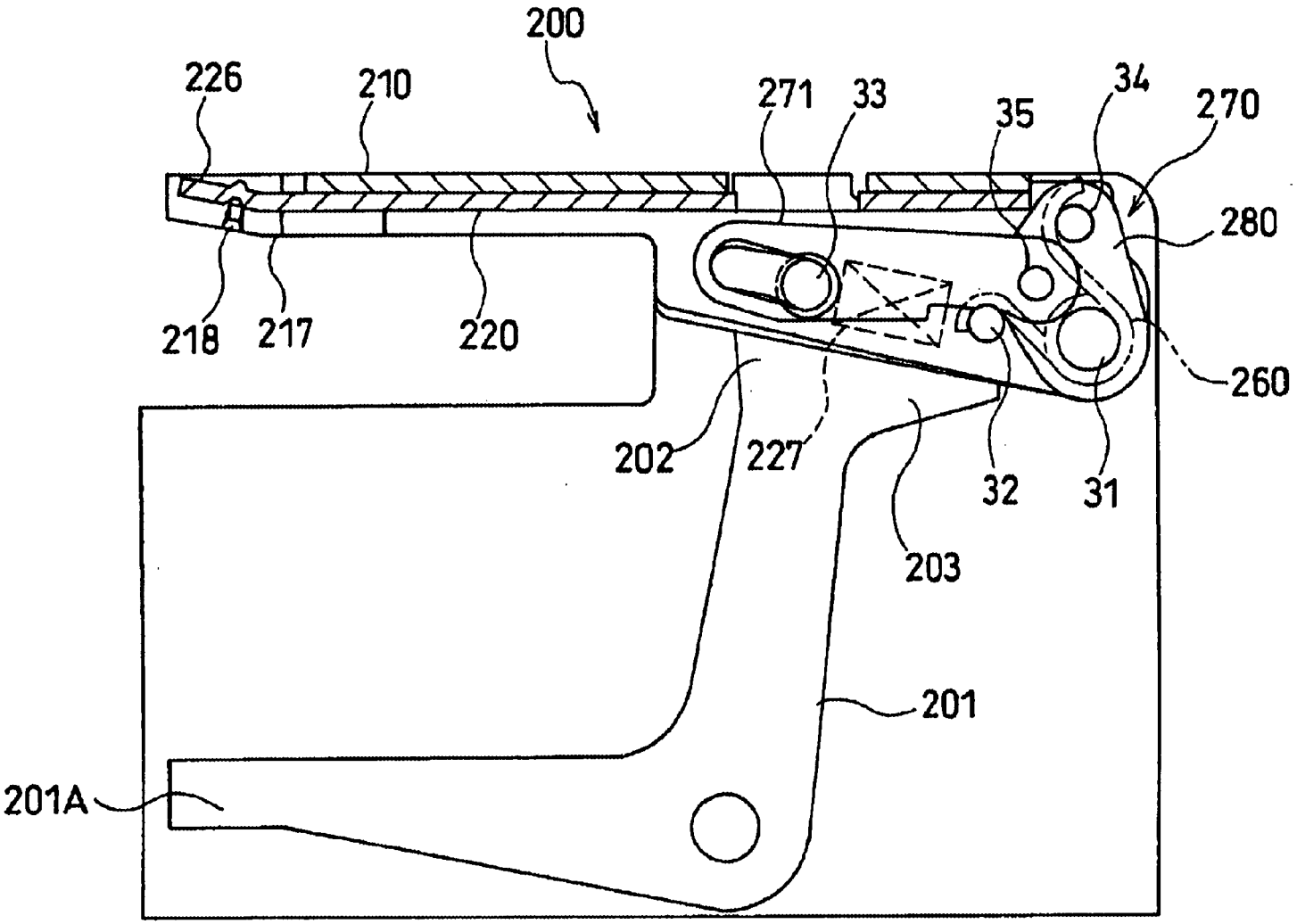
FIG. 47 is a side view illustrating the construction of the release mechanism.

The clincher mechanism 200 includes, as shown in FIG. 46 and FIG. 47, a pair of clincher links 201, a clincher guide 210 of which back is attached to the side plates 23, 23 of the body case 13 so as to freely swing, a clincher arm 220 of which back is attached to the back of the clincher guide 210 to freely swing, a lock mechanism 250 that suspends the clincher guide 210 to the portion where the clincher guide 210 turns by a specific angle, and a release mechanism 270 that releases the suspension by the lock mechanism 250, and the like.

Clincher Links

The clincher links 201 are formed into an L-letter shape, and pivoted about the middle point thereof. Horizontal contact faces 202A and vertical contact faces 202B are formed on upper portions 202 of the clincher links 201. Protruded portions 203 are provided on the rear ends of the upper portions 202 at the position fallen by a specific height from the position of the contact faces 202A.

The protruded portions 203 have slightly slant supporting faces 203A to heighten the rear upper sides thereof.

Clincher Guide

Figure 48A:
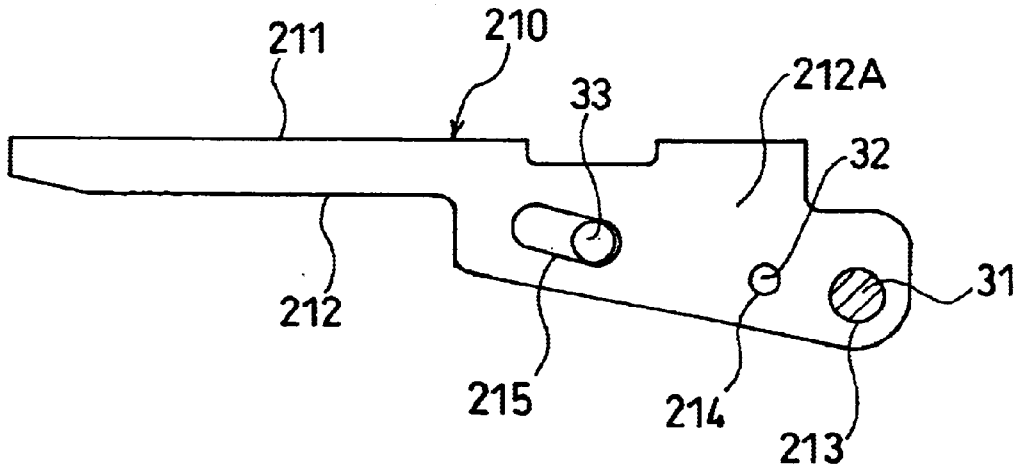
FIG. 48(A) is a view of the clincher guide.
Figure 48B:
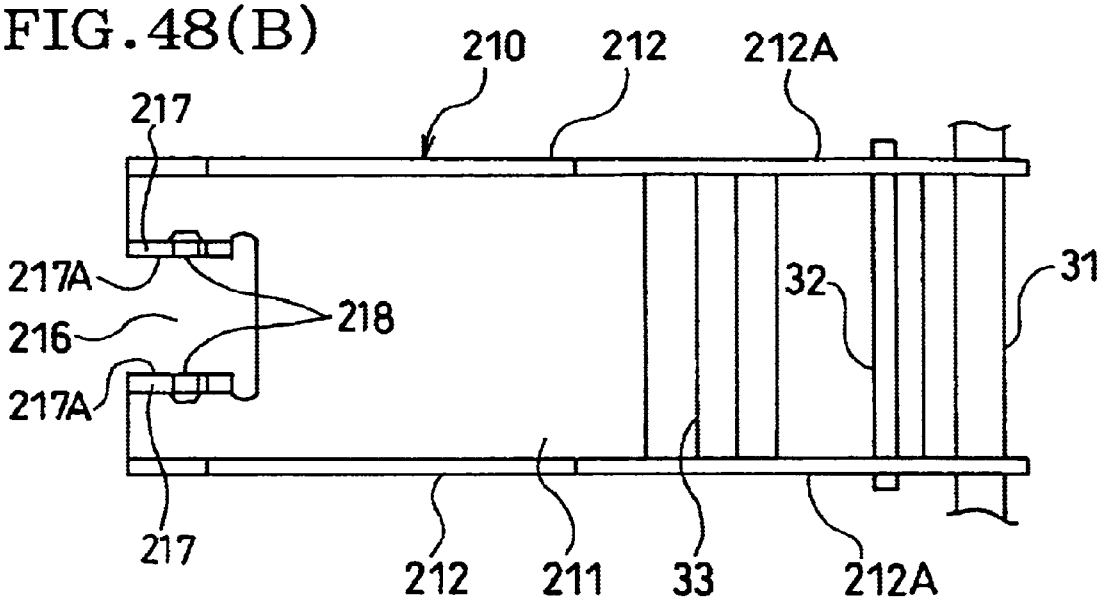
FIG. 48(B) is a bottom view of the clincher guide.
Figure 48C:
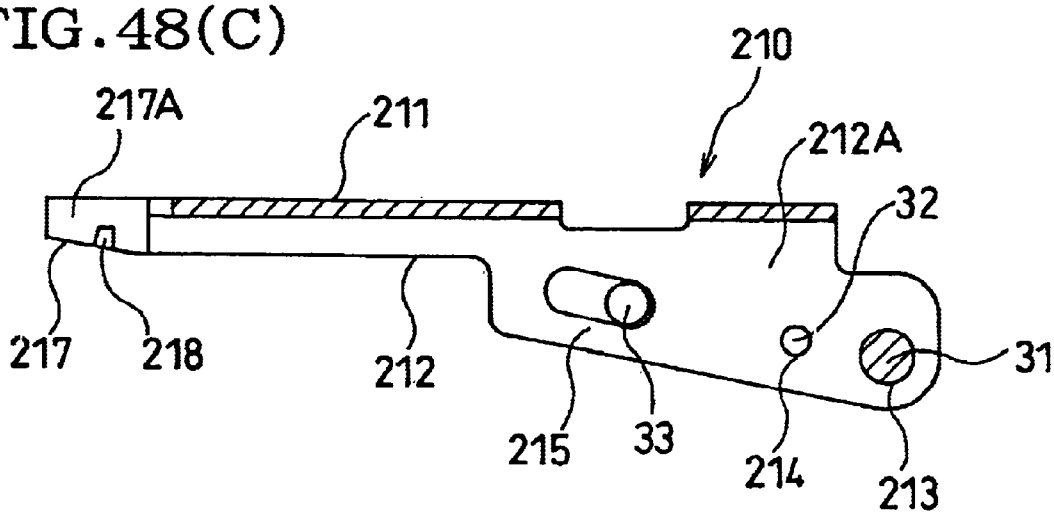
FIG. 48(C) is a vertical section of the clincher guide.
Figure 49A:
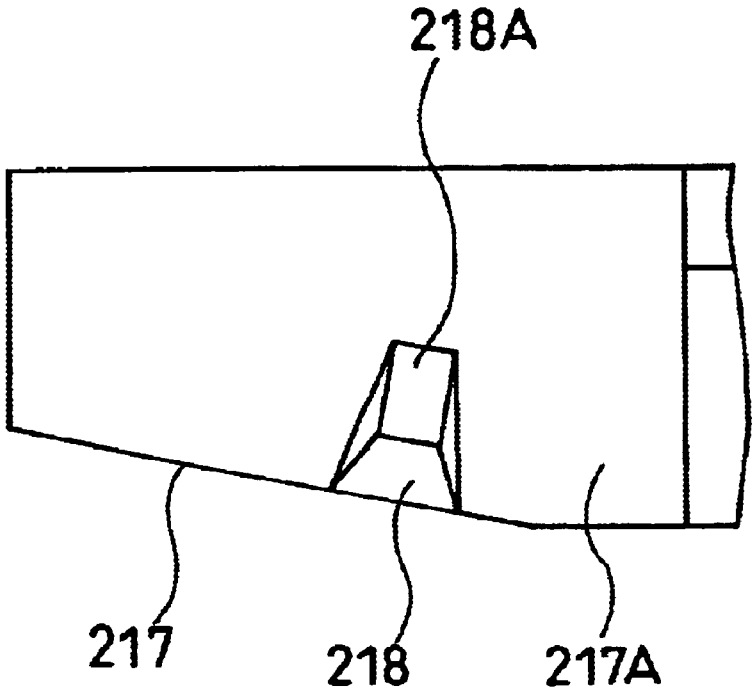
FIG. 49(A) is an enlarged view of the front portion of the clincher guide.
Figure 49B:
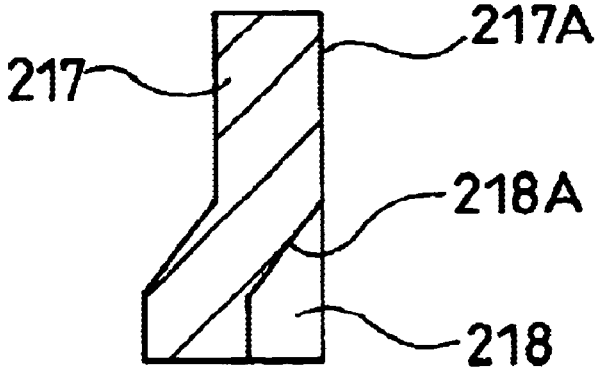
FIG. 49(B) is an enlarged sectional view of the front portion of the clincher guide.
Figure 50A:
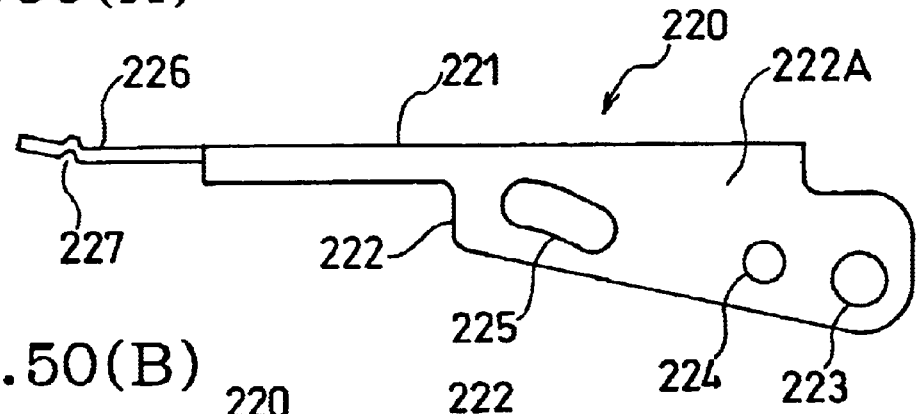
FIG. 50(A) is a side view of the clincher arm.
Figure 50B:
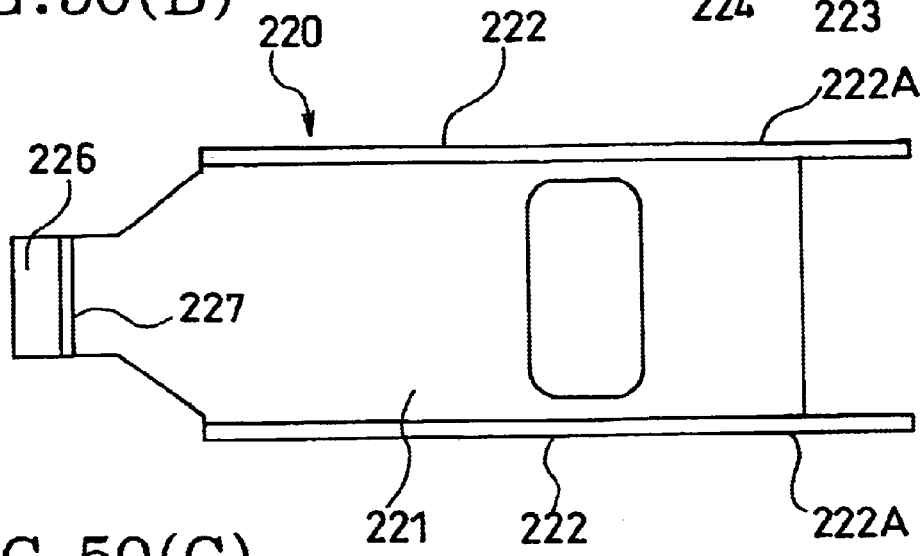
FIG. 50(B) is a bottom view of the clincher arm.
Figure 50C:
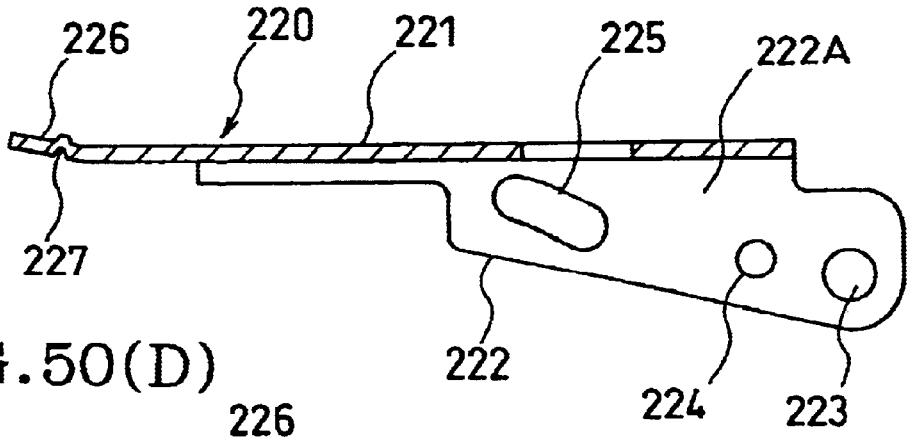
FIG. 50(C) is a vertical section of the clincher arm.
Figure 50D:
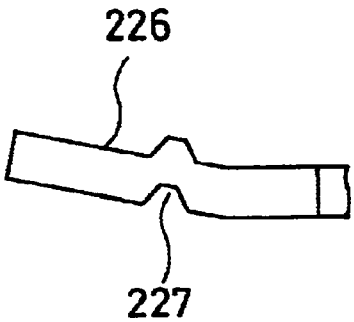
FIG. 50(D) is an enlarged view of the front portion of the ocher arm.

The clincher guide 210 has side plate portions 212 formed on both sides of a base portion 211, as shown in FIG. 48. Rear portions 212A of the side plate portions 212 are formed to thrust backward from the rear end of the base portion 211. Shaft holes 213, 214 are formed on the rear sides of the rear portions 212A, and slant long holes 215 are formed on the front sides of the rear portions 212A. A notch 216 having a specific depth and width is formed on the center of the front end of the base portion 211. Hanging walls 217 are formed on both the sides of the notch 216. As shown on FIG. 49 (A) and FIG. 49 (B) Recesses 218 are formed on insides 217A of the hanging walls 217, which extend upward from the lower ends thereof. Slopes 218A that slant inward are formed on the upper portions of the recesses 218. The lower portions of the recesses 218 are made open.

The clincher guide 210 is made to freely rotate by a shaft 31 attached between the side plates 23, 23 being inserted through the shaft holes 213 of the side plate portions 212. A shaft 32 is attached through the shaft holes 214, 214 of the side plate portions 212, 212; and both ends of a shaft 33 are inserted into the long holes 215, 215 of the side plate portions 212, 212. The shaft 33 is made movable along the long holes 215.

Clincher Arm

The clincher arm 220 has side plate portions 222 formed on both sides of a base portion 221, as shown in FIG. 50. Rear portions 222A of the side plate portions 222 are formed to thrust backward from the rear end of the base portion 221. Shaft holes 223, 224 are formed on the rear sides of the rear portions 222A, which face to the shaft holes 213, 214 of the clincher guide 210; and long holes 225 are formed on the front sides of the rear portions 222A, which face to the long holes 215 of the clincher guide 210. The diameter of the shaft hole 224 is set larger than that of the shaft hole 214 of the clincher guide 210; and the long hole 225 is slanted to the horizontal direction slightly more than the long hole 215 of the clincher guide 210.

And, a clincher portion 226 projecting forward is formed on the center of the front end of the base portion 211. A groove 227 extending right and left (in the vertical direction in FIG. 50(B)) is formed at the position corresponding to the recesses 218 of the clincher guide 210.

Figure 51:
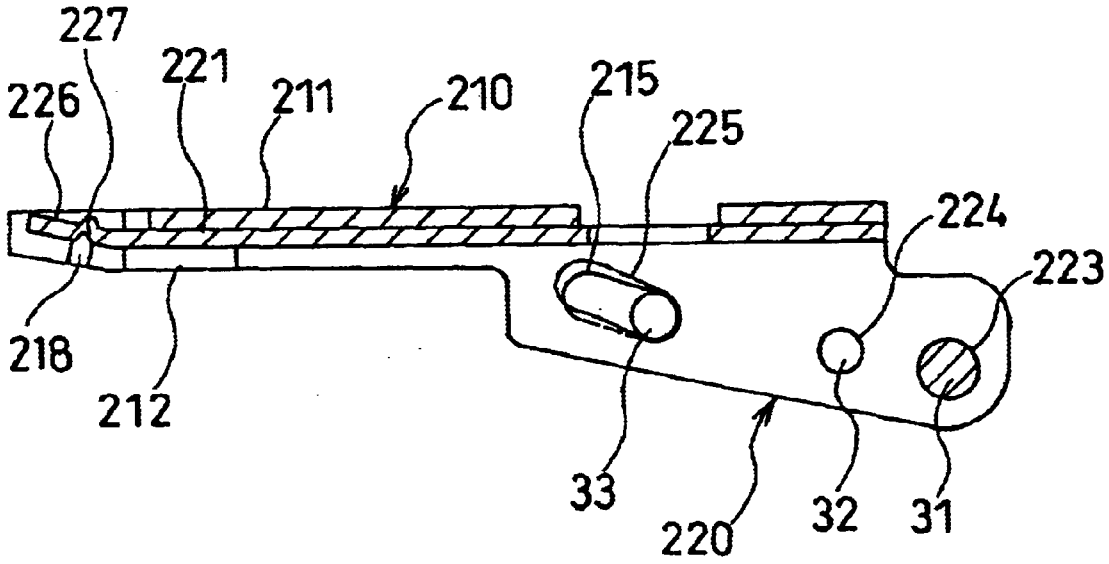
FIG. 51 is an explanatory chart of a state in which the clincher arm is attached to the clincher guide.
Figure 52:
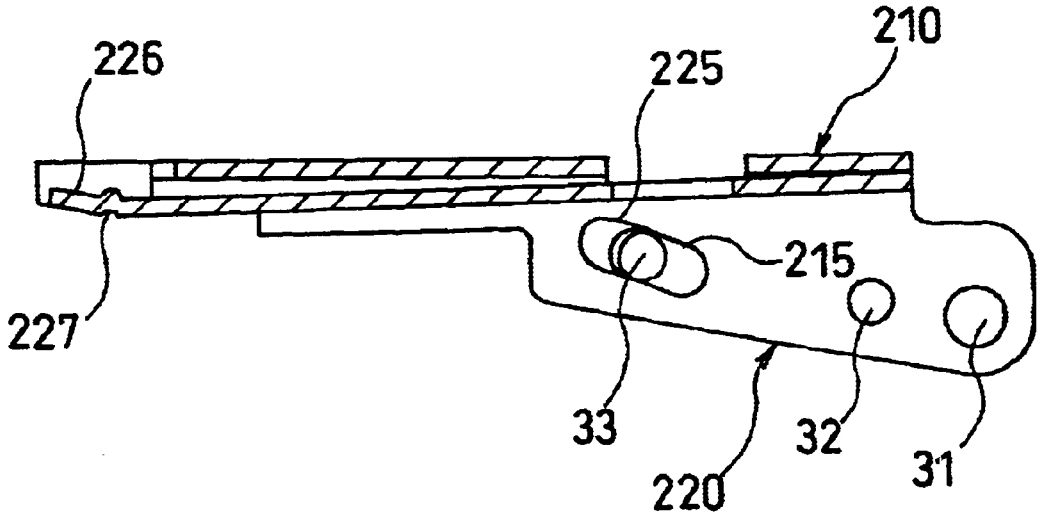
FIG. 52 is an explanatory chart of a state in which the clincher arm swings to the clincher guide.

The clincher arm 220 is placed between the side plate portions 212, 212 of the clincher guide 210, as shown in FIG. 51. The shaft 31 is inserted through the shaft holes 223 of the clincher arm 220, and the shaft 32 is loosely engaged in the shaft holes 224. The shaft 33 of the clincher guide 210 is inserted through the long holes 225 of the clincher arm 220, and the shaft 33 is made movable along the long holes 226. Since the long holes 225 are slanted to the horizontal direction more than the long holes 215, as the shaft 33 moves along the long holes 215, the clincher arm 220 swings about the shaft 31 by a specific angle from the clincher guide 210, as shown in FIG. 52.

Figure 53:
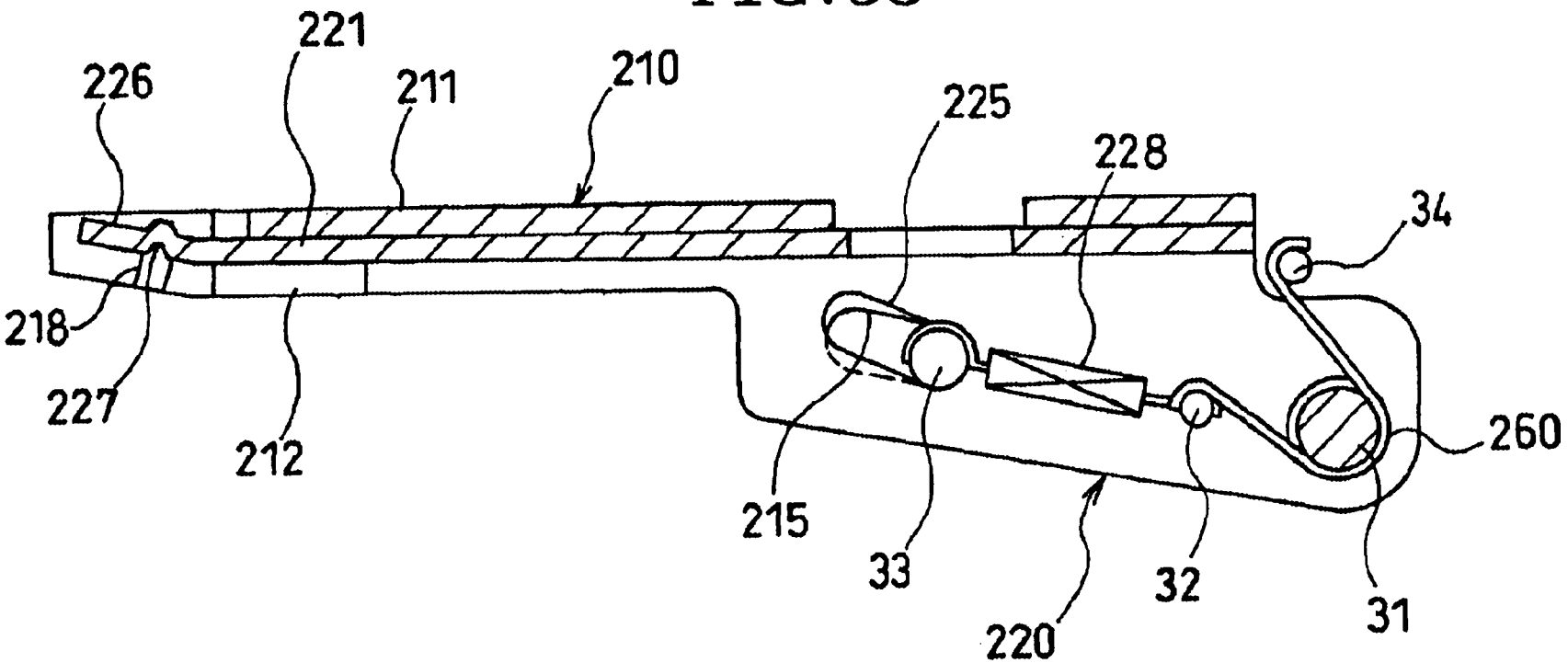
FIG. 53 is an explanatory chart illustrating the relation of the clincher guide, the clincher arm, the springs, and the shafts.
Figure 54:
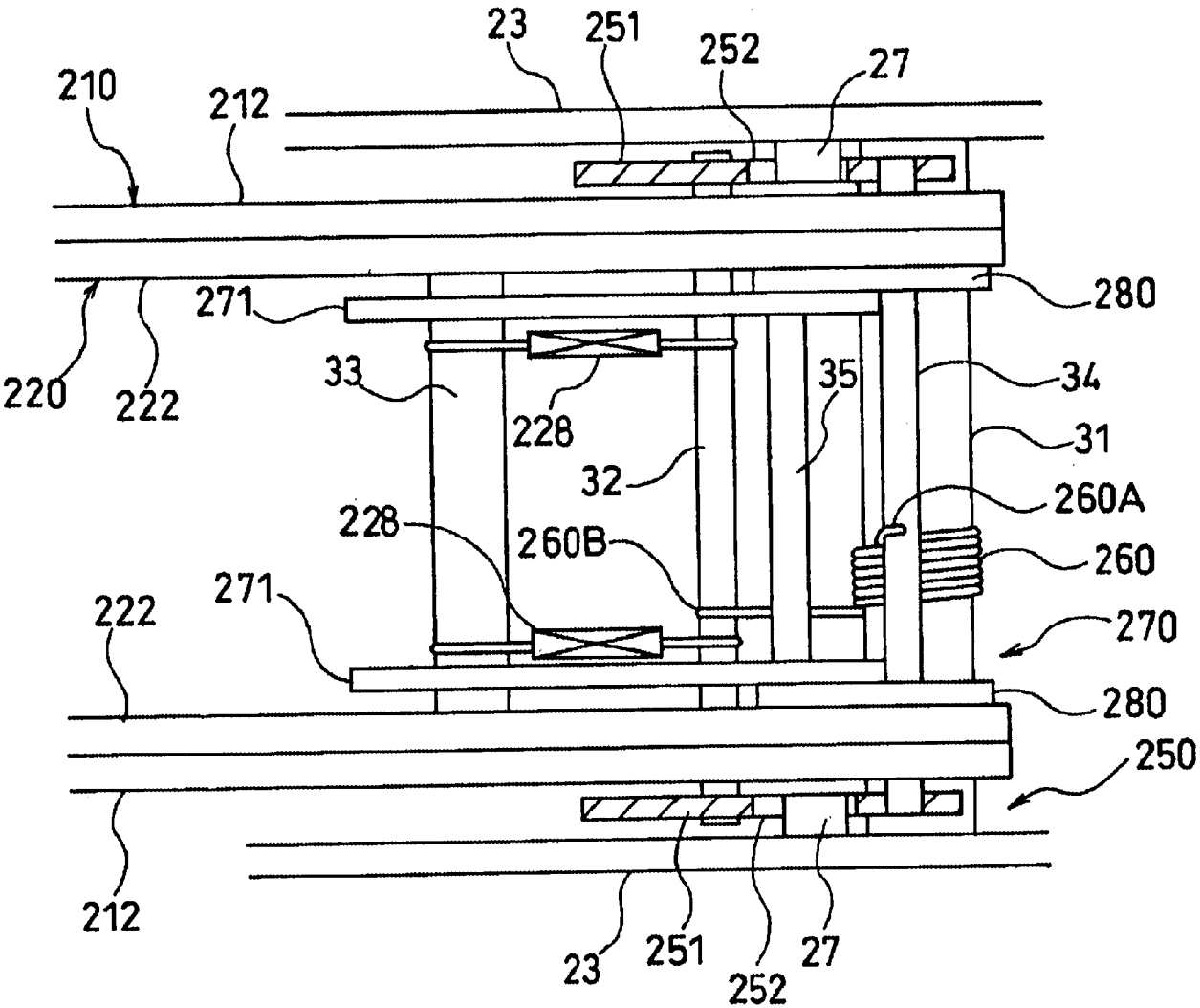
FIG. 54 is a plan view illustrating the lock mechanism and the release mechanism.

And, as shown in FIG. 53 and FIG. 54, a pair of springs 227 is mounted between the shaft 33 and the shaft 32, and the shaft 33 is energized backward by the springs 227.

Lock Mechanism

Figure 55:
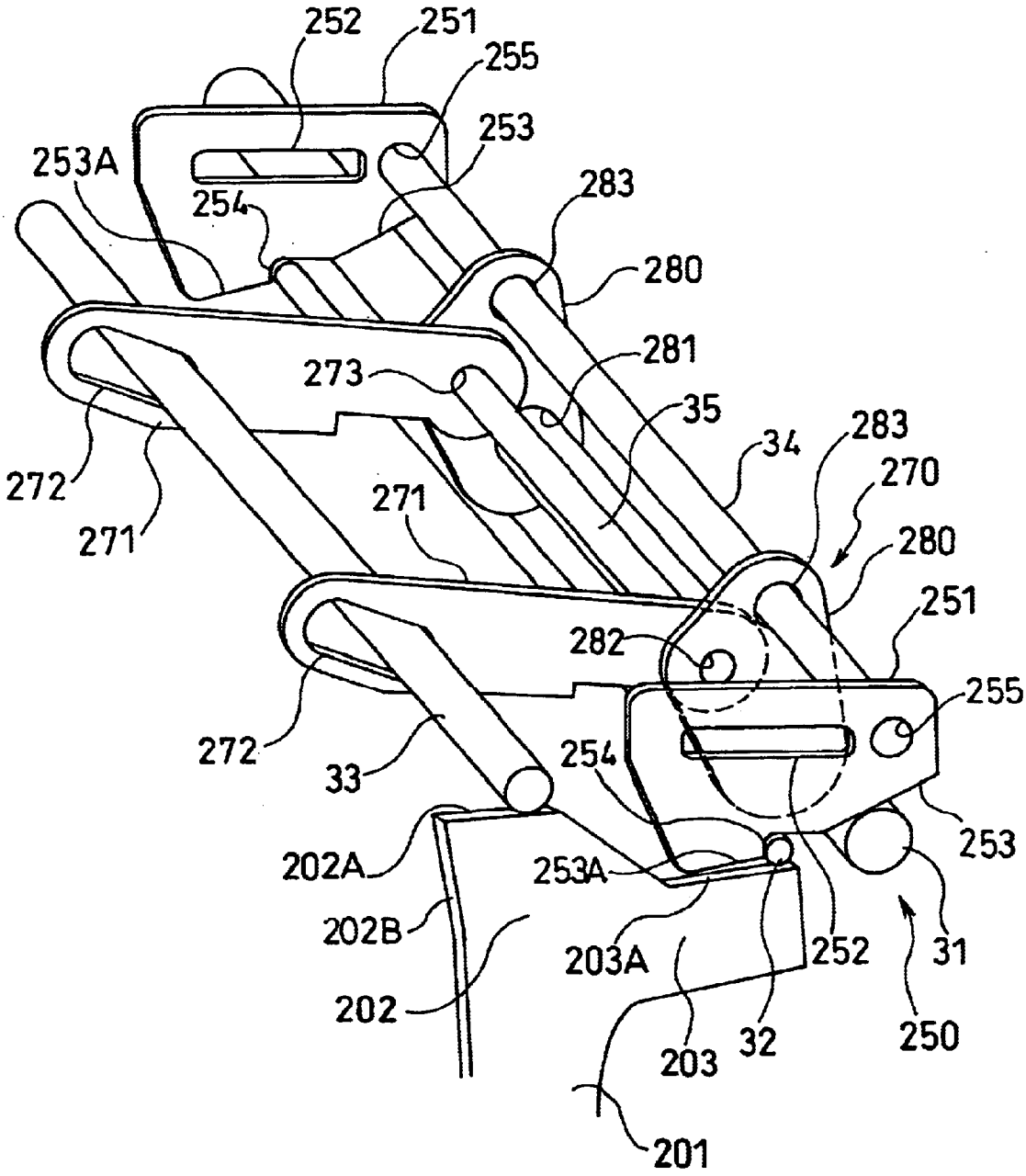
FIG. 55 is a perspective view illustrating the lock mechanism and the release mechanism.
Figure 56:
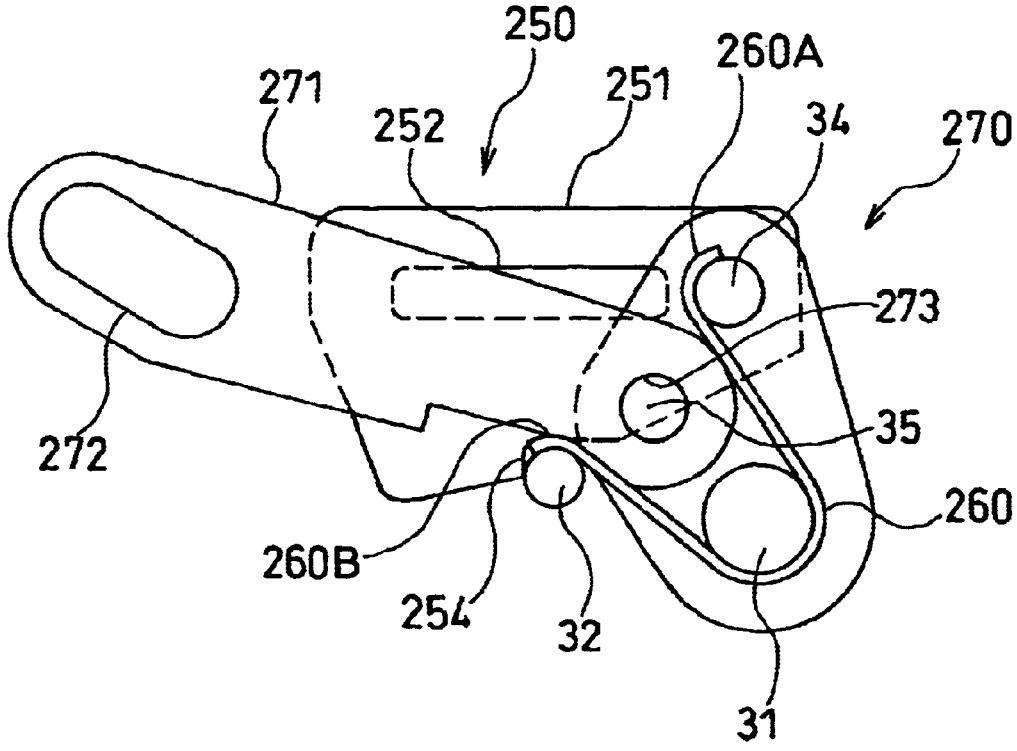
FIG. 56 is a side view illustrating the lock mechanism and the release mechanism.

The lock mechanism 250 includes suspended plates 251, 251 provided outside both the side plate portions 212, 212 of the clincher guide 210, and a spring 260 that moves the suspended plates 251, 251 backward, and the like, as shown in FIG. 54 through FIG. 56.

Figure 57:
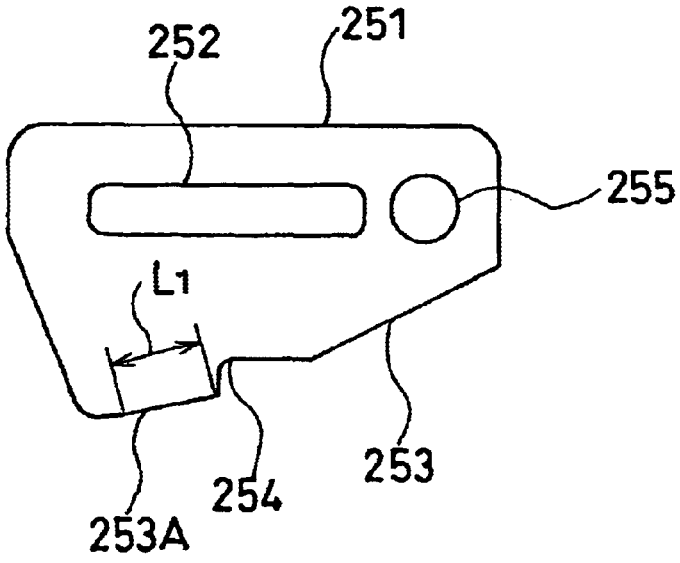
FIG. 57 is a side view of the suspended plate of the lock mechanism.

Each of the suspended plates 251 has a rectangular slit hole 252, as shown in FIG. 57. A lower side 253 of the suspended plate 251 is formed to slant upward to the backside. A recess 254 erred with the shaft 32 is formed on a middle position of the lower side 253, and a slant face 253A on the front side of the recess 254 ha a length L1. Further, a hole 255 is formed on the rear side of the slit hole 252 of the suspended plate 251.

The projections 27 of the side plates 23 are inserted in the holes 252 of the suspended plates 251, as shown in FIG. 46 and FIG. 54, and thereby the suspended plates 251 can be moved back and forth Since the projections 27 are made in a flat plate and the holes 252 are made in a slit, the suspended plates 251 are to move back and forth with the horizontal state maintained.

The spring 260 is wound on the shaft 31, and one end 260A of the spring 260 is hooked on a shaft 34 described later, and the other end 260B is hooked on the shaft 32. The spring 260 energizes the shaft 32 and the shaft 34 in a direction to expand the distance between both the shafts. This energizing form energizes the suspended plates 251 backward, and energizes the cincher guide 210 and the clincher arm 220 anticlockwise about the shaft 31 at the same time.

When the clincher links 201 stay at the position illustrated in FIG. 46, that is, when the driver holder 101 and the forming holder 110 stay at the home position, the shaft 32 is hooked in the recesses 254 of the suspended plates 251 and is in contact with the supporting faces 203A of the clincher links 201. The shaft 33 is in contact with the contact faces 202A of the clincher 201. Therefore, the suspended plates 251 stay at the position illustrated in FIG. 46 by the shaft 32 being hooked in the recesses 254 regardless of the energizing face of the spring 260, and will not move backward. And, the clincher guide 210 and the cincher arm 220 stay at the position illustrated in FIG. 46 by the shaft 32 being in contact with the supporting faces 203A regardless of the energizing force of the spring 260, and will not turn anticlockwise.

Figure 71:
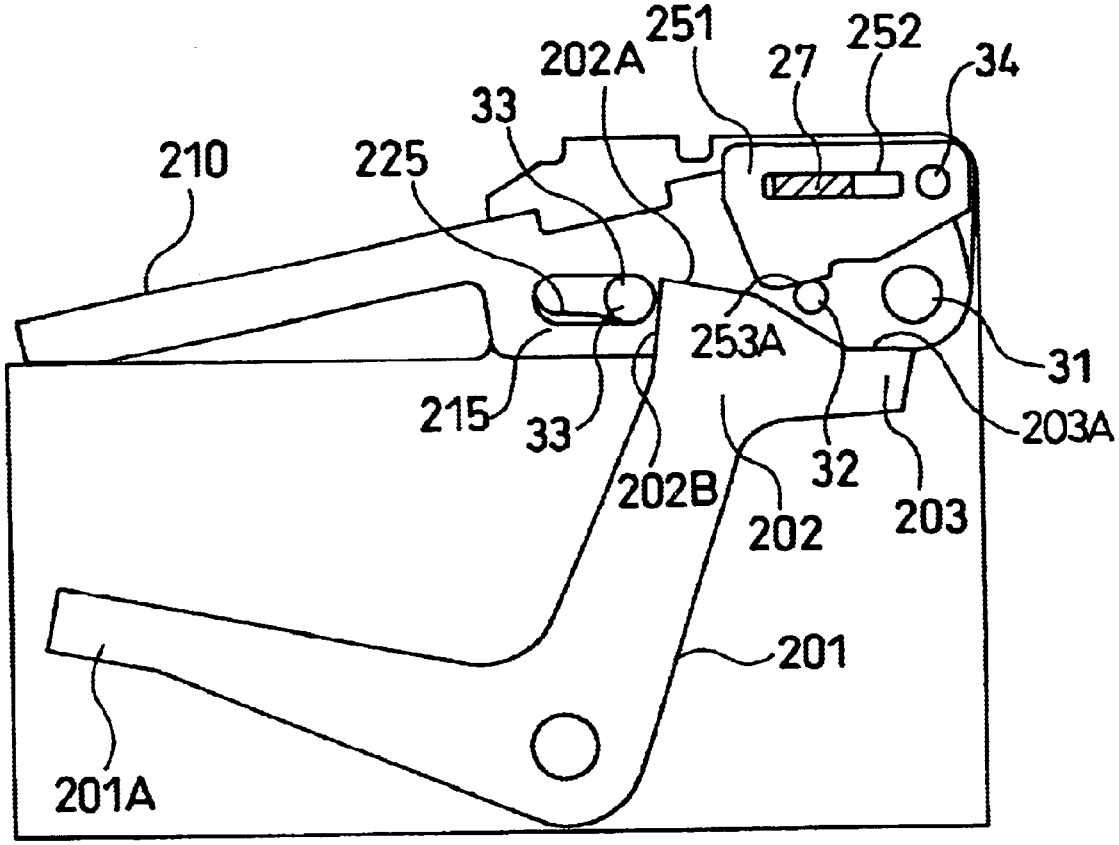
FIG. 71 is an explanatory chart of a state in which the front end of the clincher guide holds the sheet bundle by the swing of the clincher link.

When the clincher links 201 swing to a position illustrated in FIG. 71, the shaft 33 comes off the contact faces 202A of the clincher links 201 and the shaft 32 comes off the supporting face 203A of the clincher links 201, whereby the clincher arm 220 and the clincher guide 210 turn anticlockwise about the shaft 31 by the energizing face of the spring 260.

As the clincher arm 220 and the clincher guide 210 turn to the position illustrated in FIG. 71 by the energizing force of the spring 260, the lock mechanism 250 moves the suspended plates 251 backward by the energizing force of the spring 260, and brings the shaft 32 attached to the clincher guide 210 into contact with the slant faces 253A of the suspended plates 251, as shown in FIG. 71. Thereby, even if a strong upward force is effected to the fond end of the clincher guide 210, the suspended plates 261 will not turn about the shaft 34, since the projections 27 of the side plates 23 of the stapler body 10 are inserted into the slit holes 252 of the suspended plates 251. Accordingly, the clincher guide 210 does not turn clockwise by the suspended plates 251. That is, the clincher guide 210 is locked at the position illustrated in FIG. 71 by the lock mechanism 250.

Release Mechanism

The release mechanism 270 includes a pair of fist link plates 271 in conjunction with a pair of the cincher links 201 and a pair of virtually triangular second link plates 280, and the like.

First Link Plates

Figure 58:
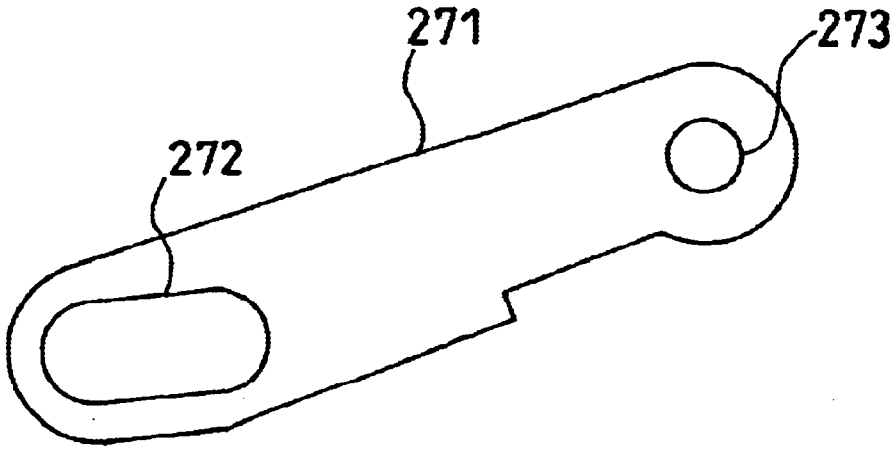
FIG. 58 is a side view of the first link plate of the lock mechanism.

The first link plates 271 have long holes 272 formed slant to the longitudinal direction on the front ends thereof, in which the shaft 33 is inserted, and have shaft holes 273 formed on the rear sides, as shown in FIG. 58. And, both ends of a shaft 35 are inserted into the shaft holes 273, 273 of the first link plates 271, 271 to thereby mount the shaft 35 on the fist link plates 271, 271, as shown in FIG. 54 and FIG. 55.

Second Link Plates

Figure 59:
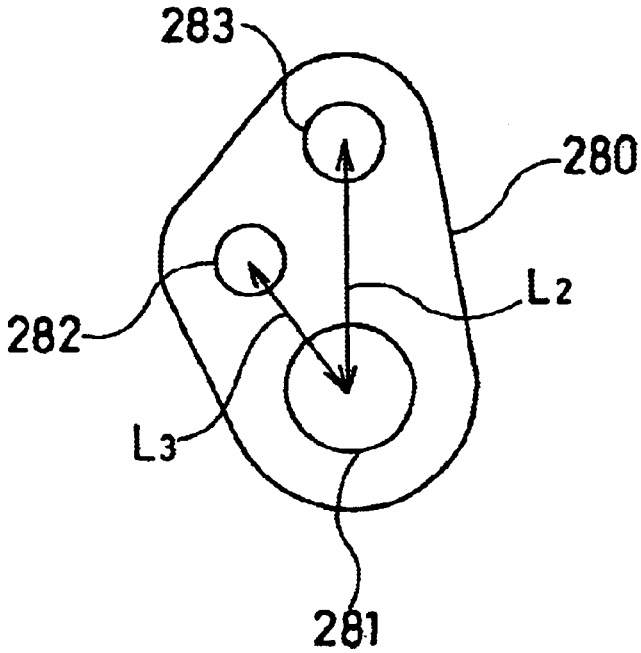
FIG. 59 is a side view of the second link plate of the lock mechanism.

The second link plates 280 have shaft holes 281 formed on the lower sides, shaft holes 282 formed on the center fronts, and vertically long shaft holes 283 formed on the upper sides, as shown in FIG. 59. The distance L2 between the shaft hole 281 and the shaft hole 283 is set to double the distance L3 between the shaft hole 281 and the shaft hole 282. The shaft 31 is inserted through the shaft holes 281, as shown in FIG. 55 and FIG. 56, and the second link plates 280 are rotatable about the shaft 31. Further, both the ends of the shaft 35 are inserted into the shaft holes 282, 282, and the shaft 34 is inserted through the shaft holes 283, 283. The shaft 34 is movable relatively vertically in the shaft holes 283, 283.

Figure 77:
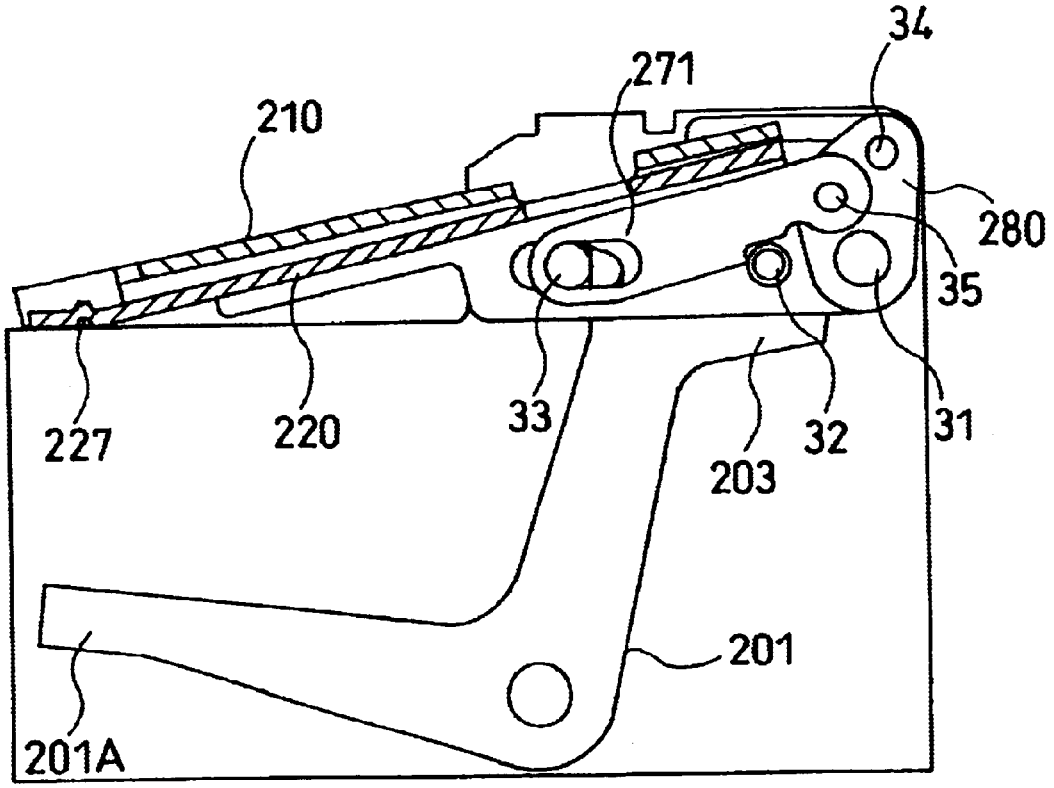
FIG. 77 is an explanatory chart illustrating the swing position of the clincher arm to the clincher guide.

As the clincher links 201 turn anticlockwise from a position illustrated in FIG. 77, the contact faces 202B push the shaft 33 forward, the first ink plates 271 move forward together with the shaft 33, the second link plates 280 turn about the shaft 31, and the turning of the second link plates 280 moves the suspended plates 251 forward through the shaft 34. Thus, the release mechanism 270 releases the lock of the clincher guide 210 by the moving of the suspended plates 251 forward.

Cartridge

Figure 60:
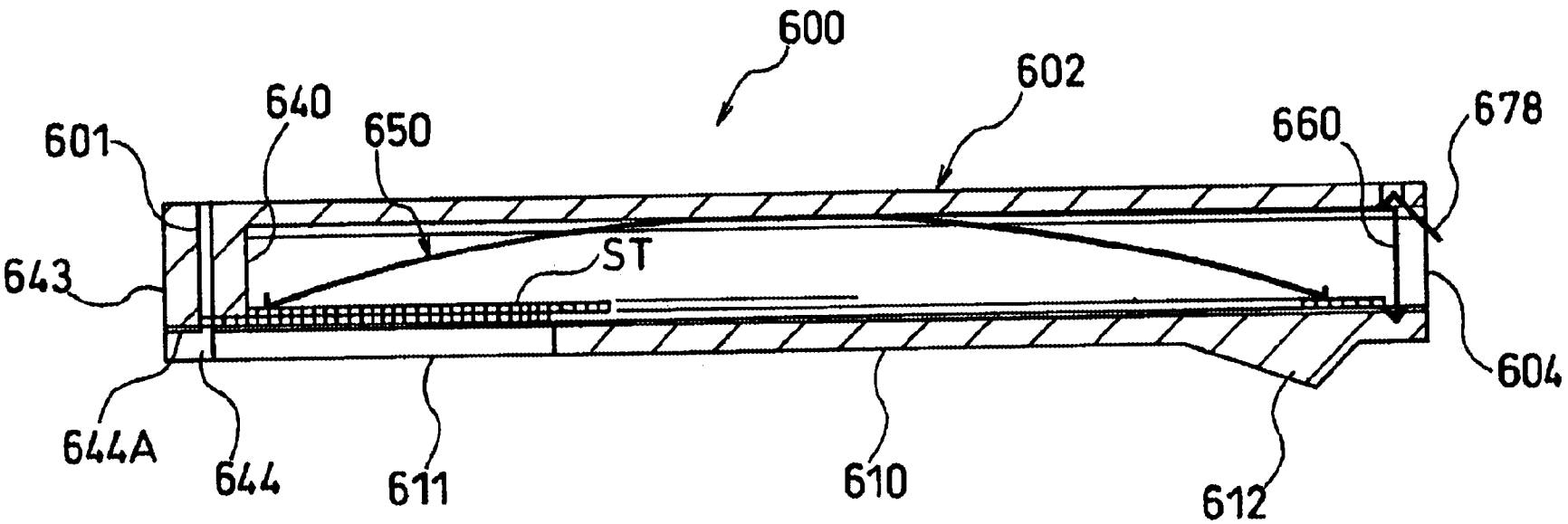
FIG. 60 is a vertical section illustrating the construction of the cartridge.

The cartridge 600 is composed of, as shown in FIG. 60, a cartridge body 602, a blade spring unit 650 detachably mounted in the cartridge 602, and the like.

Cartridge Body

Figure 61A:
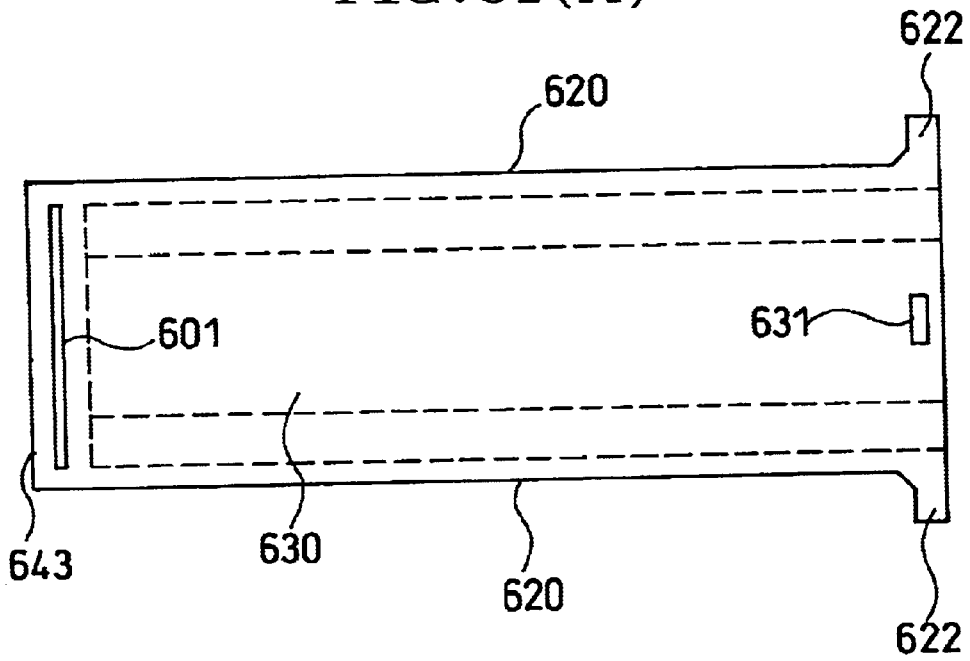
FIG. 61(A) is a plan view of the cartridge body.
Figure 61B:
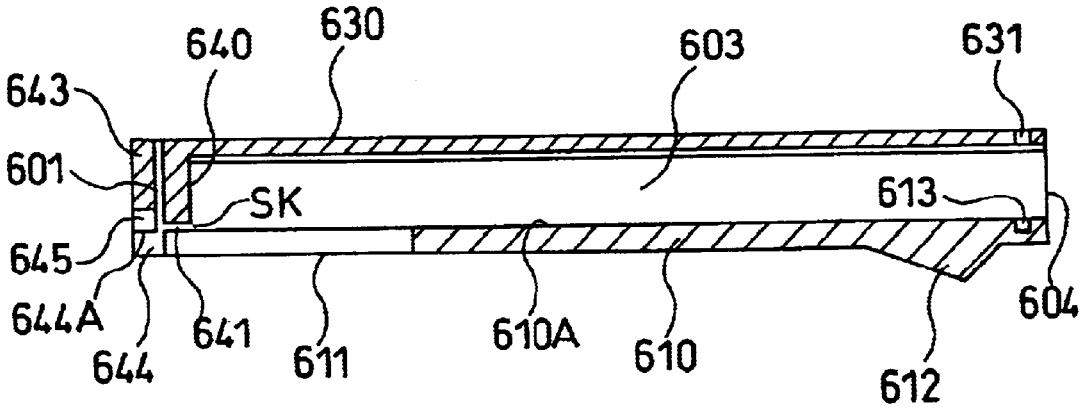
FIG. 61(B) is a vertical section of the cartridge body.
Figure 62A:
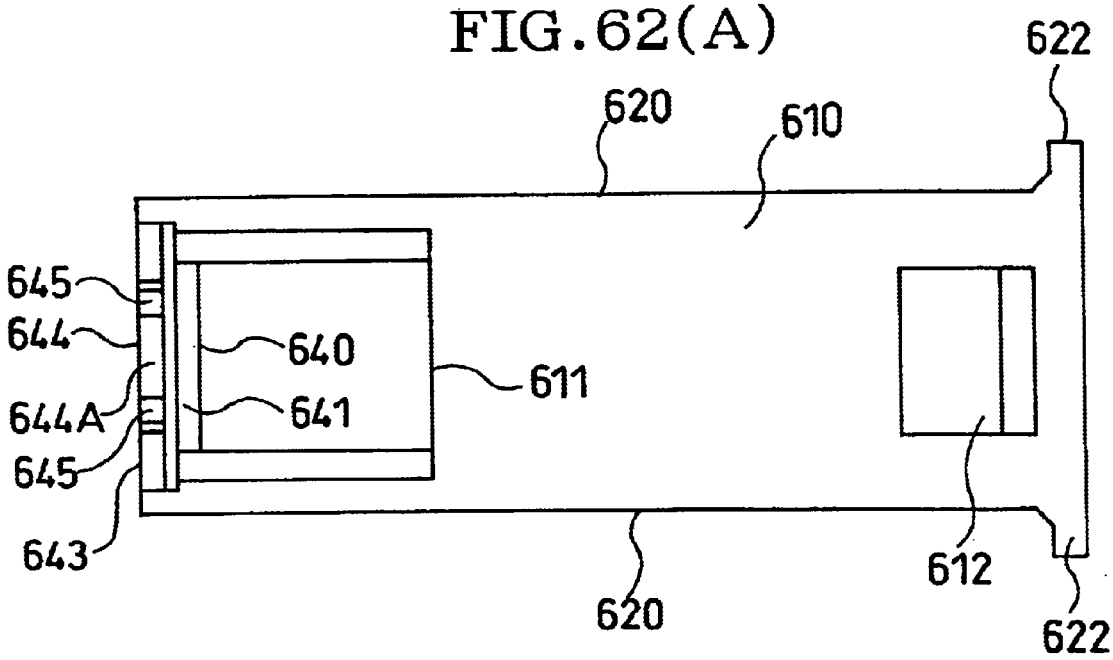
FIG. 62(A) is a bottom view of the cartridge body in FIG. 61.
Figure 62B:
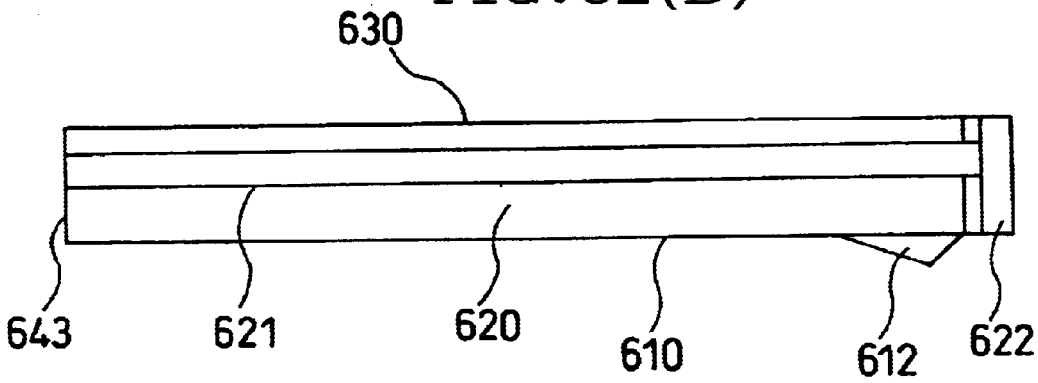
FIG. 62(B) is a side view of the cartridge body in FIG. 61.
Figure 62C:
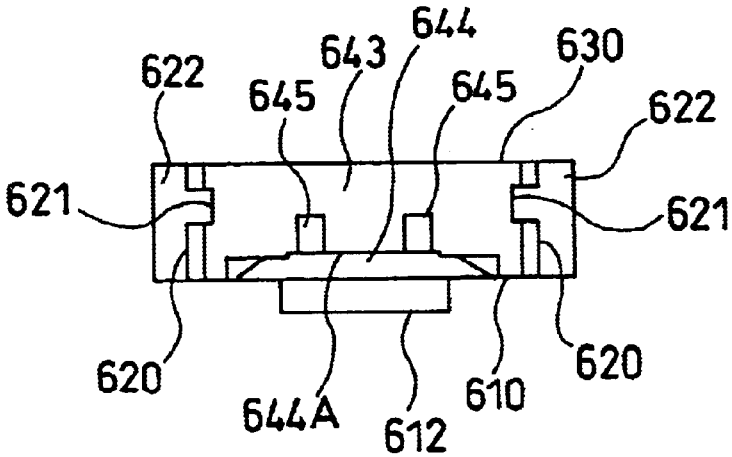
FIG. 62(C) is a front view of the cartridge body in FIG. 61.

The cartridge body 602 has a bottom wall 610, side walls 620, 620, a ceiling wall 630, a front wall 640, and the like, that form a chamber 603 to contain the sheet staple ST piled up, as shown in FIG. 61 and FIG. 62. In mounting the cartridge 600 in the stapler body 10, the upper aide of the ceiling wall 630 becomes flush with an upper edge face 25A of the front plate 25 of the stapler body 10, and the ceiling wall 630 becomes a face on which a sheet bundle P is mounted.

The rear end of the cartridge body 602 is made open as an opening 604. An opening 611 having a specific width shorter than the length of the staple S and a specific length is formed on the front portion of the bottom wall 610, and a projection 612 projected downward is formed on the underside of the rear portion of the bottom wall 610. A recess 613 is formed on the upper side of the rear portion of the bottom wall 610.

The sidewalls 620 have guide grooves 621 formed along the outsides thereof, and handles 622 projecting to the sides formed on the rear portions thereof. The ceiling wall 630 has a hole 631 formed on the rear portion thereof and a gap SK is formed between a lower face 641 of the front wall 640 and an upper face 610A of the bottom wall 610. The height of the gap SK is set substantial identical to the thickness of the sheet staple ST.

The front wall 640 is provided with a guide wall 643 on the front thereof, and the driving passage 601 is formed between the guide wall, 643 and the front wall 640. The driving passage 601 is formed to thrust out the ceiling wall 630 on the upper end thereof. The guide wall 643 has a recess 644 formed on the underside thereof, and the vertical position of an upper face 644A of the recess 644 is substantially coincident with the vertical position of the upper face 610A of the bottom wall 610. The recess 644 has a pair of notches 645, 645 formed inside thereof.

Blade Spring Unit

Figure 63:
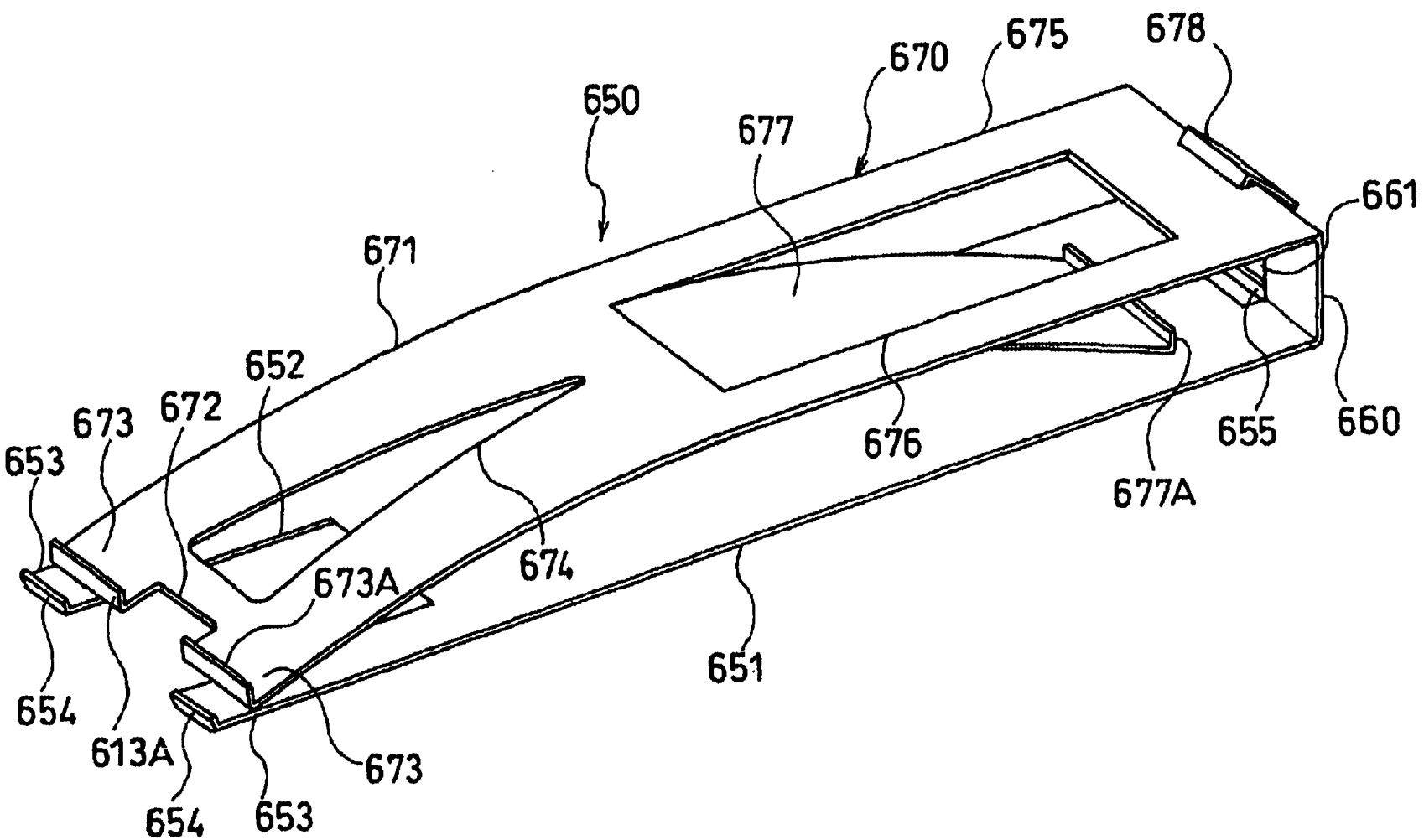
FIG. 63 is a perspective view of the blade spring unit of the cartridge.
Figure 64:
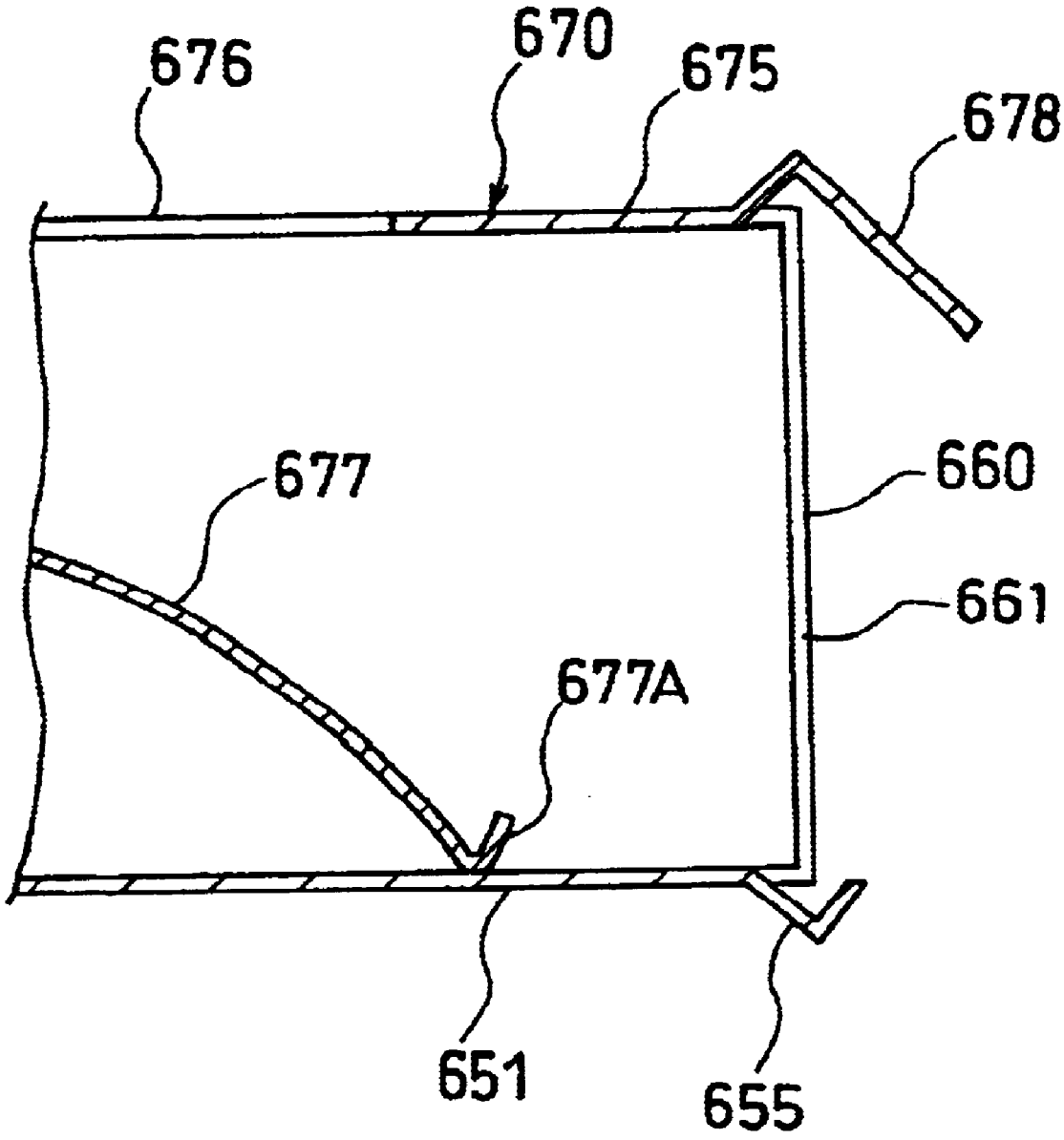
FIG. 64 is an enlarged partial view of the blade spring unit shown in FIG. 63.

The blade spring unit 650 includes, as shown in FIG. 63, a rectangular bottom plate portion 651 extending laterally (right and left in FIG. 63), an upright portion 660 rising on the rear end of the bottom plate portion 651, and a top board portion 670 extending forward from the upper end of the upright portion 660.

The bottom plate portion 651 has a notch 652 with a specific width and depth formed on the front center thereof and pair of elastic legs 653 are formed on both the sides of the notch 652, and check claws 664 projecting slant upward are formed on the fronts of the legs 653. Further, the bottom plate portion 651 has a hook portion 655 formed on the rear portion thereof, which projects downward from the bottom of the bottom plate portion 651 and turns upward in a V-letter shape. The upright portion 660 has an opening 661 formed on the middle portion thereof.

The front portion of the top board portion 670 is bent to form a blade spring portion 671, and the blade spring portion 671 has a recess 672 formed on the front center thereof and both sides of the recess 672 form a pair of legs 673. Front portions 673A of the legs 673 are bent upward, and are in contact with the legs 653 of the bottom plate portion 651. Further, the blade spring portion 671 has a virtually triangular opening 674 Formed thereon, and thereby achieves higher elasticity. The top board portion 670 is provided with a U-letter shaped cut 676 on a rear portion 675, and the portion surrounded by the cut 676 forms a blade spring portion 677. The blade spring portion 677 is bent, and a rear end portion 677A thereof is bent upward and is in contact with the bottom plate portion 651. And, the blade spring portion 671 and the blade spring portion 677 constitute a blade spring.

Further, the top board portion 670 has a reverse V-letter shaped handle portion 678 formed on the rear portion thereof and the handle portion 678 thrusts out backward from the upright portion 660.

Figure 65:
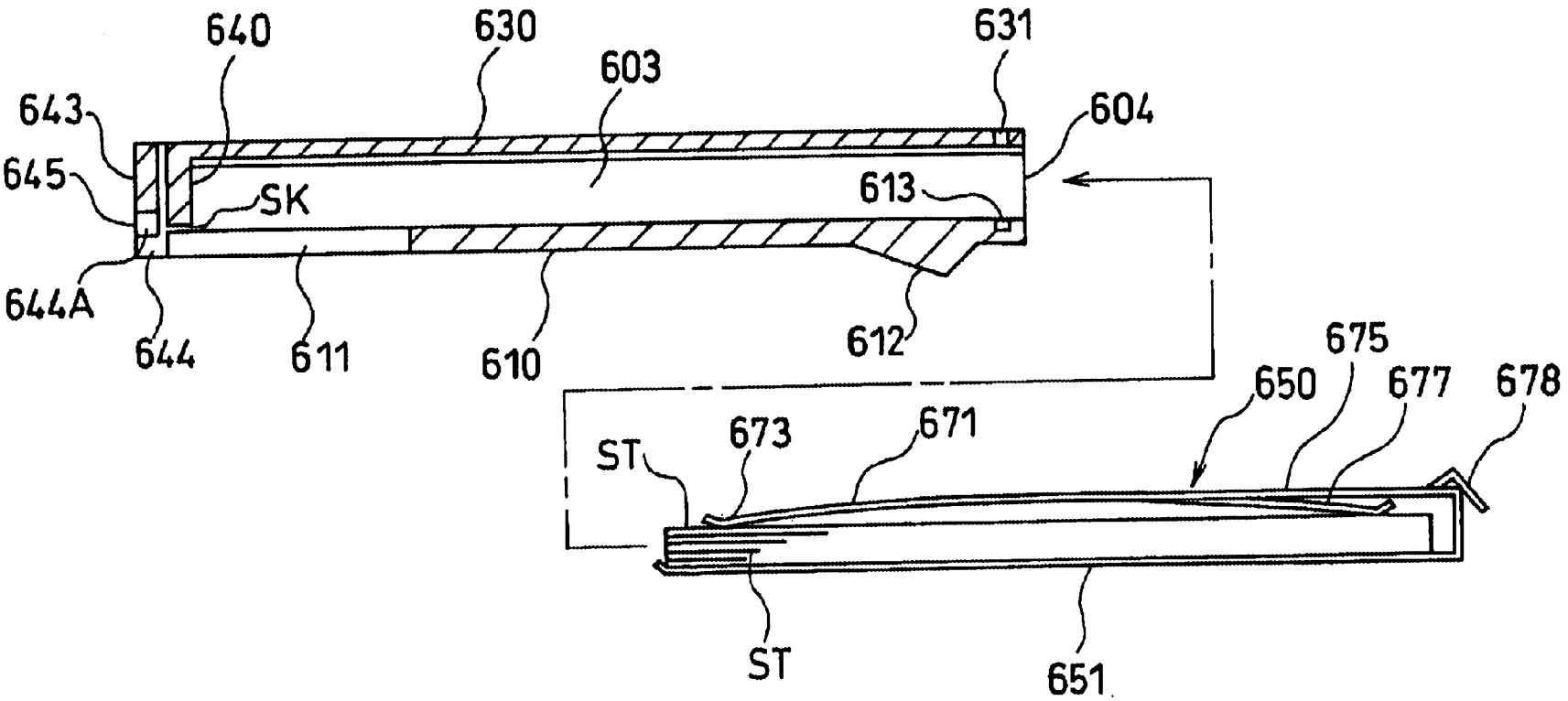
FIG. 65 is an explanatory chart of a state in which the stacked sheet staple is contained in the cartridge body.

In order to contain the sheet stale ST in the cartridge body 602 in a stacked state, the first process is to stack the sheet staple ST on the bottom plate portion 651 of the blade spring unit 660, and then to sandwich the stacked sheet staple ST between the bottom plate portion 651 and the blade spring portions 671, 677, as shown in FIG. 65. And, the blade spring unit 650 with the sheet staple ST stacked is inserted in the cartridge body 602 from the rear opening 604 thereof. As the blade spring unit 650 is inserted to a specific position of the cartridge body 602, the hook portion 655 of the blade spring unit 650 is engaged in the recess 613 of the bottom wall 610 of the cartridge body 602, and the crest 678A of the handle portion 678 is engaged in the hole 631 of the ceiling wall 630 Thus, the blade spring unit 650 is placed securely in the chamber 603 of the cartridge body 602.

The cartridge 600 with the sheet staple ST contained is loaded into the stapler body 10 from the arrow direction illustrated in FIG. 3. In the loading, the guide projections 19 of the upper walls 16 of the body case 13 are engaged in the guide grooves 621 of the sidewalls 620 of the cartridge body 602 (see FIG. 38). The cartridge 600 is pushed forward to be loaded. When the cartridge 600 is loaded in the stapler body 10, as shown in FIG. 3, the projection 612 of the cartridge body 602 is engaged in the nadir 41 of the fixed spring 40 of the body case 13; thus the cartridge 600 is placed securely to the stapler body. And, the slider 301 abed to the body case 13 goes into the opening 611 of the cartridge body 602.

Operation of the Electric Stapler

Figure 66:
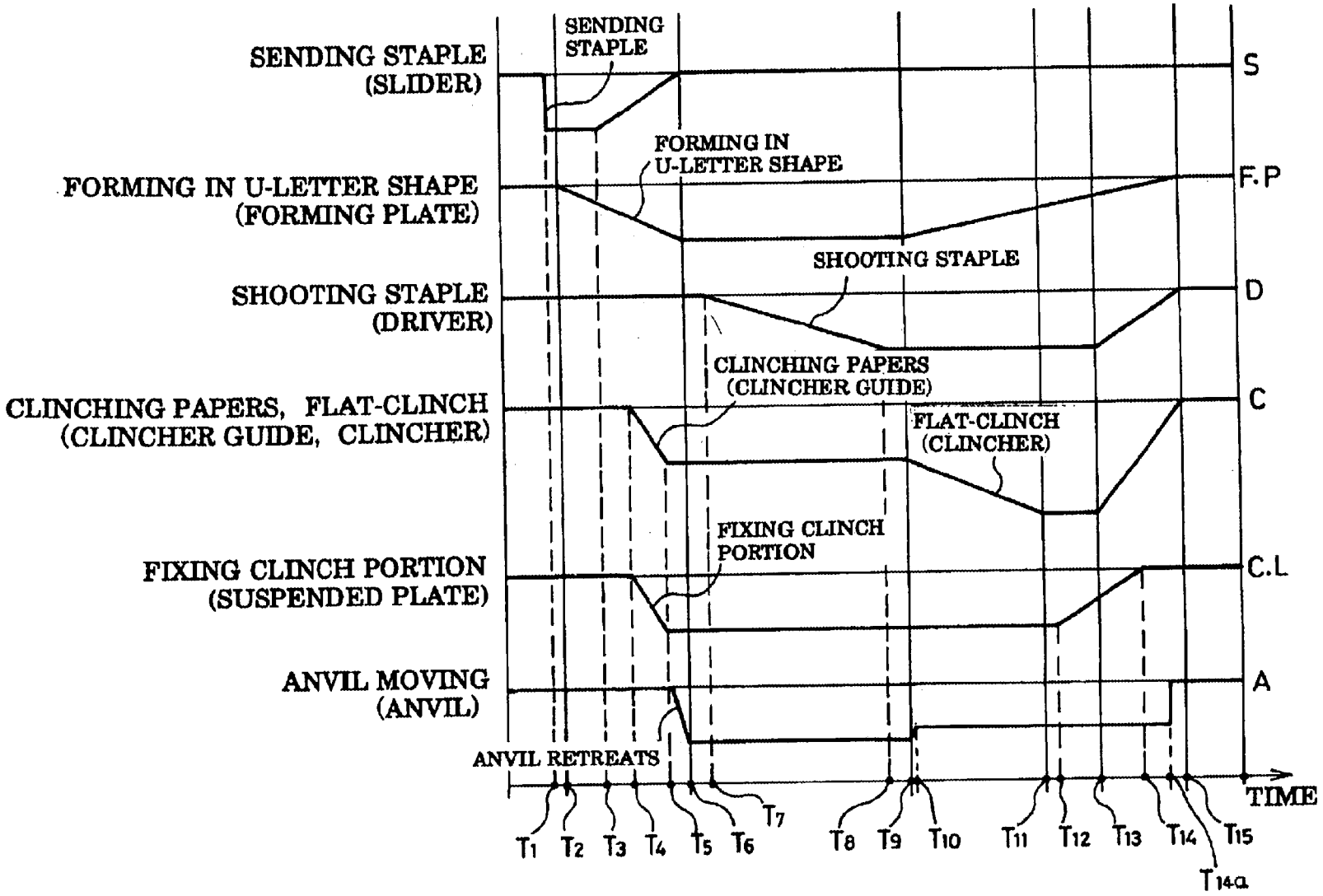
FIG. 66 is a timing chat illustrating the operation of the electric stapler.

Next, the operation of the electric stapler 1 made up as above will be described with reference to the timing chart illustrated in FIG. 66.

Figure 39A:
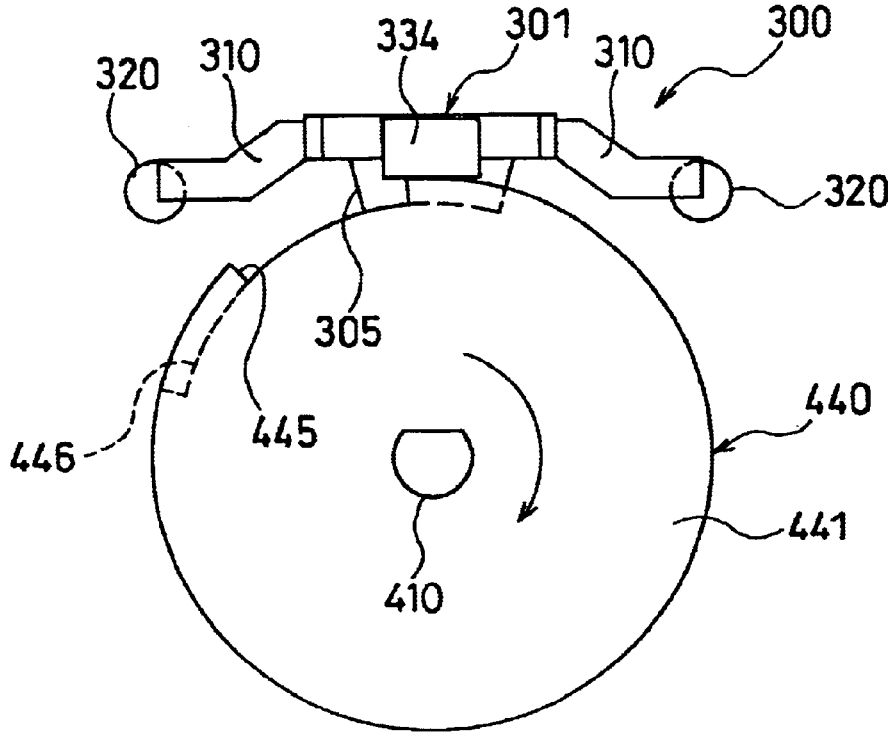
FIG. 39(A) is a front view illustrating the positional relation between the slider and the disc of the drive gear holder.
Figure 39B:
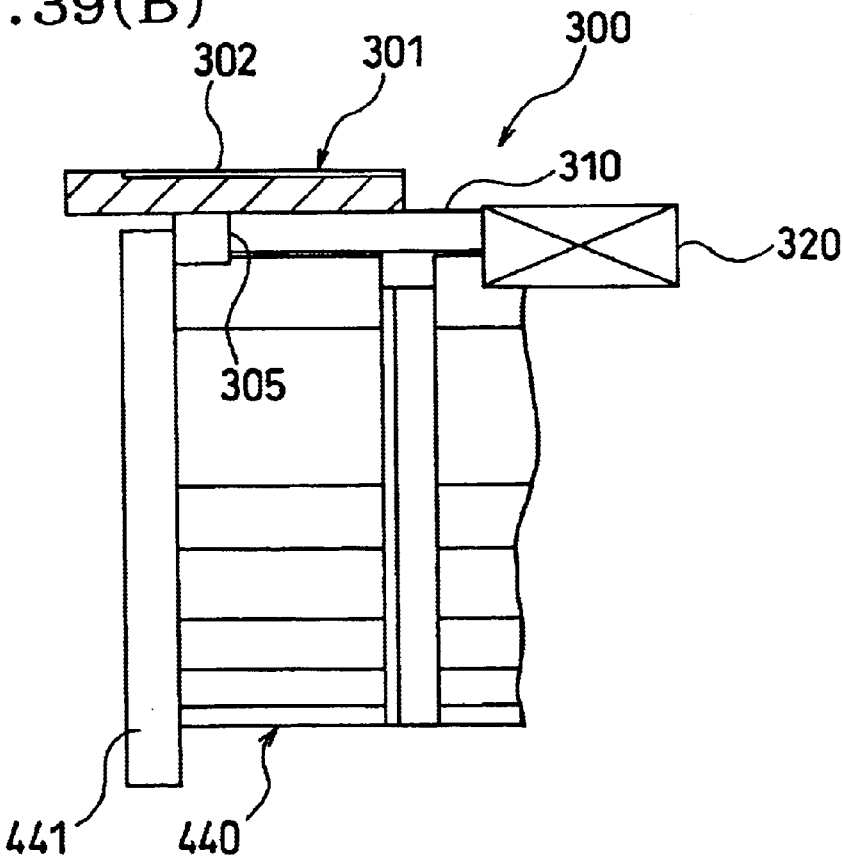
FIG. 39(B) is a side view illustrating the positional relation between the slider and the disc of the drive gear holder.

First, the cartridge 600 with the stacked sheet staple ST contained is loaded in advance in the stapler body 10 shown in FIG. 3. When the motor M is not driven, the driver holder 101 and the forming holder 110 stay at the home position illustrated in FIG. 3. And, the slider 301 is stopped at the position illustrated in FIG. 44, by the projection 305 of the slider 301 being in contact with the disc 441 of the drive gear holder 440, as shown in FIG. 39 and FIG. 44. Further, the end portion 512A of the anvil 510 goes into the driving passage 601, passing through the notch 645 of the guide plate 643 of the cartridge 600.

Figure 4:
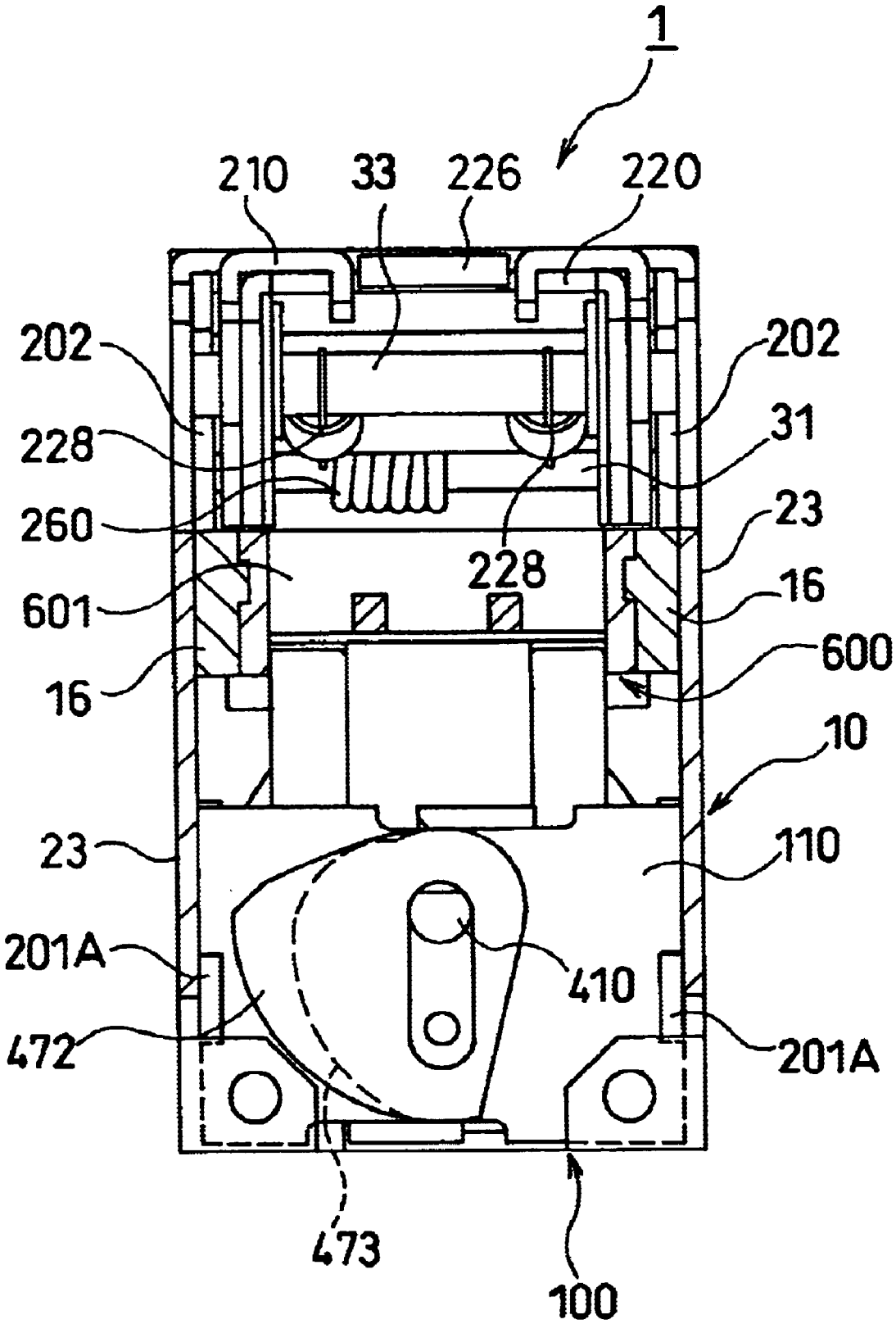
FIG. 4 is a lateral sectional view of the electric stapler shown in FIG. 1.

When the motor M is driven by a filing signal from a facsimile or a printer not illustrated, the drive shaft 410 rotates clockwise in FIG. 4 through the drive gear 401, the planet gears 425, 437, 444, and the gears 424A, 435A, etc., and the cams 470 to 473 and the drive gear holder 440 rotate integrally with the drive shaft 410.

Figure 67:
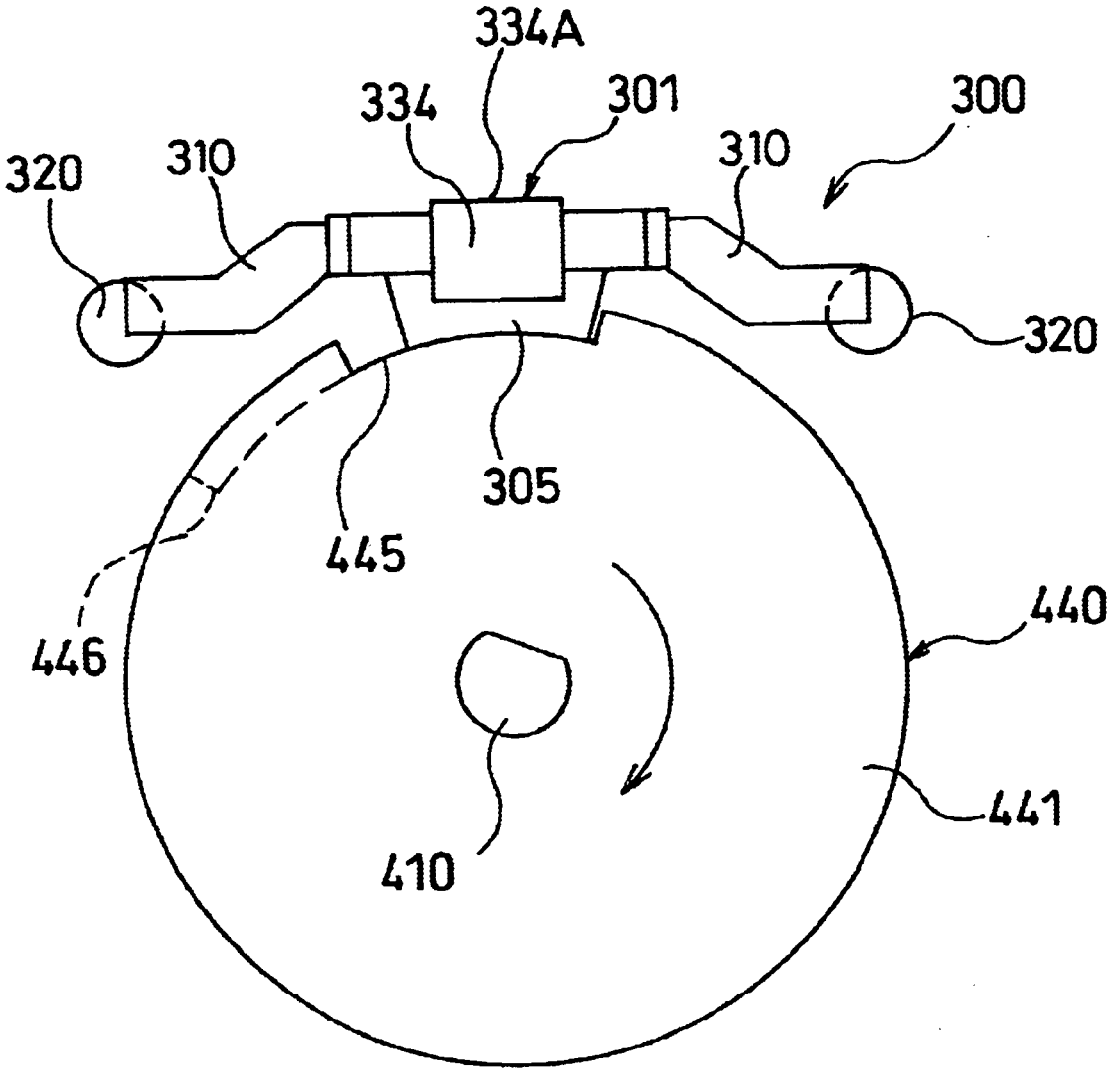
FIG. 67 is an explanatory chart illustrating the disc of the drive gear holder when the slider moves forward.
Figure 68:
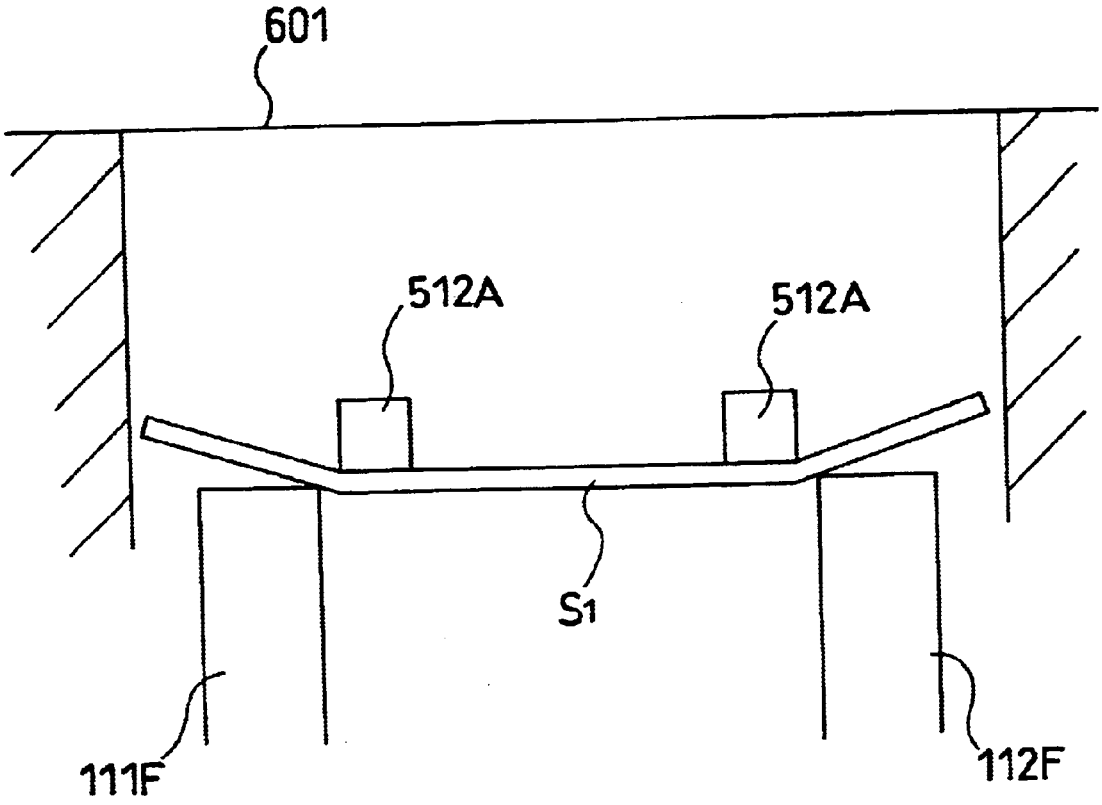
FIG. 68 is an explanatory chart of a state in which the staple is formed in a U-letter shape.

As the drive gear holder 440 rotates and the notch 445 of the disc 441 comes to the position illustrated in FIG. 67, the projection 305 of the slider 301 comes off the disc 441 of the drive gear holder 440; and accordingly the slider 301 moves forward by the energizing force of the springs 320 and goes into the notch 445. As the slider 301 moves forward, the end portion 334A of the claw 334 of the sending plate 330 thrusts out over the upper face of the base portion 302 of the slider 301 as shown in FIG. 45, whereby the sheet staple ST stacked in the lowest layer, contained in the cartridge 600, is sent out forward (time T1 in FIG. 66).

The sheet staple ST is sent out until the leading staple S1 is brought into contact with the lower portion of the guide wall 643 of the cartridge 600, as shown in FIG. 60. The leading staple S1 brought into contact with the lower portion of the guide wall 643 is placed on the one end of the driving passage 601. And, the staple S1 is brought into contact with the lower face of the end portion 512A of the anvil 510, as shown in FIG. 33.

And, accompanied with the rotation of the forming cam 472, the forming holder 110 lifts up. With this lifting-up, the forming plates 111, 112 start to Form the staple S1 in the U-letter shape (time T2). As the gear holder 440 further rotates, the slope 446 of the disc 441 comes in contact with the front of the projection 305 of the slider 301, and accompanied with the rotation of the drive gear holder 440, the slope 446 pushes the slider 301 backward against the energizing force of the springs (time T3); thus the slider 301 is moved backward.

During the backward movement of the slider 301, the sheet staple ST is about to be pushed backward, however the check claws 654 of the blade spring unit 650 of the cartridge 600 prevent the sheet staple ST from being pushed back.

Figure 69:
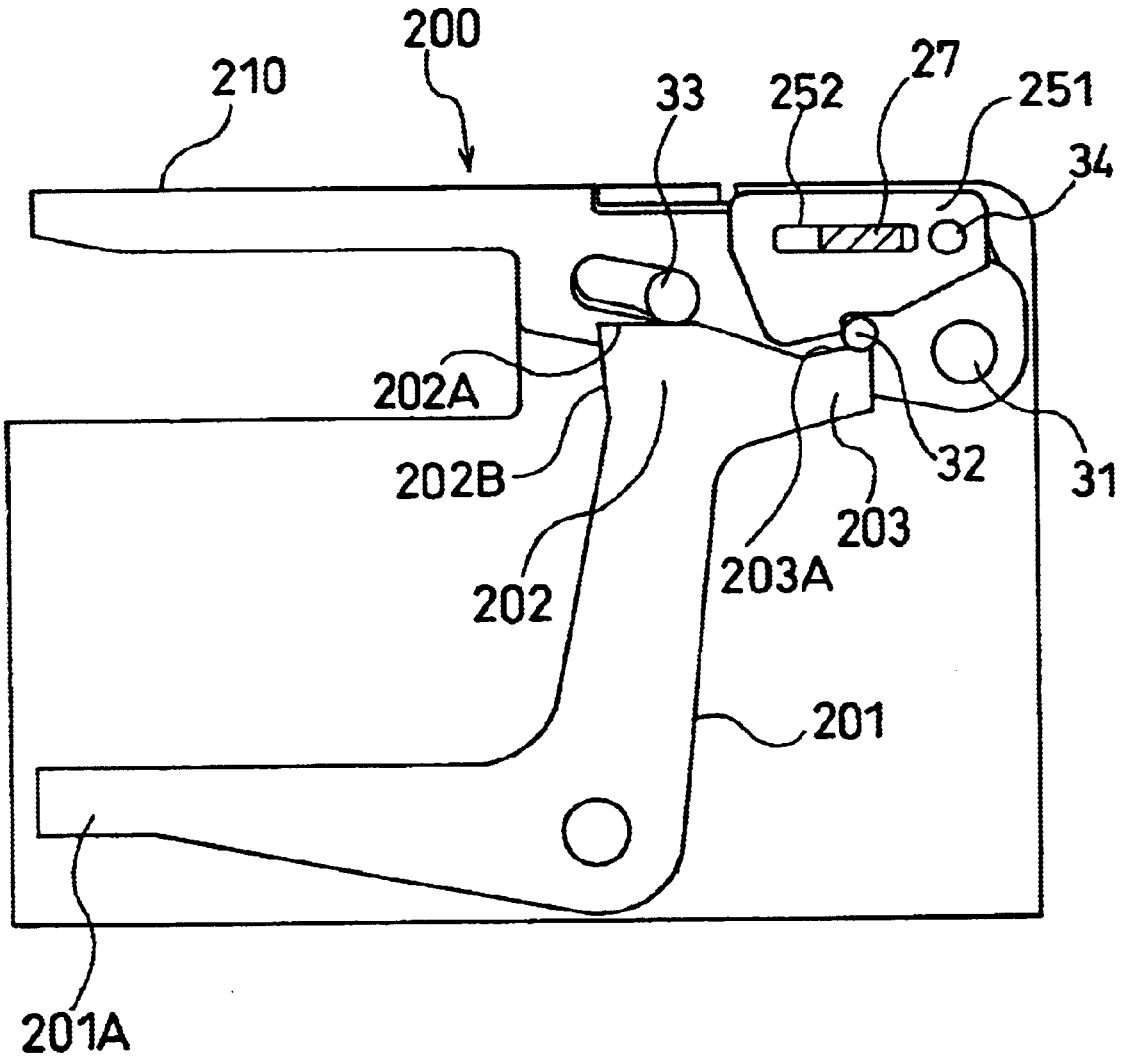
FIG. 69 is an explanatory chart illustrating the state of the lock mechanism and the clincher link and the clincher guide, when the forming holder is at the home position.
Figure 70:
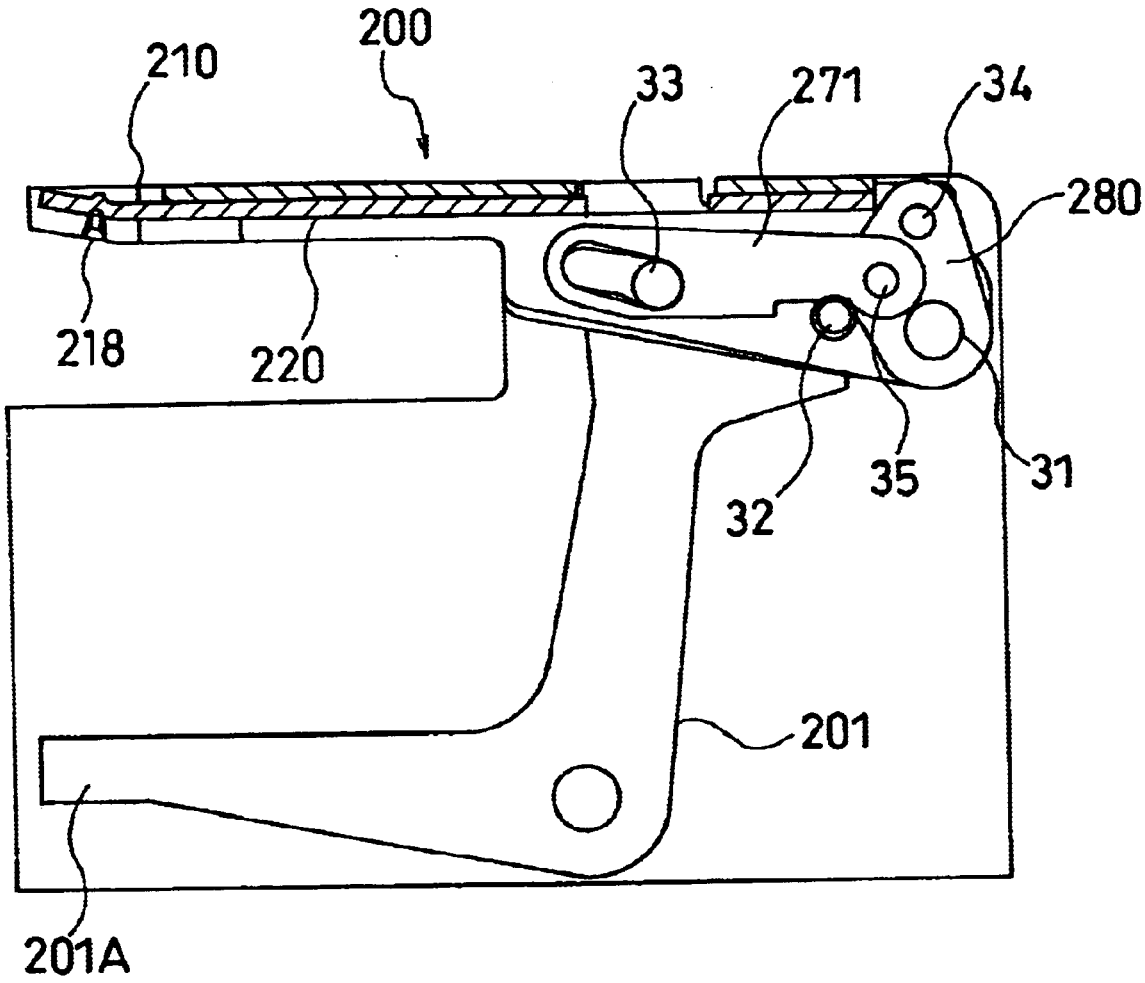
FIG. 70 is an explanatory chart illustrating the state of the release mechanism, when the forming holder is at the home position.
Figure 72:
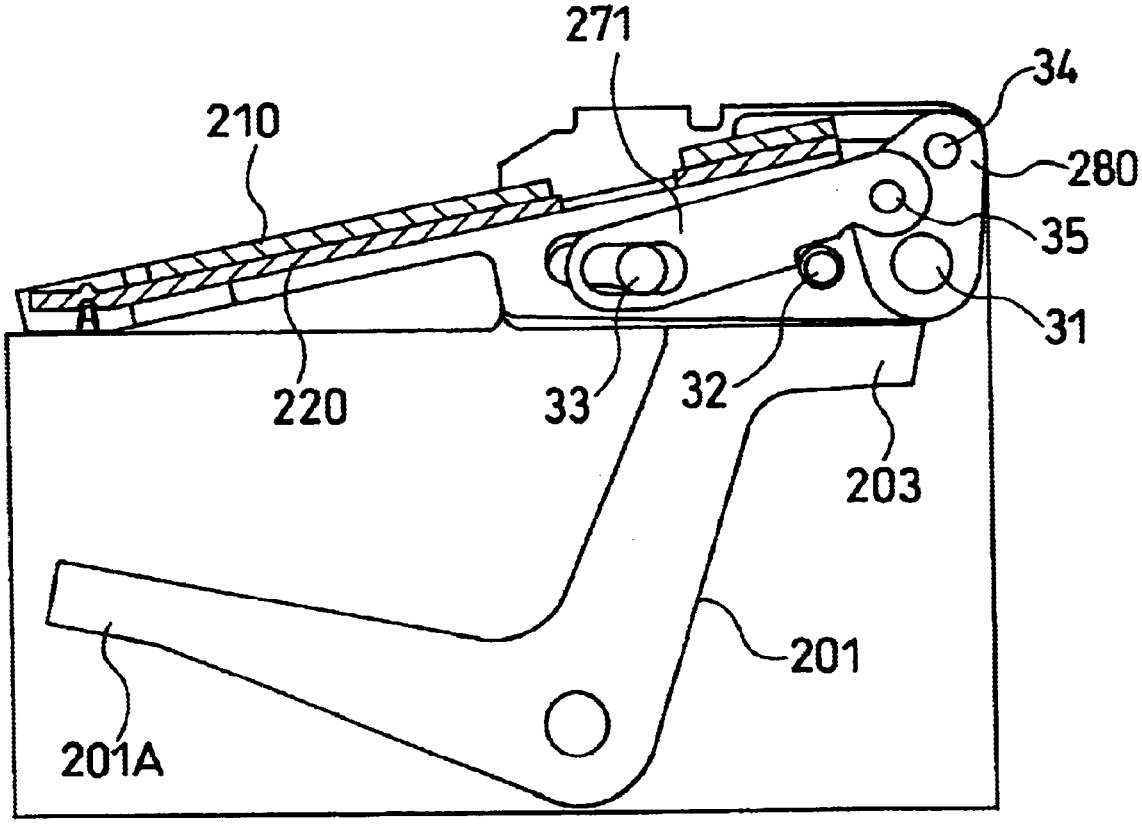
FIG. 72 is an explanatory chart illustrating the state of the release mechanism, when the front end of the clincher guide holds the sheet bundle.

On the other hand, the lifting-up of the forming holder 110 swings the clincher links 201 from the position (home position) illustrated in FIG. 69 and FIG. 70 to the position illustrated in FIG. 71 and FIG. 72 (time T4). This swing takes off the shaft 33 from the contact faces 202 of the clincher links 201, and off the shaft 32 from the supporting faces 203A of the clincher link 201. Thereby, the clincher guide 210 swings anticlockwise about the shaft 31 together with the clincher arm 220 by the energizing force of the spring 260.

As it swings to the position illustrated in FIG. 71 and FIG. 72, the clincher guide 210 holds the sheet bundle P mounted on the ceiling wall 630 of the cartridge 600 (time T5). On the other hand, the so of the clincher guide 210 and the clincher arm 220 takes off the shaft 32 from the recesses 254 of the suspended plates 251, and accordingly the suspended plates 251 move backward by the energizing force of the spring 260. This movement brings the slant aces 253A of the suspended plates 251 into contact with the shaft 32 and stops the suspended plates 251 at the position illustrated in FIG. 71. The clincher guide 210 is locked at the position illustrated in FIG. 71, by the suspended plates 251 (time T5).

And, as the forming holder 110 goes up to the position illustrated in FIG. 34, the bent portion 521 of the blade spring 520 pushes up the forming holder 110, the blade spring 620 bends as shown in FIG. 34 and FIG. 35. This bending moves the anvil 510 forward, and the end portion 512A of the anvil portion 512 retreats from the driving passage 601 of the cartridge 600 (time T6). At that moment, the forming holder 110 reaches the upper dead point, and the U-letter forming of the staple S1 is completed.

Figure 73:
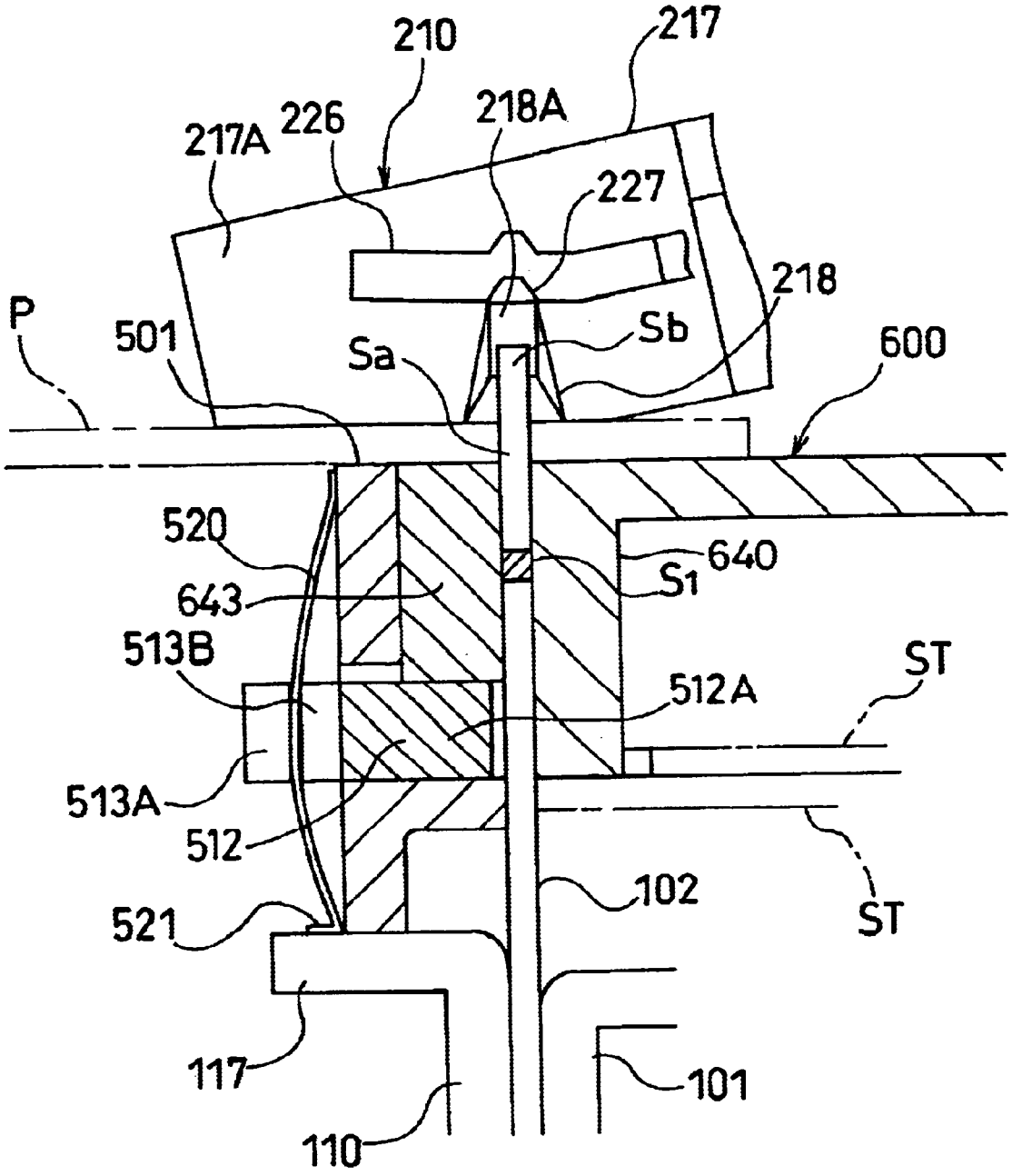
FIG. 73 is an explanatory chart of a state in which the staple is shot out.
Figure 74:
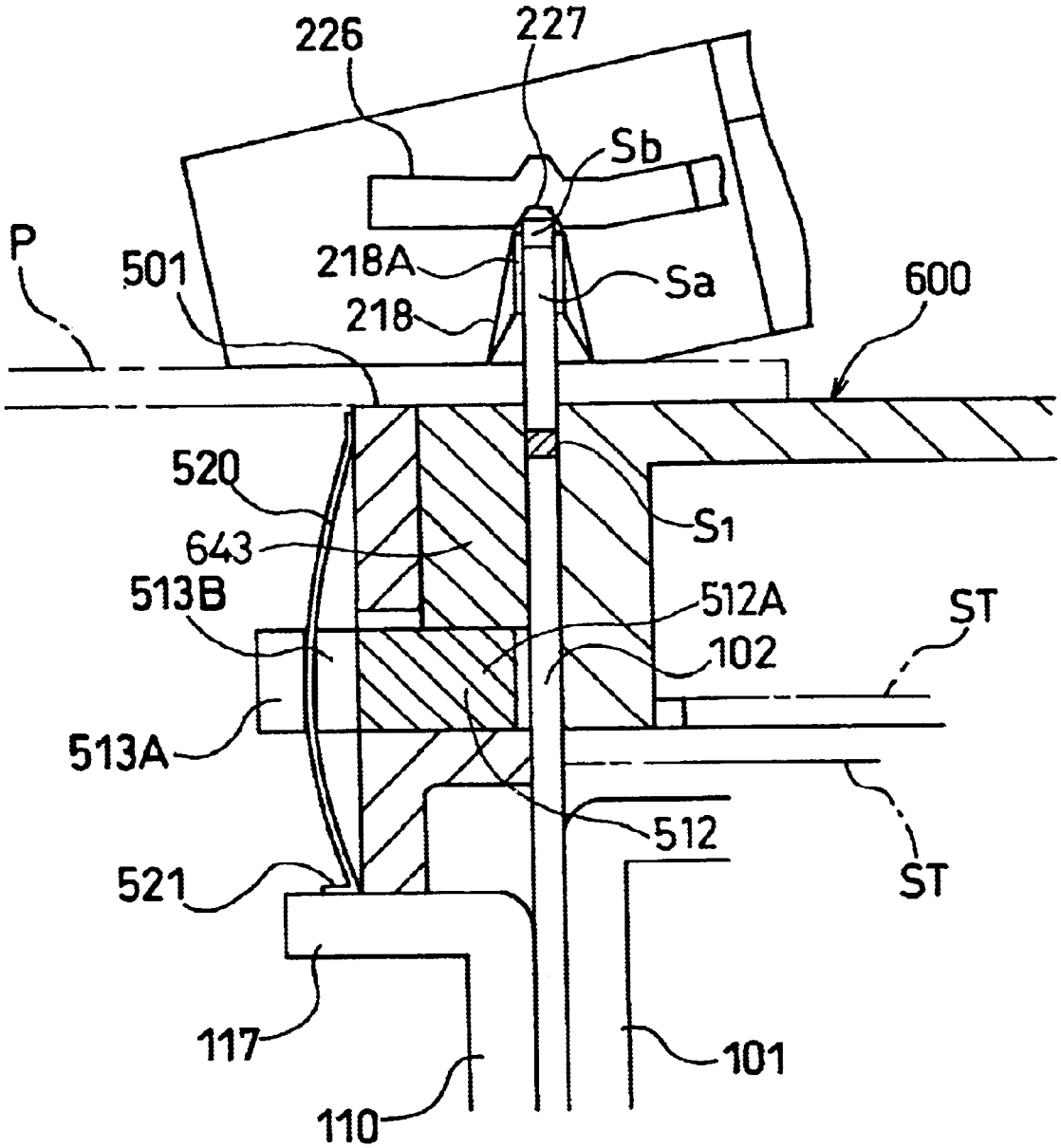
FIG. 74 is an explanatory chart of a state in which the staple is shot out and the ends of legs of the staple forward against the groove of the clincher arm.

Thereafter, the rotation of the driver cam 470 lifts up the driver holder 101, and the driver 102 pushes the staple S1 formed in the U-letter shape into the driving passage 601 and shoots out the staple S1 from the other end of the driving passage 601 (time T7). While the staple S1 is shot out from the other end of the driving passage 601, both the legs Sa of the staple S1 pierce through the sheet bundle P. As shown in FIG. 73, both front ends Sb of the legs Sa having penetrated the sheet bundle P forward against the recess 218 of the clincher guide 210. Further, accompanied with the lifting-up of the driver holder 101, the front ends Sb of the legs Sa are guided to the slopes 218A of the recess 218, where both the leg Sa are bent inward, and the front ends Sb forward against the groove 227 of the clincher arm 220 as shown in FIG. 74.

Figure 75:
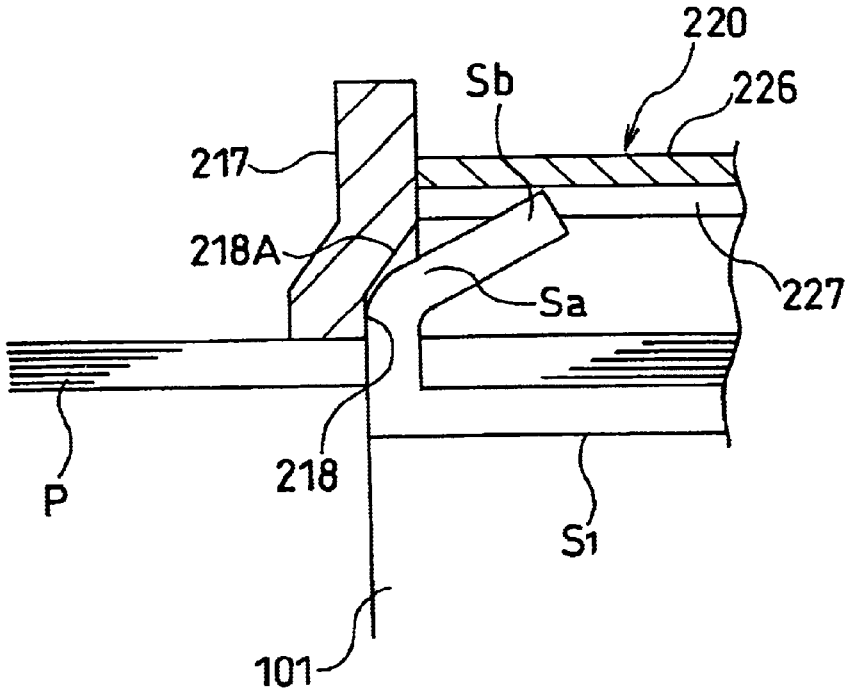
FIG. 75 is an explanatory chart of a state in which the legs of the staple shot out are going to be bent inward.

As the driver holder 101 reaches the upper dead point, the staple S1 is completely shot out from the other end of the driving passage 601 (time T8), and the front ends Sb of both the legs Sa of the staple S1 are guided into the groove 227 of the clincher arm 220 to bend both the legs Sa further inward as shown in FIG. 75, Now, a great amount of force is exerted on the front end of the clincher guide 210, when the staple S1 is shot out from the other end of the driving passage 601; however, being locked by the suspended plates 251, the clincher guide 210 is prevented from swinging clockwise. Further, by decreasing the angles of the slant faces 253A of the suspended plates 251 to the horizontal plane, the spring 260 having a small amount of energizing force will securely lock the cincher guide 210.

The decreasing of the energizing force of the spring 260 will decrease the size of the spring 260, and will lower impact noises generated when the front end of the clincher guide 210 collides to the sheet bundle P.

As the staple S1 is completely shot out from the driving passage 601, the forming holder 110 descends by the rotation of the forming return cam 473 (time T9). The descending of the forming holder 110 release the pushing-up of the bent portion 521 of the blade spring 520. Accompanied with this releasing, as shown in FIG. 32 and FIG. 33, the energizing force of the blade spring 520 moves the anvil 510 backward, and the end portion 512A of the anvil portion 512 passes through the notch 645 of the guide plate 643 of the cartridge 600 to enter directly before the driving passage 601 (time T10).

Further, the descending of the forming holder 110 swings the clincher links 201 anticlockwise from the position illustrated in FIG. 71 and FIG. 72. With this swing, the contact faces 202B of the clincher links 201 pushes the shaft. 33 forward. Thereby, the shaft 33 moves forward along the long holes 215 of the clincher guide 210, and accompanied with this forward movement of the shaft 33, the clincher arm 220 swings about the shaft 31 from the clincher guide 210. And, when the clincher links 201 swing to the position illustrated in FIG. 76 and FIG. 77, the clincher arm 220 swings to the position illustrated in FIG. 52 and FIG. 77, from the clincher guide 210 (time T11).

Figure 78:
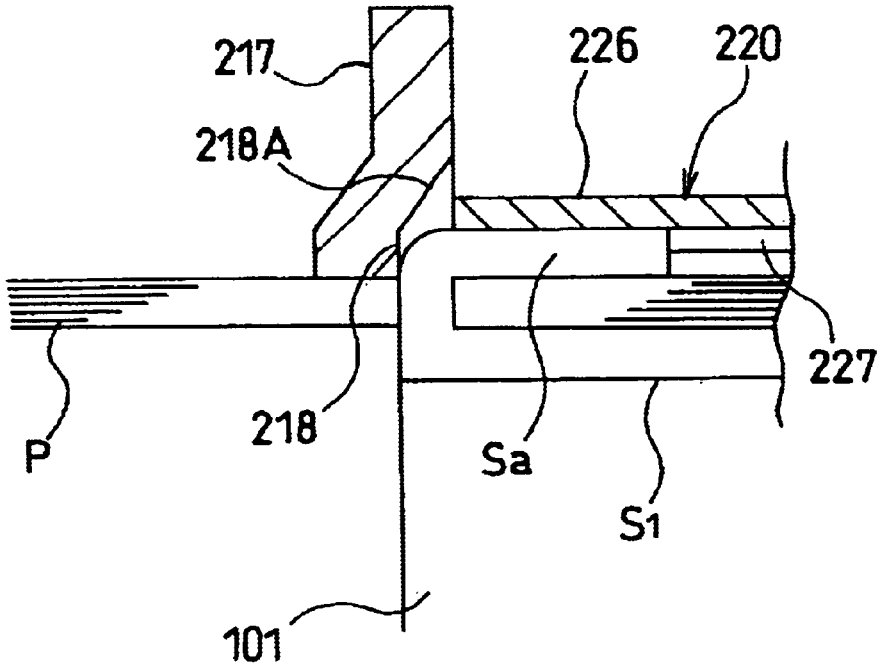
FIG. 78 is an explanatory chart of a state in which the legs of the staple are completely bent by the clincher arm.

Accompanied with this swing of the clincher arm 220, the clincher portion 226 goes down, which bends both the legs Sa of the staple S1 entered in the groove 227 of the clincher portion 226, as shown in FIG. 78. Thus, the descending of the clincher portion 226 of the clincher arm 220 bends both the legs Sa of the staple S1, whereby both the legs Sa thereof can be flattened completely. Further, the bending of both the legs Sa of the staple S1 is carried out by the swing of the clincher arm 220, and the construction of the clincher mechanism 200 is simplified accordingly.

Figure 76:
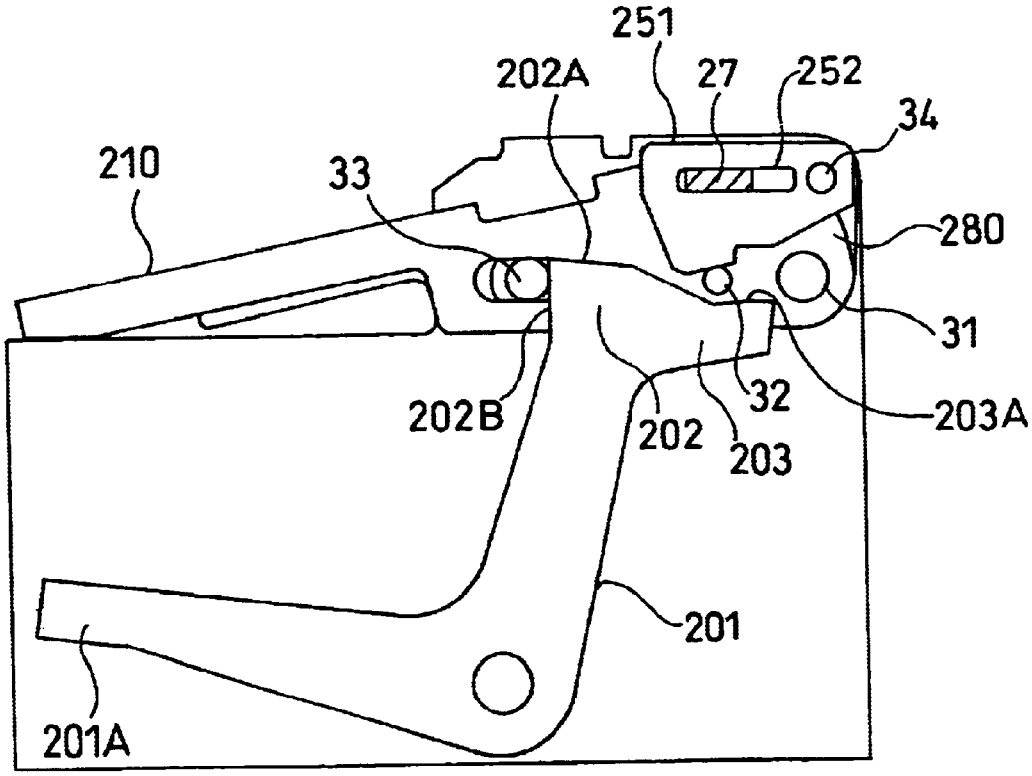
FIG. 76 is an explanatory chart illustrating the swing position of the clincher link, when the forming holder goes down from the upper dead point.
Figure 79:
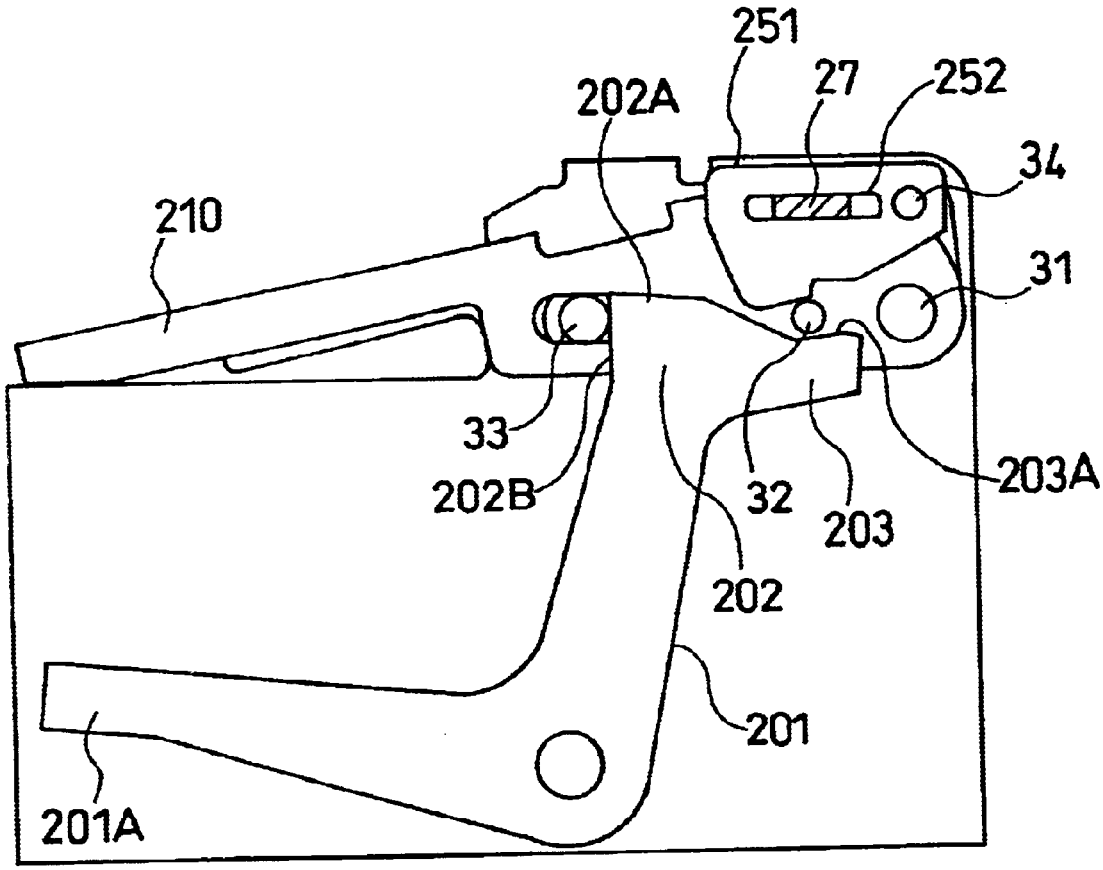
FIG. 79 is an explanatory chart of a state in which the clincher link slightly swings anticlockwise from the position illustrated in FIG. 76.
Figure 80:
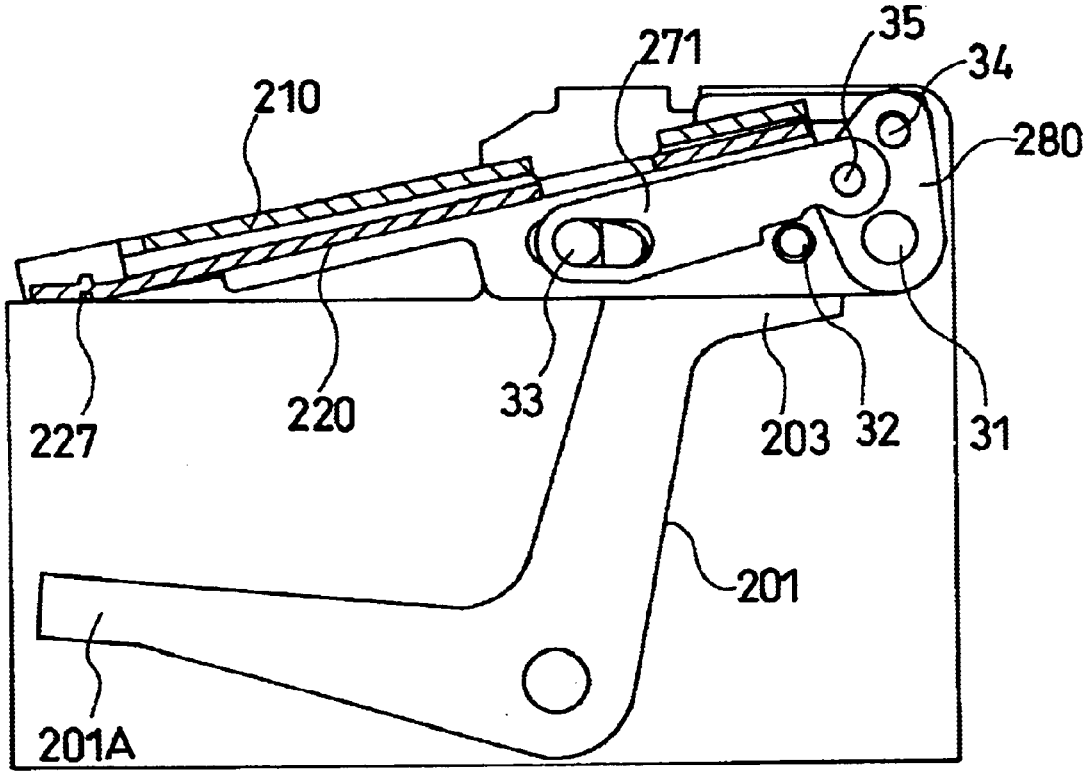
FIG. 80 is an explanatory chart illustrating the state of the release mechanism in which the clincher link swings to the position illustrated in FIG. 79.

As the descending of the forming holder 110 the clincher links 201 anticlockwise to the position illustrated in FIG. 79 and FIG. 80 from the position illustrated in FIG. 76 and FIG. 77 (time T13), the contact faces 202B of the clincher links 201 further pushes the shaft 33 forward. Thereby, the shaft 33 moves further forward along the long holes 215 of the clincher guide 210. This movement holds the clincher arm 220, during the time T11 to T12, at the position illustrated in FIG. 52 and FIG. 77, whereby both the legs Sa of the staple S1 are bent flat securely.

In the forward movement of the shaft 33, the first link plates 271 together with the shaft 33 move forward to turn the second link plates 280 about the shaft 31. The turning of the second link plates 280 moves the suspended plates 251 forward through the shaft 34 to release the lock of the clincher guide 210 (time T12).

As the clincher links 201 swing to the position illustrated in FIG. 79 and FIG. 80, the shaft 32 of the clincher guide 210 comes in contact with the supporting faces 203A of the clincher links 201. And, the rotation of the driver return cam 471 starts to descend the driver holder 101 (time T13).

Figure 81:
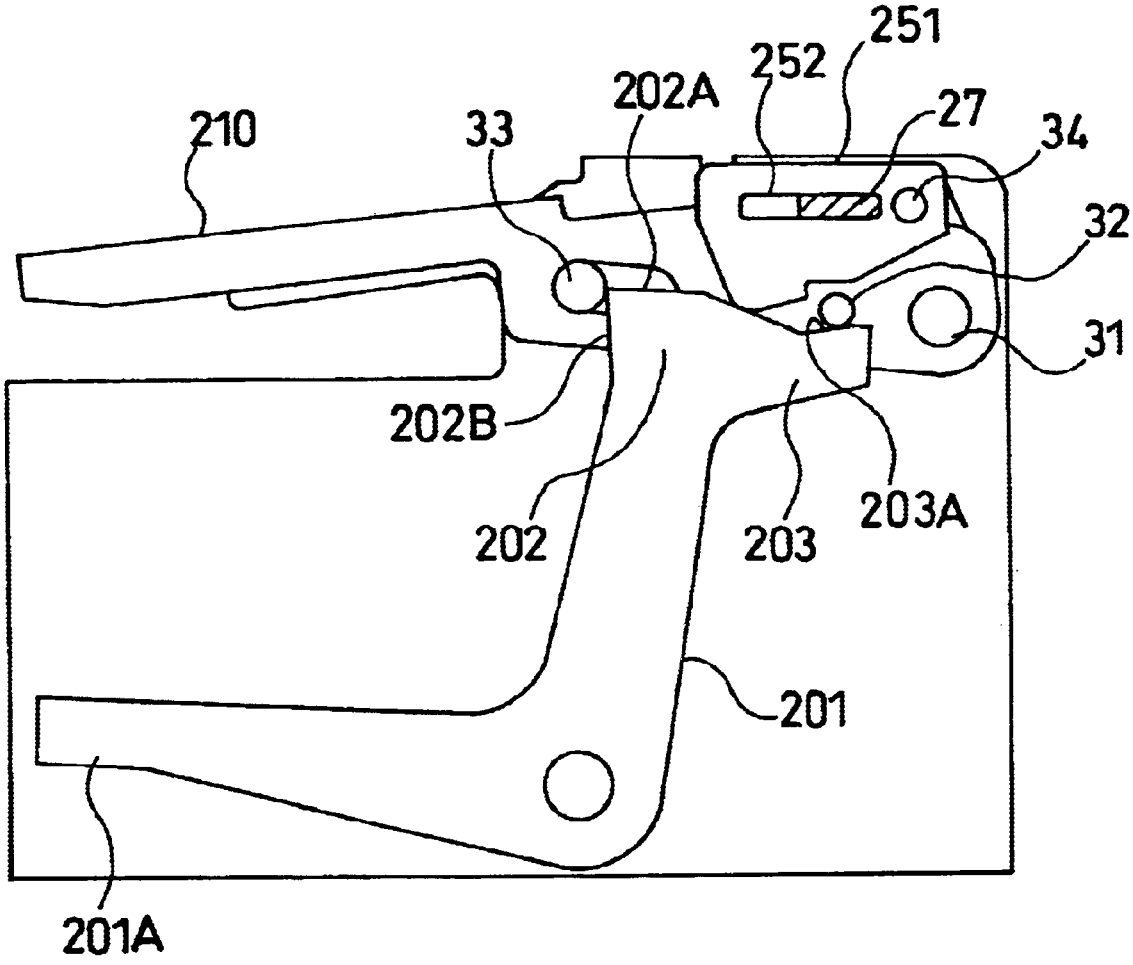
FIG. 81 is an explanatory chart of a state in which the lock mechanism releases the lock.
Figure 82:
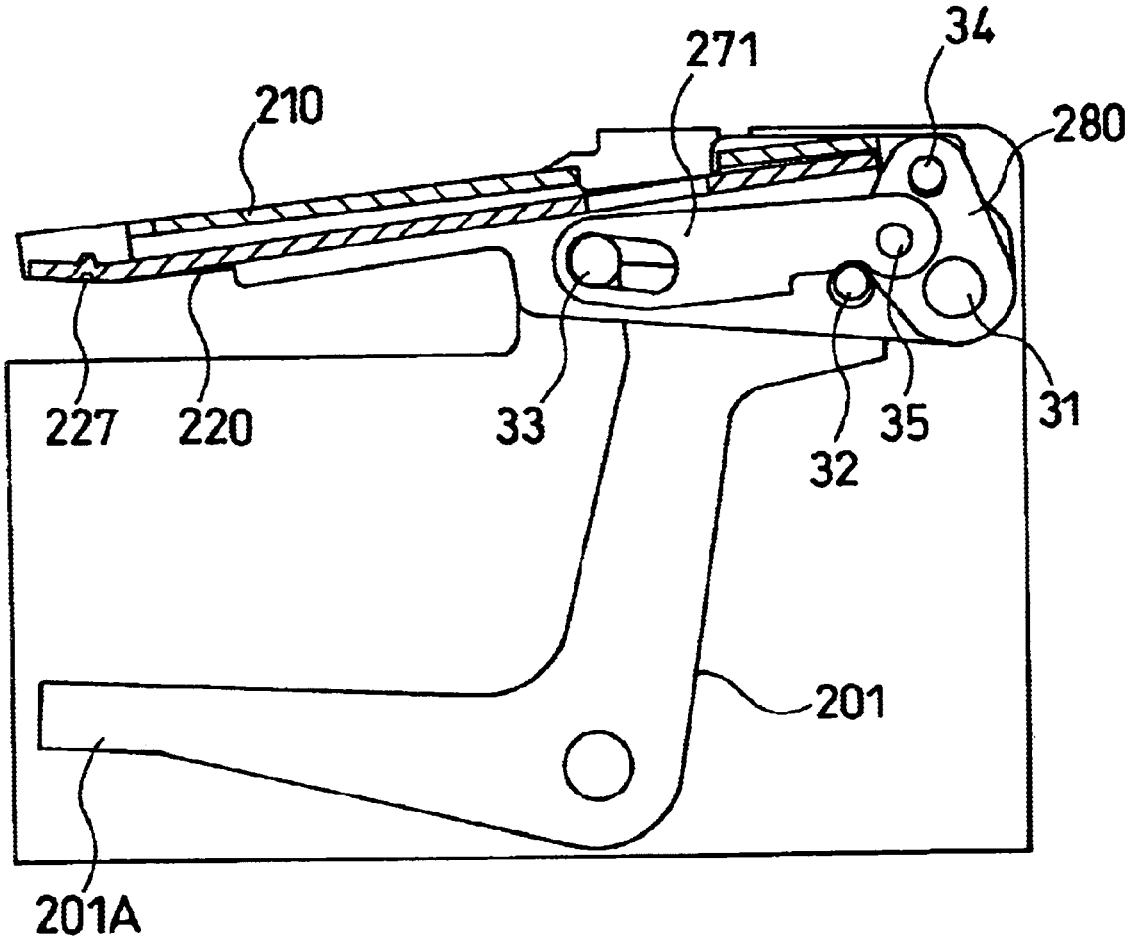
FIG. 82 is an explanatory chart illustrating the operation of the release mechanism.

In conjunction with the descending of the forming holder 110, as the clincher links 201 swing anticlockwise to the position illustrated in FIG. 81 and FIG. 82, the contact faces 202B of the clincher links 201 further push the shaft 33 forward to move the first link plates 271 to the position illustrated in FIG. 81 (time T14). The forward movement of the first link plates 271 is about double the movement of the first link plates 271, because the distance L2 between the shaft hole 281 and the shaft hole 283 is set to about double the distance L3 between the shaft hole 281 and the shaft hole 282. Therefore, a slight movement of the first link plates 271 will significantly move the suspended plates 251 to securely release the lock of the clincher guide 210.

On the other hand, when the clincher links 201 swing to the position illustrated in FIG. 81 and FIG. 82, the shaft 32 pushes up the supporting faces 203A of the clincher links 201, so that the clincher guide 210 as well as the clincher arm 220 swings clockwise about the shaft 31 against the energizing force of the spring 260. Since a small amount of the energizing force suffices for the spring 260, the load of the motor M becomes decreased.

And, as the driver 102 goes down to the specific position, accompanied with the descending of the driver holder 101, the end portion 512A of the anvil portion 512 goes into the driving passage 601 (time T14*a*).

Next, as the forming holder 110 goes down to the home position (time T15), the driver holder 101 also goes down to the position illustrated in FIG. 8, and the clincher links 201 turn to the position illustrated in FIG. 69 and FIG. 70. When the clincher links 201 come back to the position illustrated in FIG. 69 and FIG. 70, the shaft 33 comes off the contact acs 202B of the clincher links 201. Accordingly, the energizing force of the springs 227 moves the shaft 33 backward along the long holes 215 of the clincher guide 210. This movement of the shaft 33 swings the clincher arm 220 clockwise about the shaft 31 to the clincher guide 210.

Further, the shaft 32 attached to the clincher guide 210 is hooked in the recesses 254 of the suspended plates 261, and the shaft 33 is brought in contact with the contact faces 202A of the clincher links 201 by the energizing force of the spring 260. And, the switch 29 detects the clincher links 201 having come back to the home position illustrated in FIG. 69 and FIG. 70, thus stopping the drive of the motor M.

According to the electric stapler 1 of the embodiment, one rotation of the drive shaft 410 performs all the operations including the sending out of the sheet staple ST, the forming of the staple S in the U-letter shape, the shooting out of the staple S, and the like. Further, since the clinching operation of both the legs Sa of the staple S1 is achieved by the swing of the cincher arm 220, the structure thereof is very simple compared with a type of clinching mechanism that installs a pair of swing members on the right and left and cares out the clinching by the swing of the swing members, and therefore the stapler body 10 can be made up light in a small size.

Figure 83:
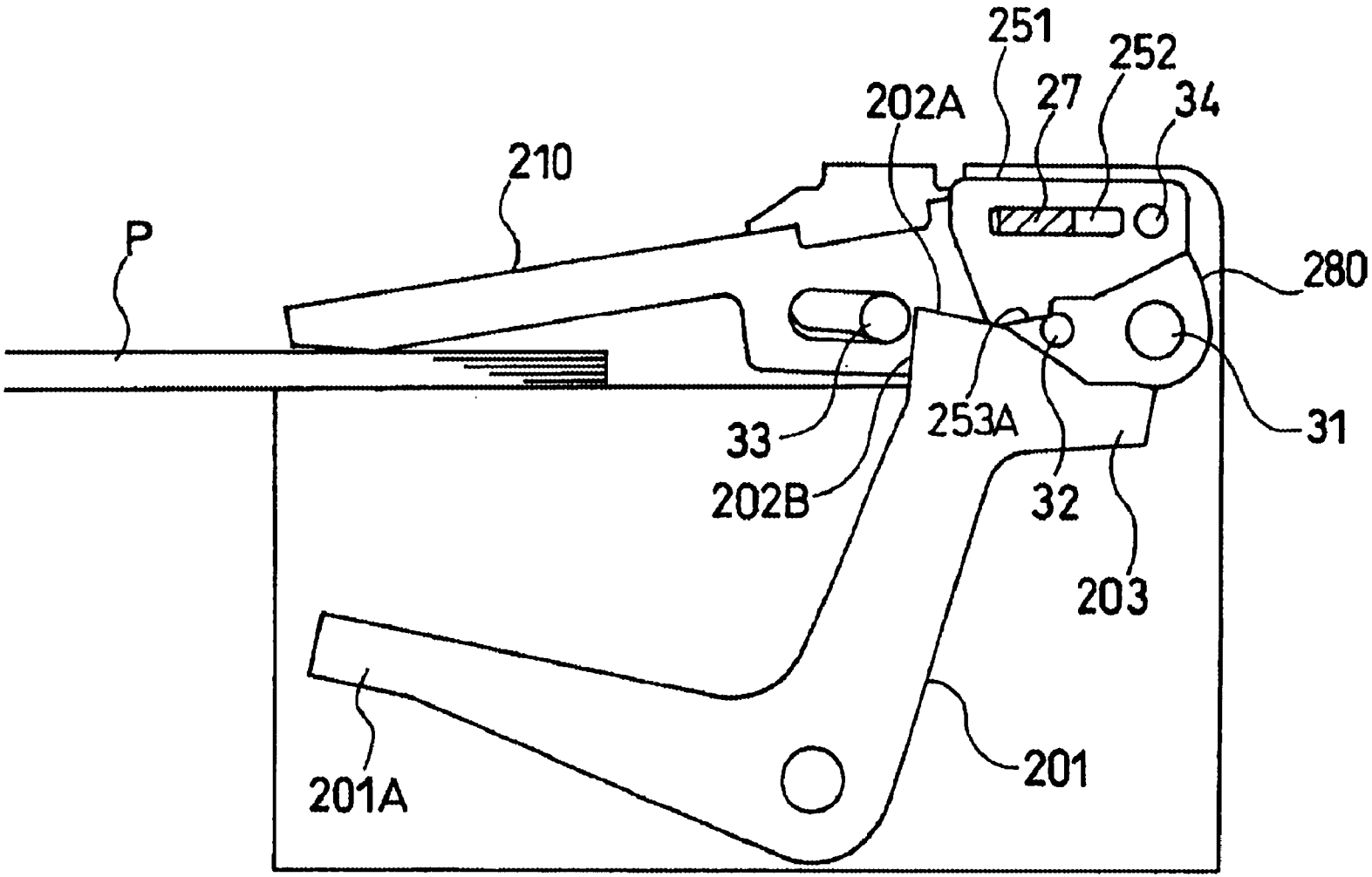
FIG. 83 is an explanatory chart of a state in which a buckling of the staple is prevented, when the sheet bundle P is considerably thick.

Now, in case that the sheet bundle P is considerably thick, as shown in FIG. 83, the swing of the clincher guide 210 becomes decreased compared with that in FIG. 71, and here the length L1 of the slant faces 253A is set in such a manner that the shaft 32 of the clincher guide 210 is in contact with the right ends (in FIG. 83) of the slant faces 253A of the suspended plate 251. Therefore, as the shooting out of the staple S gives an upward force to the front end of the clincher guide 210, the shaft 32 comes off from the slant faces 253A of the suspended plates 251. In consequence, the clincher guide 210 swings clockwise to go away, which prevents the buckling of the staple S.

That is, in case that the thickness of the sheet bundle P is more than a specific one, the clincher guide 210 goes off in the shooting of the staple S to avoid the buckling of the staple S. Thus, the buckling of the staple S will not clog up the driving passage 601 of the cartridge 600, and accordingly the drive holder 101 and the forming holder 110 will not stop on the way of lifting up, thereby preventing the lock of the drive shaft 410.

Further, the swing position of the clincher guide 210 varies depending on the thickness of the sheet bundle P, however the relative position of the clincher arm 220 to the clincher guide 210 does not vary depending on the swing position thereof as shown in FIG. 51, Therefore, the forward movement of the shaft 33, as shown in FIG. 52, swings the clincher arm 220 to the clincher guide 210 about the shaft 31, always by the specific angle regardless of the wing position. Therefore, the legs Sa of the sheet staple S can securely be clinched regardless of the thickness of the sheet bundle P.

Further, when the firming holder 110 stays at the home position, as shown in FIG. 44, the end portion 334A of the claw 334 of the sending plate 330 is pulled in down from the upper face of the base portion 302 of the slider 301. Therefore, in taking out the cartridge 600 from the stapler body 10, the end portion 334A of the claw 334 will not catch the sheet staple ST, whereby the cartridge 600 can be drawn out without a catch.

Further, according to the embodiment, since the blade spring portions 671, 677 press the sheet stale ST stacked in the chamber 603 of the cartridge 600, only a small space is needed for the layout of the blade spring portions 671, 677, and the chamber 603 with a low height can contain the sheet staple ST with increased number of stacking. Further, since the blade spring unit 650 has the blade spring portions 671, 677 and the check claws 654 formed thereon, only taking out the blade spring unit 650 will achieve the segregation processing. Besides, only pulling back the handle portion 678 of the blade spring unit 650 can take out the blade spring unit 650 from the cartridge body 602, thus the taking out can be done very easily.

Further, according to the embodiment, the motor M is placed under the cartridge 600 in such a manner that the motor spindle Ma of the motor M faces to the sending direction of the sleet staple ST, further the motor spindle Ma and the drive shaft 410 are disposed so as to be on one centric strait line, and the planet gears 425, 437, 444 for reduction are disposed along the drive shaft 410; and therefore, the planet gears 425, 437, 444 can be laid out along the longitudinal direction of the cartridge 600 so as to be overlapped, and they can be laid out within the width of the cartridge 600 accordingly. In addition, plural reduction gears are not necessary to be placed in parallel on the side walls in the direction perpendicular to the sending direction of the sheet staple ST, whereby the drive mechanism 400 that drives the drive shaft 410 can be made compact, and the stapler body 10 can be made compact. Further, since the cams 470 to 473 installed on the drive shaft 410 directly move up and down the driver holder 101 and the forming holder 110, the driver 102 and the forming plates 111F, 112F are not necessary to be provided with the link mechanism for the up-and-down movement thereof; and accordingly, the structure for the up-and-down movement can be simplified, and the stapler body 10 can be made still smaller.

Further, according to the embodiment, since the sending-out timing of the sheet staple ST by the slider 301 is determined by the notch 445 of the disc 441 of the drive gear holder 440, the sending-out timing thereof cm be set arbitrarily and precisely.

What is claimed is:

1. An electric stapler comprising:

sending means for sending out a sheet staple contained in a chamber toward one end of a driving passage;

a forming plate disposed to reciprocate in order to deform said sent out sheet staple in a predetermined shape;

a driver disposed to reciprocate in order to drive out said deformed sheet staple from said driving passage;

holder means for holding said forming plate and driver;

cam means engaging directly with said holder means for reciprocating said holder means;

a drive shaft having an end for supporting said forming plate, driver, holder means and cam means;

reduction gears supported on a second end of said drive shaft; and a motor which has a spindle connected with said reduction gears, wherein as the motor is rotated, said cam means is rotated and said forming plate and driver are reciprocated through said holder means by said rotation of the cam means, wherein said motor is position so that an axis of said spindle is disposed along a direction of sending out said sheet staple and axes of the spindle of said motor and said drive shaft are substantially positioned in line.

2. An electric stapler according to claim 1, wherein said holder means include a driver holder for holding said driver and a forming holder for holding said forming plate and said cam means include cams connected with said drive shaft for engaging with said driver holder and cams connected with said drive shaft for engaging with said forming plate.

3. An electric stapler according to claim 2, wherein said forming plate and drive are disposed adjacent with respect to each other between said driver and forming holder.

4. An electric stapler including a body case, a sending means that sends out a sheet staple contained in a chamber to one end of a driving passage, a forming plate and a driver disposed for reciprocation, a holder for holding the forming plate and the driver, a drive shaft for reciprocating the holder and a motor for rotating the drive shaft, in which a forward motion of the forming plate forms a staple sent out to one end of the driving passage in a u-letter shape, the forward motion of the driver shoots out the staple formed in the u-letter shape from the other end of the driving passage, and a clincher mechanism clinches the legs of the stapler shot out of the electric stapler, wherein the drive shaft is disposed on one centric straight line with a spindle of the motor and planet gears are disposed along the drive shaft for speed reduction and rotate the drive shaft by rotation of the motor spindle, the clincher mechanism including a clincher guide that has a rear portion pivoted rotatably to the body case and swings to hold a sheet bundle with a front end thereof and the body case, and a clincher arm disposed inside the clincher guide of which the rear portion is pivoted to the rear portion of the clincher guide to be swingable by a specific angle to the clincher guide, on a front portion of which is formed a bending groove for bending the legs of the staple; and the clincher guide swings to hold the sheet bundle with the front portion thereof in the body case, after the staple is driven to penetrate the sheet bundle, the clincher arm swings to the clincher guide by the specific angle, and the bending groove clinches the legs of the staple penetrated the sheet bundle.

5. An electric stapler as claimed in claim 4, wherein:

a long guide hole slant in a direction deflecting from the body case as it approaches toward the front end is formed on a first side wall formed on the clincher guide;

a long swing hole slant more than the long guide hole, of which rear portion faces to the rear portion of the long guide hole, is formed on a second side wall of the clincher arm formed to face to the first side wall;

a swing shaft inserted in the long guide hole and the long swing hole is provided which is movable along the long guide bole;

a spring is provided which energizes the clincher guide in a direction to close the front end of the clincher guide;

clincher links capable, of a reciprocating swing are provided which stop the clincher guide and the clincher arm at an initial position; and when the clincher links make a go swing, an energizing force of the spring swings the clincher guide and the clincher arm, and a return swing of the clincher links moves the swing shaft along the long guide hole to thereby swing the clincher arm by a specific angle to the clincher guide.

6. An electric stapler including a body case, a sending means that sends out a sheet staple contained in a chamber to one end of a driving passage, a forming plate and a driver disposed for reciprocation, a holder for holding the forming plate and the driver, a drive shaft for reciprocating the holder and a motor for rotating the drive shaft, in which a forward motion of the forming plate forms a staple sent out to one end of the driving passage in a u-letter shape, the forward motion of the driver shoots out the staple formed in the u-letter shape from the other end of the driving passage, and a clincher mechanism clinches the legs of the stapler shot our of the electric stapler, wherein the drive shaft is disposed on one centric straight line with a spindle of the motor and planet gears are disposed along the drive shaft for speed reduction and rotate the drive shaft by rotation of the motor spindle, wherein the clincher mechanism includes a clincher guide having a bending groove to bend the legs of the staple on a front portion thereof and a rear portion pivoted rotatably to the body case, which swings to hold a sheet bundle with the front end in the body case, and a check plate, when the clincher guide swings to hold the sheet bundle with the front portion of the body case, controls the clincher guide to swing in the direction opposite to the direction in which the sheet bundle is held.

7. An electric stapler as claimed in claim 6, wherein:

the sending means includes a sending plate having a slider that reciprocates back and forth and a sending claw attached to the slider that hooks the staple of the sheet staple;

and a pressing member that, when the slider is at a standby position, presses the sending plate to remove the sending claw from the staple.

8. An electric stapler as claimed in claim 7, wherein:

the slider slides on a sliding face formed on one side of the sheet staple;

the sending plate is attached on the opposite side of the sheet staple on the slider, and the sending claw thrusts out from the other side of the slider to hook the staple of the sheet staple;

the slider has a recess that allows a bending of the sending plate formed on a face thereof where the sending plate is attached; and when the slider is in the standby position, the pressing member presses to bend the sending plate into the recess, and this bending pulls back the sending claw.

9. An electric stapler as claimed in claim 7, including an energizing member that energizes the sending means forward, and a disc rotatably disposed before the sending means to accept the sending means, wherein:

the disc is provided with a notch that moves the sending means forward within a specific region of rotation angle and a guide means that returns the sending means to the standby position.

10. An electric stapler including a body case, a sending means that sends out a sheet staple contained in a chamber to one end of a driving passage, a forming plate and a driver disposed for reciprocation, a holder for holding the forming plate and the driver, a drive shaft for reciprocating the holder and a motor for rotating the drive shaft, in which a forward motion of the forming plate forms a staple sent out to one end of the driving passage in a u-letter shape, the forward motion of the driver shoots out the staple formed in the u-letter shape from the other end of the driving passage, and a clincher mechanism clinches the legs of the stapler shot out of the electric stapler, wherein the drive shaft is disposed on one centric straight line with a spindle of the motor and planet gears are disposed along the drive shaft for speed reduction and rotate the drive shaft by rotation of the motor spindle, the clincher mechanism includes a clincher guide that has a rear portion pivoted rotatably to the body case and swings to hold a sheet bundle with a front end thereof and a body case, and a clincher arm disposed inside the clincher guide of which rear portion is pivoted to the rear portion of the clincher guide to be swingable by a specific angle to the clincher guide, on a front portion which is between the side walls of which rear portion is pivoted to the rear portion of the clincher guide to be swingable by a specific angle to the clincher guide;

the clincher arm has a flat groove formed on the front portion thereof extending in the cross direction, which bends the legs of the staple;

the side walls have recesses formed on the insides thereof having slopes slanted inwardly as they are away from the body case, which guide the legs of the staple into the flat groove; and after the staple is driven to penetrate the sheet bundle, the clincher arm swings to the clincher guide by the specific angle, and the flat groove clinches the legs of the staple penetrated the sheet bundle.

11. An electric stapler including a body case, a sending means that sends out a sheet staple contained in a chamber to one end of a driving passage, a forming plate and a driver disposed for reciprocation, a holder for holding the forming plate and the driver, a drive shaft for reciprocating the holder and a motor for rotating the drive shaft, in which a forward motion of the forming plate forms a staple sent out to one end of the driving passage in a u-letter shape, the forward motion of the driver shoots out the staple formed in the u-letter shape from the other end of the driving passage, and a clincher mechanism clinches the legs of the stapler shot out of the electric stapler, wherein the drive shaft is disposed on one centric straight line with a spindle of the motor and planet gears are disposed along the drive shaft for speed reduction and rotate the drive shaft, wherein the clincher mechanism includes:

a clincher body that makes a forward motion, of which front portion holds a sheet bundle mounted on the other end of the driving passage; and a link member that makes a reciprocating swing by a reciprocating motion of the holder, and a fixing means that fixes the clincher body at a position where the front portion holds the sheet bundle;

the clincher body has a clincher that includes the legs of the staple penetrated the sheet bundle; and the reciprocating swing of the link member carries out holding the sheet bundle by the clincher body, fixing the clincher body by the fixing means, clinching the legs of the staple by the clincher releasing the fixing of the clincher body, and releasing the holding of the sheet bundle.

* * * * *